US007396638B2

(12) United States Patent
Nariyuki

(10) Patent No.: US 7,396,638 B2
(45) Date of Patent: Jul. 8, 2008

(54) PHOTOTHERMOGRAPHIC MATERIAL AND IMAGE FORMING METHOD

(75) Inventor: Fumito Nariyuki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 10/766,939

(22) Filed: Jan. 30, 2004

(65) Prior Publication Data

US 2004/0218033 A1 Nov. 4, 2004

(30) Foreign Application Priority Data

Feb. 6, 2003 (JP) ..... 2003-029781

(51) Int. Cl.
*G03C 5/16* (2006.01)
*G03C 1/498* (2006.01)

(52) U.S. Cl. ..... 430/350; 430/264; 430/607; 430/613; 430/619; 430/945

(58) Field of Classification Search ..... 430/350, 430/619, 567, 945, 264, 607, 613
See application file for complete search history.

(56) References Cited

U.S. PATENT DOCUMENTS 4,332,889 A * 6/1982 Siga et al. ..... 430/583
5,656,419 A * 8/1997 Toya et al. ..... 430/619
5,958,668 A * 9/1999 Matsumoto et al. ..... 430/619
5,998,126 A * 12/1999 Toya et al. ..... 430/619
6,120,983 A * 9/2000 Okada et al. ..... 430/619
6,143,488 A * 11/2000 Uytterhoeven et al. ..... 430/619
2003/0194659 A1* 10/2003 Ohzeki et al. ..... 430/350
2003/0207216 A1* 11/2003 Fukui et al. ..... 430/350
2003/0235794 A1* 12/2003 Yoshioka ..... 430/566
2004/0033454 A1* 2/2004 Ohzeki et al. ..... 430/619
2004/0038161 A1* 2/2004 Ohzeki ..... 430/619

FOREIGN PATENT DOCUMENTS

EP 1276006 A 1/2003
EP 1276007 A 1/2003

* cited by examiner

*Primary Examiner*—Thorl Chea
(74) *Attorney, Agent, or Firm*—Margaret A. Burke; Sheldon J. Moss

(57) ABSTRACT

The present invention relates to a photothermographic material including, on a same surface of a support, a photosensitive silver halide, a non-photosensitive organic silver salt, a reducing agent and a binder, wherein the photosensitive silver halide has a silver iodide content within a range from 40 to 100 mol %, and the material is thermally developed within a developing time of 12 seconds or less. The invention also relates to an image forming method using the photothermographic material.

15 Claims, No Drawings

PHOTOTHERMOGRAPHIC MATERIAL AND IMAGE FORMING METHOD

CROSS-REFERENCE TO RELATED APPLICATION

This application claims priority under 35 USC 119 from Japanese patent Application No. 2003-029781, the disclosure of which is incorporated by reference herein.

BACKGROUND OF THE INVENTION

1. Field of the Invention

The present invention relates to a photothermographic material and an image forming method, and more particularly to a novel photothermographic material having an excellent printout property and having improved unprocessed stock storability and to an image forming method using the photothermographic material.

2. Description of the Related Art

In recent years, there is a need in the medical field to reduce the amount of waste processing liquids in consideration of environmental conservation and space-saving. For this reason, there is a need for a technology for a photothermographic material for medical diagnosis and for photographic applications, the technology being capable of efficient exposure with a laser image setter or a laser imager and capable of forming a sharp black image with a high resolution and a high sharpness. Such a photothermographic material can eliminate use of processing chemicals in solutions and can provide users with a thermal development system which is simpler and does not destruct the environment.

Although similar requests are present in the ordinary image forming materials, an image for medical use has to have a particularly high image quality with an excellent sharpness and granularity because a precise image is required. Also there is preferred an image of cold black tone in order to facilitate diagnosis. Currently, various hard copy systems utilizing pigments or dyes, such as an ink jet system and an electrophotographic system, are available as ordinary image forming systems, but no such system yet is satisfactory as an output system for medical images.

Thermal image forming systems utilizing an organic silver salt are known. Such systems are disclosed in, for example, U.S. Pat. Nos. 3,152,904 and 3,457,075, and D. Klosterboer, *Thermally Processed Silver Systems*, ed. Sturge, V. Walworth and A. Shepp (Imaging Processes and Materials, Neblette 8th edition, 1989), chapter. 9, p. 279. More specifically, a photothermographic material generally has a photosensitive layer in which a photocatalyst (for example silver halide) in a catalytically active amount, a reducing agent, a reducible silver salt (for example organic silver salt) and a toning agent for regulating tone of silver if necessary, are dispersed in a matrix binder. The photothermographic material is heated, after image-wise exposure, to a high temperature (for example 80° C. or higher) whereby a black silver image is formed through a redox reaction between the silver halide or the reducible silver salt (acting as an oxidizing agent) and the reducing agent. The redox reaction is accelerated by a catalytic effect of a silver halide latent image, which is formed by the exposure to light. Therefore, a black silver image is formed in an exposed area (see, for example, U.S. Pat. No. 2,910,377 and JP-B No. 43-4924). As a medical image forming system utilizing a photothermographic material, Fuji Medical Dry Imager FM-DPL is available.

A thermal image forming material utilizing an organic silver salt may be prepared by solvent coating, or by coating and drying a coating solution containing an aqueous dispersion of fine polymer particles as a main binder. The latter method can be applied with a simple manufacturing facility and is advantageous to a mass production since solvent recovery and the like are unnecessary.

A photothermographic material generally has an image forming layer in which a photocatalyst (for example silver halide) in a catalytically active amount, a reducing agent, a reducible silver salt (for example organic silver salt), and the like are dispersed in a matrix binder.

A photothermographic material has a big problem that a reducing reaction of silver ions proceeds when exposed to indoor light after an image formation or when exposed to a high temperature during storage, thereby generating a fog. The reducing reaction proceeds because unreacted compounds are unremoved from the photosensitive material after a thermal development process and such compounds remain in the photothermographic material. Consequently, it has been requested to develop a technology for improving image storability.

Regarding a method for improving the image storability, a polyhalogen compound is known to be effective, which oxidatively decompose unnecessary fogging silver which is generated in a processed photothermographic material with time (for example cf. JP-A No. 2001-33911). Also there is disclosed a complex forming agent capable of forming a complex with a developing agent, thereby suppressing an undesirable reducing reaction during storage (for example cf. JP-A Nos. 2002-156727 and 2002-318431). However, even these technologies can reduce a "printout", an increase in the fog level under an exposure to light, only insufficiently, and a further improvement is therefore requested.

As a result of intensive investigation, it was found that the printout could be significantly improved by using a silver iodide emulsion as a photosensitive silver halide (for example cf. JP-A No. 2001-209145 and EP Nos. 1276006 and 1276007). However, it has been found that a silver iodide emulsion involves a problem of a sensitivity loss in a photothermographic material during a storage period from a manufacture thereof to a laser exposure or a thermal development for image formation. Since such sensitivity loss becomes larger as a temperature or a humidity during storage becomes higher, and the sensitivity loss increases with time, it is not possible to obtain a constant sensitivity in use. Further, it is unable to predict the tendency of sensitivity loss in advance, thus there is a need for a stabilization of the sensitivity.

SUMMARY OF THE INVENTION

In consideration of the foregoing, an object of the present invention is to provide a novel photothermographic material having an improved printout property and an improved unprocessed stock storability. Another object of the invention is to provide an image forming method using the photothermographic material.

Such object of the invention can be achieved by the following aspects of the invention.

A first aspect of the invention provides an image forming method (S) comprising:

exposing to a radiation source a photothermographic material comprising, on a same surface of a support, a photosensitive silver halide having a silver iodide content of 40 to 100 mol %, a non-photosensitive organic silver salt, a reducing agent and a binder; and thermally developing the photothermographic material with a developing time of 1 to 12 seconds.

A second aspect of the invention provides the image forming method (S), wherein the developing time is 2 to 10 seconds.

A third aspect of the invention provides the image forming method (S), wherein the thermal development is conducted at a temperature of 80 to 250° C.

A fourth aspect of the invention provides the image forming method (S), wherein the thermal development is conducted at a temperature of 100 to 140° C.

A fifth aspect of the invention provides the image forming method (S), wherein the photothermographic material further includes an antifogging agent.

A sixth aspect of the invention provides the image forming method (S), wherein the photosensitive silver halide has an average grain size of 5 to 50 nm.

A seventh aspect of the invention provides the image forming method (S), wherein the photothermographic material further includes a development accelerator.

An eighth aspect of the invention provides the image forming method (S), wherein the photothermographic material further includes a compound represented by the following formula (H):

$$Q—(Y)_n—C(Z_1)(Z_2)X \qquad \text{Formula (H)}$$

wherein in formula (H), Q represents an alkyl group, an aryl group or a heterocyclic group; Y represents a divalent connecting group; n represents 0 or 1; $Z_1$ and $Z_2$ each independently represent a halogen atom; and X represents a hydrogen atom or an electron attracting group.

A ninth aspect of the invention provides the image forming method (S), wherein the photothermographic material further includes a toning agent.

A tenth aspect of the invention provides the image forming method (S), wherein the photothermographic material further includes a ultra-high contrast agent.

An eleventh aspect of the invention provides the image forming method (S), wherein the photothermographic material further includes a matting agent.

A twelfth aspect of the invention provides the image forming method (S), wherein the radiation source was a laser.

A thirteenth aspect of the invention provides the image forming method (S), wherein the laser has a light emission peak intensity within a wavelength range of 350 to 450 nm.

A fourteenth aspect of the invention provides the image forming method (S), wherein the reducing agent is a compound represented by the following formula (R-1):

Formula (R-1)

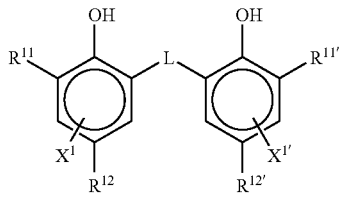

wherein in formula (R-1), $R^{11}$ and $R^{11'}$ each independently represent an alkyl group having 1 to 20 carbon atoms; $R^{12}$ and $R^{12'}$ each independently represent an alkyl group having 2 to 20 carbon atoms; L represents a —S— group or a —$CHR^{13}$— group; $R^{13}$ represents a hydrogen atom or an alkyl group having 1 to 20 carbon atoms; $X^1$ and $X^{1'}$ each independently represent a hydrogen atom or a group that can substitute a benzene ring.

A fifteenth aspect of the invention provides a photothermographic material (T) comprising, on a same surface of a support, a photosensitive silver halide, a non-photosensitive organic silver salt, a reducing agent and a binder, wherein the photosensitive silver halide has a silver iodide content of 40 to 100 mol %, and the material is thermally developed within a developing time of 1 to 12 seconds.

A sixteenth aspect of the invention provides the photothermographic material (T), wherein the photosensitive silver halide has an average grain size of 5 to 50 nm.

A seventeenth aspect of the invention provides the photothermographic material (T), further comprising a development accelerator.

An eighteenth aspect of the invention provides the photothermographic material (T), further comprising a antifogging agent.

A nineteenth aspect of the invention provides the photothermographic material (T), further comprising a compound represented by the following formula (H):

$$Q—(Y)_n—C(Z_1)(Z_2)X \qquad \text{Formula (H)}$$

wherein in formula (H), Q represents an alkyl group, an aryl group or a heterocyclic group; Y represents a divalent connecting group; n represents 0 or 1; $Z_1$ and $Z_2$ each independently represent a halogen atom; and X represents a hydrogen atom or an electron attracting group.

A twentieth aspect of the invention provides the photothermographic material (T), wherein the reducing agent is a compound represented by the following formula (R-1):

Formula (R-1)

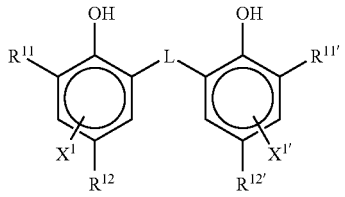

wherein in formula (R-1), $R^{11}$ and $R^{11'}$ each independently represent an alkyl group having 1 to 20 carbon atoms; $R^{12}$ and $R^{12'}$ each independently represent an alkyl group having 2 to 20 carbon atoms; L represents a —S— group or a —$CHR^{13}$— group; $R^{13}$ represents a hydrogen atom or an alkyl group having 1 to 20 carbon atoms; $X^1$ and $X^{1'}$ each independently represent a hydrogen atom or a group that can substitute a benzene ring.

In this specification, the term "unprocessed stock storability" refers to storage stability during a storage period of a photothermographic material from a manufacture thereof by coating and drying to an exposure and development. On the other hand, the term "image storability" refers to storage stability of an image after thermal development.

The present inventor has conducted intensive analyses and investigations on the unprocessed stock storability of a photothermographic material which utilizies a photosensitive silver halide with a high silver iodide content of 40 to 100 mol %. As the result of the investigations, the inventor has found a fact that although the sensitivity decrease is very large when the performance is evaluated with an ordinarily employed developing time of 20 to 60 seconds, the sensitivity decrease does not occur with a short-time development of 12 seconds or less. Accordingly the inventor has made the invention. The inventor has also reached preferred embodiments capable of attaining a higher sensitivity and a sufficient image intensity with a short-time development.

DETAILED DESCRIPTION OF THE INVENTION

In the following, the present invention will be explained in detail.

Explanation of Organic Silver Salt

1) Composition

The organic silver salt used in the invention is a silver salt which is relatively stable to light but functions as a silver ion supplying substance when heated to 80° C. or higher in the presence of an exposed photosensitive silver halide and a reducing agent, thereby forming a silver image. The organic silver salt may be an arbitrary organic substance that can supply a silver ion which can be reduced by a reducing agent. Such non-photosensitive organic silver salt is described, for example, in JP-A No. 10-62899, paragraphs 0048-0049, EP-A No. 0803764A1, page 18, line 24 to page 19, line 37, EP-A No. 0962812A1, and JP-A Nos. 11-349591, 2000-7683 and 2000-72711. The non-photosensitive organic silver salt may be preferably a silver salt of an organic acid, particularly a silver salt of a long-chain aliphatic carboxylic acid (with 10 to 30 carbon atoms, preferably with 15 to 28 carbon atoms). Preferable examples of the aliphatic acid silver salt include silver lignocerate, silver behenate, silver arachidate, silver stearate, silver oleate, silver laurate, silver caproate, silver myristate, silver palmitate, silver erucate and mixtures thereof. In the invention, it is further preferable to use an aliphatic acid silver salt having a silver behenate content of 50 to 100 mol %, more preferably 85 to 100 mol % and further preferably 95 to 100 mol %. It is also preferable to use an aliphatic acid silver salt having a silver erucate content of 2 mol % or less, more preferably 1 mol % or less and further preferably 0.1 mol % or less.

A silver stearate content is preferably 1 mol % or less. By setting a silver stearate content at 1 mol % or less, an organic acid silver salt having a low Dmin, a high sensitivity, and an excellent image storability can be obtained. The silver stearate content is more preferably 0.5 mol % or less and it is particularly preferable that silver stearate should be substantially absent.

When the silver salt of organic acid includes silver arachidate, it is preferable to set a silver arachidate content at 6 mol % or less, more preferably 3 mol % or less, in order to obtain an organic acid silver salt providing a low Dmin and an excellent image storability.

2) Shape

The shape of the organic silver salt used in the invention is not particularly restricted, and may have an acicular shape, a rod shape, a flat shape or a scale shape.

In the invention, an organic silver salt of scale shape is preferable. There is also advantageously used a grain of a short acicular shape with a ratio of a longer axis to a shorter axis not exceeding 5, a rectangular parallelepiped shape, a cubic shape or a potato-like amorphous shape. An organic silver salt grain having such a shape has an advantage of a lower fog level at thermal development in comparison with a grain of a long acicular shape having a ratio of a longer axis to a shorter axis larger than 5. In particular, a grain with a ratio of a longer axis to a shorter axis equal to or less than 3 is preferable because of an improved mechanical stability of a coated film. In the present specification, an organic silver salt of a scale shape is defined in the following manner. The organic silver salt grain is observed under an electron microscope, and the grain shape is approximated by a rectangular parallelepiped with sides a, b and c in the order of increasing length (c may be equal to b), and following value x is determined by the smaller values a and b in the following manner:

$$x=b/a$$

The value x is calculated with respect to about 200 grains to determine an average value "x(average)". A scale shape is defined by a relation x(average)≧1.5. A scale-shaped grain preferably satisfy a relation 30≧x(average)≧1.5, more preferably 15≧x(average)≧1.5. For reference, an acicular shape is defined by 1≦x(average)≦1.5.

In a scale-shaped grain, the value a can be regarded as a thickness of a plate-shaped grain having a principal plane defined by sides b and c. An average of the value a is preferably within a range from 0.01 to 0.3 μm, more preferably from 0.1 to 0.23 μm. Also an average of c/b is preferably within a range from 1 to 9, more preferably 1 to 6, further preferably from 1 to 4, and most preferably from 1 to 3.

A sphere-corresponding diameter maintained within a range from 0.05 to 1 μm hinders coagulation in the photosensitive material and provides a satisfactory image storability. The sphere-corresponding diameter is preferably 0.1 to 1 μm. In the invention, the sphere-corresponding diameter can be determined by taking a photograph of a sample by an electron microscope and then executing an image processing on the negative.

In the aforementioned scale-shaped grains, a ratio of (sphere-corresponding diameter)/a of the grain is defined as an aspect ratio. The aspect ratio of the scale-shaped grain is preferably within a range of 1.1 to 30 in view of hindering coagulation in the photosensitive material and improving the image storability, more preferably from 1.1 to 15.

A grain size distribution of the organic silver salt is preferably a monodispersion. Monodispersion means that a percentage of a standard deviation of each length of the shorter axis and the longer axis, divided respectively by the shorter axis or the longer axis, is preferably 100% or less, more preferably 80% or less and further preferably 50% or less. The shape of the organic silver salt can be measured from a transmission electron microscope image of an organic silver salt dispersion. The monodispersion property can also be measured by determining a standard deviation of a volume-weighted average diameter of the organic silver salt, and a percentage (variation factor) obtained by dividing the standard deviation of a volume-weighted average diamter by the volume-weighted average diameter is preferably 100% or less, more preferably 80% or less and further preferably 50% or less. A commercially available particle size measuring apparatus of laser scattering type can be used for the measurement.

3) Preparation

For preparing and dispersing the organic silver salt to be employed in the invention, a known method can be employed. For example, reference may be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868.

Since the presence of a photosensitive silver salt at dispersion of the organic silver salt increases fog level and significantly decreases sensitivity, it is preferable that the photosensitive silver salt should be substantially absent at the dispersion. In the invention, the amount of the photosensitive silver salt in an aqueous dispersion of an organic silver salt is preferably 1 mol % or less per 1 mole of organic silver salt in the dispersion, more preferably 0.1 mol % or less, and further preferably no positive addition of the photosensitive silver salt should be executed.

In the invention, the photosensitive material can be prepared by mixing an aqueous dispersion of the organic silver salt and an aqueous dispersion of the photosensitive silver salt. A mixing ratio of the organic silver salt and the photosensitive silver salt can be selected according to the purpose, however a proportion of the photosensitive silver salt to the organic silver salt is preferably within a range of 1 to 30 mol %, more preferably 2 to 20 mol %, and particularly preferably 3 to 15 mol %. At the mixing, there is preferably employed a method of mixing two or more aqueous dispersions of organic silver salts and two or more aqueous dispersions of photosensitive silver salts, in order to regulate the photographic characteristics.

4) Amount of Addition

The organic silver salt of the invention may be used in an arbitrary amount, however a total coated silver amount including silver halide is preferably within a range of 0.1 to 5.0 g/m$^2$, more preferably 0.3 to 3.0 g/m$^2$, and further preferably 0.5 to 2.0 g/m$^2$. Particularly for improving the image storability, the total coated silver amount is preferably 1.8 g/m$^2$ or less, more preferably 1.6 g/m$^2$ or less. A reducing agent preferred in the invention allows to obtain a sufficient image density even with such low silver amount.

(Explanation on Reducing Agent)

A reducing agent to be employed in the invention is preferably a compound represented by a following formula (R-1):

Formula (R-1)

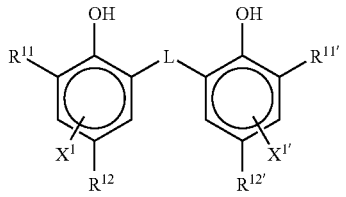

In the formula (R-1), $R^{11}$ and $R^{11'}$ each independently represent an alkyl group with 1 to 20 carbon atoms; $R^{12}$ and $R^{12'}$ each independently represent an alkyl group with 1 to 20 carbon atoms; L represents —S— or —CHR$^{13}$—; $R^{13}$ represents a hydrogen atom or an alkyl group with 1 to 20 carbon atoms; and $X^1$ and $X^{1'}$ each independently represent a hydrogen atom or a group that can substitute the benzene ring.

In the following, there will be given a detailed explanation on each substituent group.

1) $R^{11}$ and $R^{11'}$ $R^{11}$ and $R^{11'}$ each independently represent a substituted or non-substituted alkyl group with 1 to 20 carbon atoms. A substituent on the alkyl group is not particularly limited, but is preferably an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, or a halogen atom.

2) $R^{12}$ and $R^{12'}$ $R^{12}$ and $R^{12'}$ each independently represent an alkyl group with 1 to 20 carbon atoms, however excluding a methyl group.

3) $X^1$ and $X^{1'}$ $X^1$ and $X^{1'}$ each independently represent a hydrogen atom or a group that can substitute the benzene ring. The group that can substitute the benzene ring can preferably be an alkyl group, an aryl group, a halogen atom, an alkoxy group or an acylamino group.

4) L

L represents a —S— group or a —CHR$^{13}$— group. $R^{13}$ represents a hydrogen atom or an alkyl group with 1 to 20 carbon atoms, and the alkyl group may have a substituent.

Specific examples of $R^{13}$, when $R^{13}$ represents a non-substituted alkyl group, include a methyl group, an ethyl group, a propyl group, a butyl group, a heptyl group, an undecyl group, an isopropyl group, a 1-ethylpentyl group and 2,4,4-trimethylpentyl group.

Examples of the substituent on the alkyl group are similar to the substituents on $R^{11}$, and include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group and a sulfamoyl group.

5) Preferred Substituent

Each of $R^{11}$ and $R^{11'}$ is preferably a secondary or tertiary alkyl group with 3 to 15 carbon atoms, and can specifically be an isopropyl group, an isobutyl group, a t-butyl group, a t-amyl group, a t-octyl group, a cyclohexyl group, a cyclopentyl group, a 1-methylcyclohexyl group or a 1-methylcyclopropyl group. Each of $R^{11}$ and $R^{11'}$ is more preferably a tertiary alkyl group with 4 to 12 carbon atoms, among which a t-butyl group, a t-amyl group or a 1-methylcyclohexyl group is more preferable, and a t-butyl group is most preferable.

Each of $R^{12}$ and $R^{12'}$ is preferably an alkyl group with 1 to 20 carbon atoms, and can specifically be an ethyl group, a propyl group, a butyl group, an isopropyl group, a t-butyl group, a t-amyl group, a cyclohexyl group, a 1-methylcyclohexyl group, a benzyl group, a methoxymethyl group, or a methoxyethyl group. Each of $R^{12}$ and $R^{12'}$ is more preferably an ethyl group, a propyl group, an isopropyl group or a t-butyl group.

Each of $X^1$ and $X^{1'}$ is preferably a hydrogen atom, a halogen atom, or an alkyl group, more preferably a hydrogen atom.

L is preferably a —CHR$^{13}$— group.

$R^{13}$ preferably represents a hydrogen atom or an alkyl group with 1 to 15 carbon atoms, and, as the alkyl group, there is preferred a methyl group, an ethyl group, a propyl group, an isopropyl group or a 2,4,4-trimethylpentyl group. As $R^3$, there is particularly preferred a hydrogen atom, a methyl group, a propyl group or an isopropyl group.

When $R^{13}$ is a hydrogen atom, each of $R^{12}$ and $R^{12'}$ is preferably an alkyl group with 2 to 5 carbon atoms, more preferably an ethyl group or a propyl group and most preferably an ethyl group.

When $R^{13}$ is a primary or secondary alkyl group with 1 to 8 carbon atoms, each of $R^{12}$ and $R^{12'}$ is preferably a methyl group. As the primary or secondary alkyl group with 1 to 8 carbon atoms represented by $R^{13}$, there is more preferred a methyl group, an ethyl group, a propyl group or an isopropyl group, and further preferred is a methyl group, an ethyl group or a propyl group.

In the following, there are shown specific examples of the reducing agent of the invention, including the compound represented by the formula (R-1), but the invention is not limited to such examples.

(1-1)

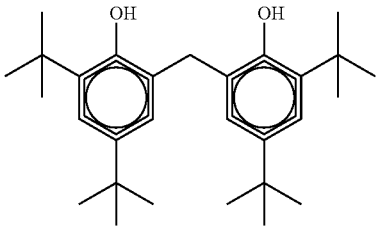

(1-2)

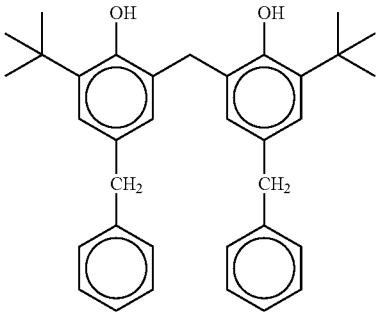

(1-3)

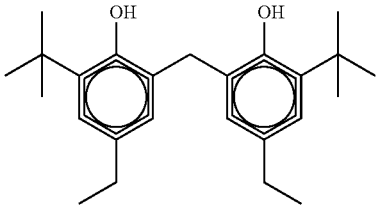

(1-4)

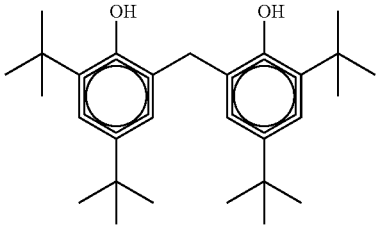

(1-5)

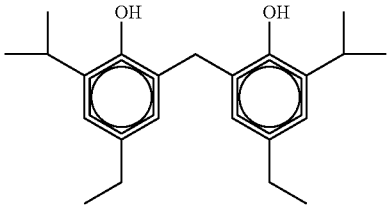

(1-6)

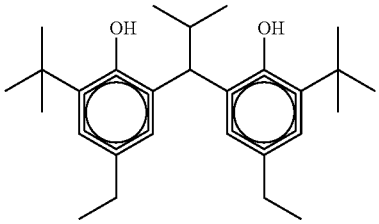

-continued (1-7)

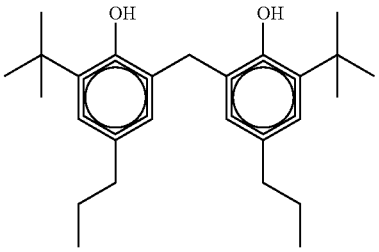

(1-8)

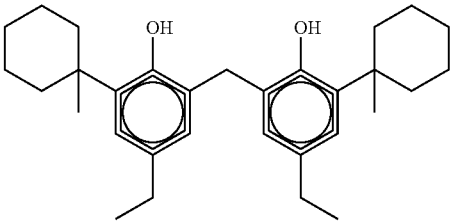

(1-9)

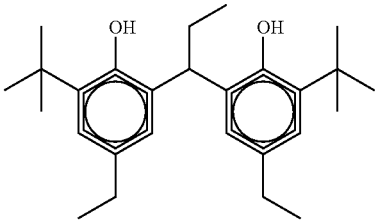

Other preferable examples of the reducing agent used in the invention are described in JP-A Nos. 2001-188314, 2001-209145, 2001-350235 and 2002-156727.

In the invention, the reducing agent is preferably added in an amount of 0.1 to 3.0 g/m$^2$, more preferably 0.2 to 1.5 g/m$^2$, further preferably 0.3 to 1.0 g/m$^2$. The reducing agent is preferably included in an amount of 5 to 50 mol % per 1 mole of silver on a surface having an image forming layer, more preferably 8 to 30 mol %, and further preferably 10 to 20 mol %. The reducing agent is preferably included in an image forming layer.

The reducing agent of the invention may be added to the coating solution and in the photosensitive material by any manner, for example in a state of a solution, an emulsified dispersion or a dispersion of fine solid particles.

A well known method for preparing an emulsified dispersion comprises dissolving a reducing agent in an oil such as dibutyl phthalate, tricresyl phosphate, glyceryl triacetate or diethyl phthalate, or an auxiliary solvent such as ethyl acetate or cyclohexanone, followed by a mechanical preparation of an emulsified dispersion.

The fine solid particles dispersion may be prepared by a method of dispersing powder of a reducing agent in a suitable solvent with a ball mill, a colloid mill, a vibrating ball mill, a sand mill, a jet mill, a roller mill or ultrasonic wave thereby obtaining a solid dispersion. In such a method, a protective colloid (such as polyvinyl alcohol) or a surfactant (for example an anionic surfactant such as sodium triisopropylnaphthalenesulfonate (a mixture of compounds with different combinations of substitution positions of three isopropyl groups) may be used. In the above-mentioned mills, beads such as of zirconia are usually used as a dispersion medium, and the dispersion is sometimes contaminated with zirconium etc. leaking out of such beads. Zr content in the dispersion, through dependent on the dispersing conditions, is usually within a range of 1 to 1000 ppm. The presence of Zr can be tolerated practically as long as its content in the photosensitive material is 0.5 mg or less per 1 g of silver.

An aqueous dispersion preferably includes an antiseptic (such as sodium salt of benzothiazolinone).

A reducing agent is added to a coating solution particularly preferably in a state of fine solid particle dispersion, and an average particle size of the reducing agent is preferably 0.01 to 10 μm, more preferably 0.05 to 5 μm, further preferably 0.1 to 2 μm. In the invention, also, other solid dispersions include the respective solid particles with particle sizes preferably within such a range.

In the invention, in addition to the reducing agent represented by the formula (R-1), a compound represented by a following formula (R-2) may also be included.

Formula (R-2):

Formula (R-2)

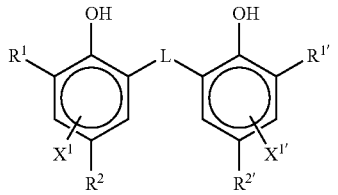

In the formula (R-2), $R^1$ and $R^{1'}$ each independently represent an alkyl group having 3 to 20 carbon atoms and including a secondary or tertiary carbon atom bonded to the benzene ring; $R^2$ and $R^{2'}$ each independently represent a methyl group; L represents —S— or —CHR $^3$—; R represents a hydrogen atom or an alkyl group with 1 to 20 carbon atoms; and $X^1$ and $X^{1'}$ each independently represent a hydrogen atom or a group that can substitute the benzene ring.

In the following, there will be given a detailed explanation on each substituent group.

1) $R^1$ and $R^{1'}$

In the formula (R-2), $R^1$ and $R^{1'}$ each independently represent a substituted or non-substituted alkyl group having 3 to 20 carbon atoms and including a secondary or tertiary carbon atom bonded to the benzene ring. A substituent on the alkyl group is not particularly limited, but is preferably an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, or a halogen atom.

2) $R^2$ and $R^{2'}$

In the formula (R-2), $R^2$ and $R^{2'}$ each independently represent a methyl group.

3) $X^1$ and $X^{1'}$ $X^1$ and $X^{1'}$ each independently represent a hydrogen atom or a group that can substitute the benzene ring. The group that can substitute the benzene ring can preferably be an alkyl group, an aryl group, a halogen atom, an alkoxy group or an acylamino group.

4) L

L represents a —S— group or a —CHR$^3$— group. $R^3$ represents a hydrogen atom or an alkyl group with 1 to 20 carbon atoms, and the alkyl group may have a substituent.

Specific examples of the non-substituted alkyl group represented by $R^3$ include a methyl group, an ethyl group, a propyl group, a butyl group, a heptyl group, an undecyl group, an isopropyl group, a 1-ethylpentyl group and 2,4,4-trimethylpentyl group.

Examples of the substituent on the alkyl group are similar to the substituents on $R^1$, and include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group and a sulfamoyl group.

5) Preferred Substituent

In the formula (R-2), each of $R^1$ and $R^{1'}$ is preferably a secondary or tertiary alkyl group with 3 to 15 carbon atoms, and can specifically be an isopropyl group, an isobutyl group, a t-butyl group, a t-amyl group, a t-octyl group, a cyclohexyl group, a cyclopentyl group, a 1-methylcyclohexyl group or a 1-methylcyclopropyl group. Each of $R^1$ and $R^{1'}$ is more preferably a tertiary alkyl group with 4 to 12 carbon atoms, among which a t-butyl group, a t-amyl group or a 1-methylcyclohexyl group is more preferable, and a t-butyl group is most preferable.

Each of $X^1$ and $X^{1'}$ is preferably a hydrogen atom, a halogen atom, or an alkyl group, more preferably a hydrogen atom.

L is preferably a —CHR$^3$— group.

$R^3$ preferably represents a hydrogen atom or an alkyl group with 1 to 15 carbon atoms, and, as the alkyl group, there is preferred a methyl group, an ethyl group, a propyl group, an isopropyl group or a 2,4,4-trimethylpentyl group. As $R^3$, there is particularly preferred a hydrogen atom, a methyl group, a propyl group or an isopropyl group.

In the following, there are shown specific examples of the compound represented by the formula (R-2), but the invention is not limited to such examples.

(1-1)

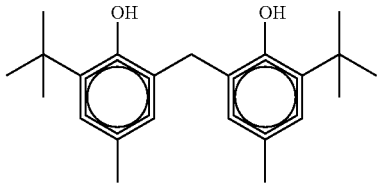

(1-2)

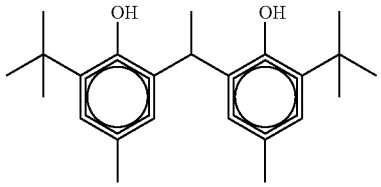

(1-3)

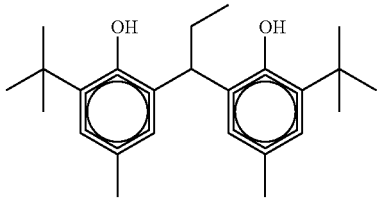

-continued (1-4)

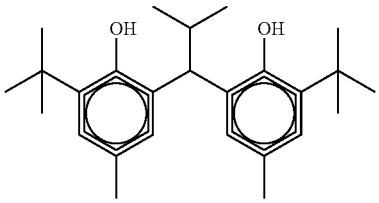

(1-5)

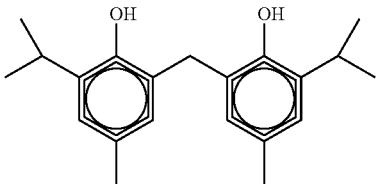

(1-6)

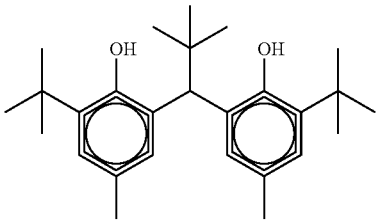

(1-7)

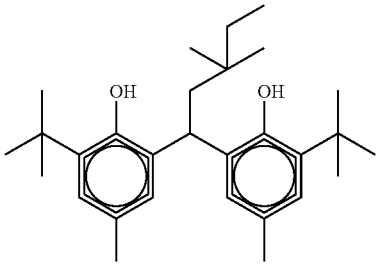

(1-8)

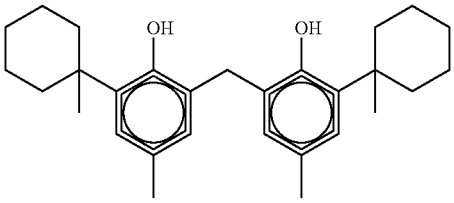

(1-9)

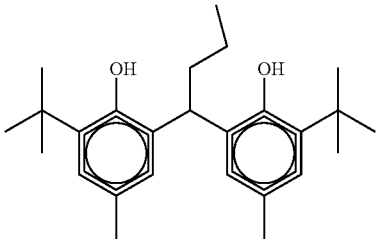

Explanation of Development Accelerator

In the invention, it is preferable to use a development accelerator.

The development accelerator used in the invention can be preferably a sulfonamidephenol compound represented by a formula (A) in JP-A Nos. 2000-267222 and 2000-330234, a hindered phenol compound represented by a formula (II) in JP-A No. 2001-92075, a hydrazine compound represented by a formula (I) in JP-A Nos. 10-62895 and 11-15116, by a formula (D) in JP-A No. 2002-156727 and by a formula (1) in JP-A No. 2002-278017, or a phenol or naphthol compound represented by a formula (2) in JP-A No. 2001-264929. Such a development accelerator is used within a range of 0.1 to 20 mol % with respect to the reducing agent, preferably 0.5 to 10 mol % and more preferably 1 to 5 mol %. It can be added to a photosensitive material in a manner similar to that in the case of the reducing agent, and it is particularly preferably added in a state of a solid dispersion or an emulsified dispersion. When a development accelerator is added in a state of an emulsified dispersion, the emulsified dispersion is preferably prepared by dispersing the development accelerator in a high-boiling solvent which is solid at the normal temperature and a low-boiling auxiliary solvent. Alternatively, the emulsified dispersion may be a so-called oilless emulsified dispersion without a high-boiling solvent.

In the invention, among the aforementioned development accelerators, a hydrazine compound represented by a formula (D) in JP-A No. 2002-156727 and a phenol or naphthol compound represented by a formula (2) in JP-A No. 2001-264929 are more preferable.

In the invention, particularly preferred development accelerators are compounds represented by the following formulas (A-1) and (A-2).

$$Q_1—NHNH—Q_2 \qquad \text{Formula (A-1)}$$

In the formula, $Q_1$ represents an aromatic group or a heterocyclic group each comprising a carbon atom which is bonded to —NHNH—$Q_2$; and $Q_2$ represents a carbamoyl group, an acyl group, an alkoxycarbonyl group, an aryloxycarbonyl group, a sulfonyl group or a sulfamoyl group.

In the formula (A-1), the aromatic group or the heterocyclic group represented by $Q_1$ is preferably a 5- to 7-membered unsaturated ring. Preferred examples thereof include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and a condensed ring formed by mutual condensation of some of these rings.

These rings may have a substituent, and when two or more substituents are present, such substituents may be same as or different from each other. Examples of the substituent include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group and an acyl group. When such substituent is a substitutable group, it may further have a substituent, and preferable examples of such a further substituent include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group and an acyloxy group.

A carbamoyl group represented by $Q_2$ preferably has 1 to 50 carbon atoms, more preferably 6 to 40 carbon atoms, and can be, for example, non-substituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbamoyl, N-3-pyridylcarbamoyl, or N-benzylcarbamoyl.

An acyl group represented by $Q_2$ preferably has 1 to 50 carbon atoms, more preferably 6 to 40 carbon atoms, and can be, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, or 2-hydroxymethylbenzoyl. An alkoxycarbonyl group represented by $Q_2$ preferably has 2 to 50 carbon atoms, more preferably 6 to 40 carbon atoms, and can be, for example, methoxycarbonyl, ethoxycarbonyl, isobutyloxycarbonyl, cyclohexyloxycarbonyl, dodecyloxycarbonyl or benzyloxycarbonyl.

An aryloxycarbonyl group represented by $Q_2$ preferably has 7 to 50 carbon atoms, more preferably 7 to 40 carbon atoms, and can be, for example, phenoxycarbonyl, 4-octyloxyphenoxycarbonyl, 2-hydroxymethylphenoxycarbonyl, or 4-dodecyloxyphenoxycarbonyl.

A sulfonyl group represented by $Q_2$ preferably has 1 to 50 carbon atoms, more preferably 6 to 40 carbon atoms, and can be, for example, methylsulfonyl, butylsulfonyl, octylsulfonyl, 2-hexadecylsulfonyl, 3-dodecyloxypropylsulfonyl, 2-octyloxy-5-tert-octylphenylsulfonyl or 4-dodecyloxyphenylsulfonyl.

A sulfamoyl group represented by $Q_2$ preferably has 0 to 50 carbon atoms, more preferably 6 to 40 carbon atoms, and can be, for example, non-substituted sulfamoyl, N-ethylsulfamoyl, N-(2-ethylhexyl)sulfamoyl, N-decylsulfamoyl, N-hexadecylsulfamoyl, N-{3-(2-ethylhexyloxy) propyl}sulfamoyl, N-(2-chloro-5-dodecyloxycarbonylphenyl)sulfamoyl, or N-(2-tetradecyloxyphenyl)sulfamoyl.

A group represented by $Q_2$ may further have, on a substitutable position, a group cited before as a substituent on a 5- to 7-membered unsaturated ring represented by $Q_1$, and, when two or more substituents are present on $Q_2$, the substituents may be same as or different from each other.

In the following there will be explained a preferred range of the compound represented by the formula (A-1). $Q_1$ is preferably a 5- or 6-membered unsaturated ring, and is more preferably a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring or a ring formed by a condensation of one of the aforementioned rings with a benzene ring or an unsaturated hetero ring. Also $Q_2$ is preferably a carbamoyl group, more preferably a carbamoyl group having a hydrogen atom on a nitrogen atom.

Formula (A-2)

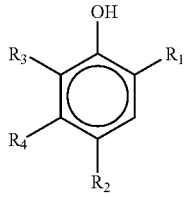

In the formula (A-2), $R_1$ represents an alkyl group, an acyl group, an acylamino group, a sulfonamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group or a carbonate ester group. $R_3$ and $R_4$ each independently represent a group that can substitute the benzene ring, as cited in the examples of the substituent in the explanation of the formula (A-1). $R_3$ and $R_4$ may be mutually bonded to form a condensed ring.

$R_1$ is preferably an alkyl group with 1 to 20 carbon atoms (such as a methyl group, an ethyl group, an isopropyl group, a butyl group, a tert-octyl group, or a cyclohexyl group), an acylamino group (such as an acetylamino group, a benzoylamino group, a methylureide group or a 4-cyanophenylureide group), or a carbamoyl group (such as an n-butylcarbamoyl group, an N,N-diethylcarbamoyl group, a phenylcarbamoyl group, a 2-chlorophenylcarbamoyl group, or a 2,4-dichlorophenylcarbamoyl group), and more preferably an acylamino group (including an ureide group and an urethane group). $R_2$ is preferably a halogen atom (more preferably a chlorine atom or a bromine atom), an alkoxy group (such as a methoxy group, a butoxy group, an n-hexyloxy group, an n-decyloxy group, a cyclohexyloxy group, or a benzyloxy group), or an aryloxy group (such as a phenoxy group or a naphthoxy group).

$R_3$ is preferably a hydrogen atom, a halogen atom or an alkyl group with 1 to 20 carbon atoms, and a halogen atom is most preferable. $R_4$ is preferably a hydrogen atom, an alkyl group, or an acylamino group, and an alkyl group or an acylamino group is more preferable. Preferred examples of such a substituent are similar to the preferred examples of $R_1$. When $R_4$ is an acylamino group, it is also preferable that $R_4$ should be bonded to $R_3$ to form a carbostyryl ring.

In the formula (A-2), when $R_3$ and $R_4$ are mutually bonded to form a condensed ring, a naphthalene ring is particularly preferable as such a condensed ring. The naphthalene ring may have a substituent of which examples are the same as in the case of the formula (A-1). When the formula (A-2) represents a naphthol compound, $R_1$ is preferably a carbamoyl group, and particularly preferably a benzoyl group. $R_2$ is preferably an alkoxy group or an aryloxy group, particularly preferably an alkoxy group.

In the following specific preferred examples of the development accelerator of the invention are shown, but the invention is not limited to such examples.

(A-1)

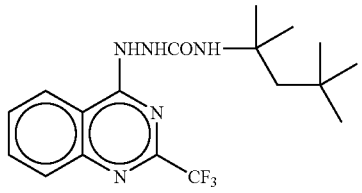

(A-2)

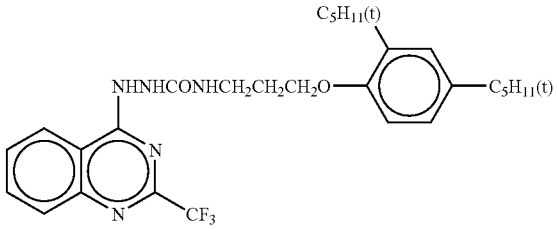

-continued (A-3)

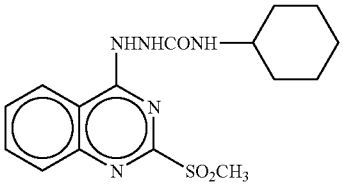

(A-4)

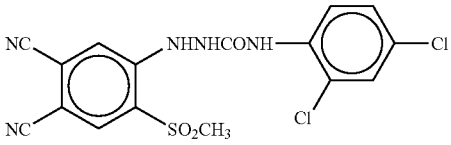

(A-5)

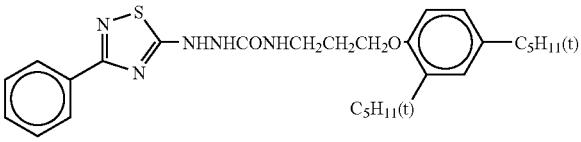

(A-6)

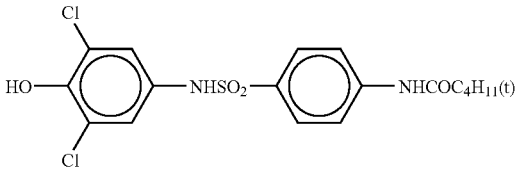

(A-7)

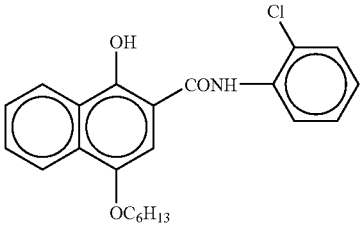

(A-8)

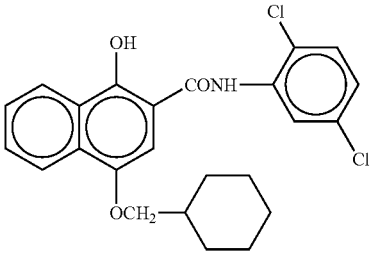

(A-9)

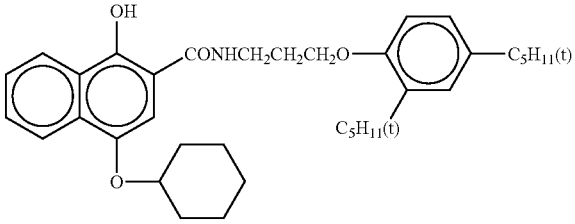

-continued (A-10)

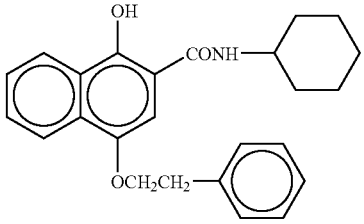

(A-11)

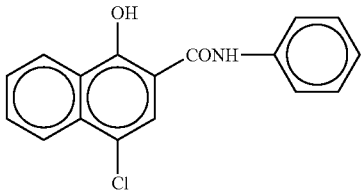

(A-12)

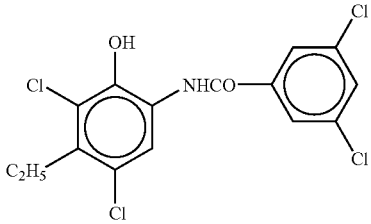

Explanation of Hydrogen Bonding Compound

In the invention, when the reducing agent has an aromatic hydroxyl group (—OH) or an amino group, particularly when the reducing agent is an aforementioned bisphenol, it is preferable to further use a non-reducing compound having a group capable of forming a hydrogen bond with such a group. A group capable of forming a hydrogen bond with a hydroxyl group or an amino group can be, for example, a phosphoryl group, a sulfoxide group, a sulfonyl group, a carbonyl group, an amide group, an ester group, an urethane group, an ureide group, a tertiary amino group or a nitrogen-containing aromatic group. Among them there is preferred a compound having a phosphoryl group, a sulfoxide group, an amide group (not including >N—H but blocked as >N—Ra (Ra being a substituent other than H)), an urethane group (not including >N—H but blocked as >N—Ra (Ra being a substituent other than H)), or an ureide group (not including >N—H but blocked as >N—Ra (Ra being a substituent other than H)).

In the invention, a particularly preferred hydrogen bonding compound is represented by a following formula (D):

Formula (D)

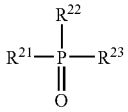

In the formula (D), $R^{21}$ to $R^{23}$ each independently represent an alkyl group, an aryl group, an alkoxy group, an aryloxy group, an amino group or a heterocyclic group, which may be non-substituted or may have a substituent. When any of $R^{21}$ to $R^{23}$ has a substituent, such substituent can be a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group or a phosphoryl group, among which preferred is an alkyl group or an aryl group such as a methyl group, an ethyl group, an isopropyl group, a t-butyl group, a t-octyl group, a phenyl group, a 4-alkoxyphenyl group or a 4-acyloxyphenyl group.

Specific examples of alkyl groups represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, and a 2-phenoxypropyl group. Specific examples of the aryl group include a phenyl group, a cresyl group, a xylyl group, a naphthyl group, a 4-t-butylphenyl group, a 4-t-octylphenyl group, a 4-anisidyl group and a 3,5-dichlorophenyl group. Specific examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group. Specific examples of the aryloxy group include a phenoxy group, a cresyloxy group, an isopropylphenoxy group, a 4-t-butylphenoxy group, a naphthoxy group and a biphenyloxy group. Specific examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

Each of $R^{21}$ to $R^{23}$ is preferably an alkyl group, an aryl group, an alkoxy group, or an aryloxy group. From the viewpoint of the effect of the invention, it is preferable that at least one of $R^{21}$ to $R^{23}$ should be an alkyl group or an aryl group, and it is more preferable that two or more of $R^{21}$ to $R^{23}$ each should be an alkyl group or an aryl group. It is also preferred that $R^{21}$ to $R^{23}$ should be same groups, in consideration of inexpensive availability.

In the following, specific examples of the hydrogen bonding compound of the invention, including the compound of the formula (D), are shown, but the invention is not limited to such examples.

(D-1)

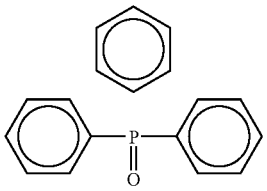

(D-2)

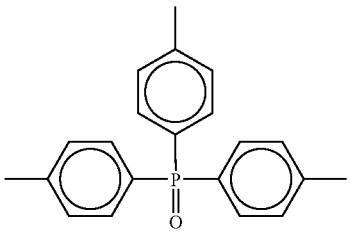

-continued (D-3)

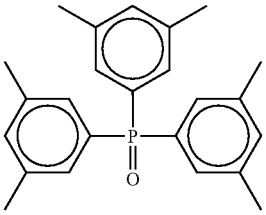

(D-4)

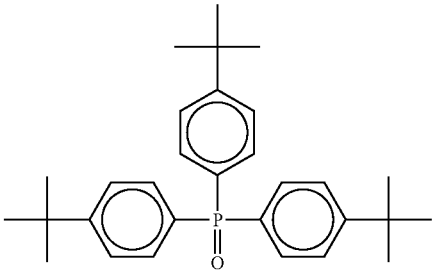

(D-5)

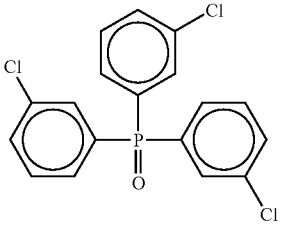

(D-6)

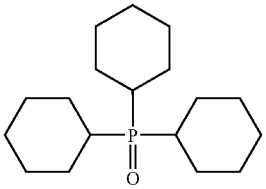

(D-7)

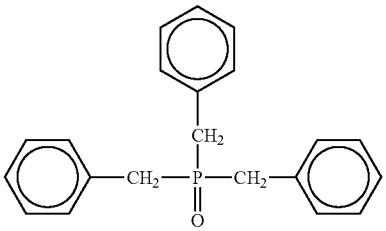

(D-8)

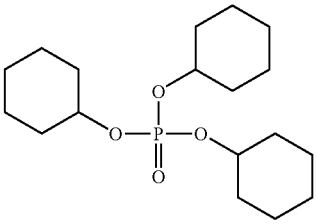

(D-9)

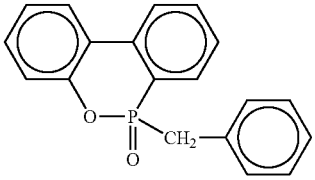

-continued (D-10)

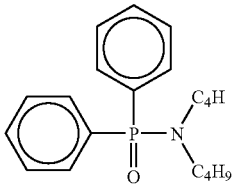

(D-11)

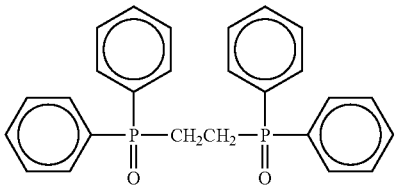

(D-12)

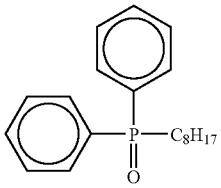

(D-13)

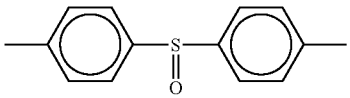

(D-14)

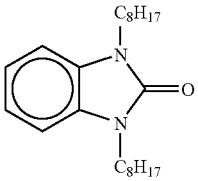

(D-15)

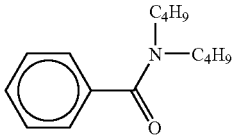

Specific examples of the hydrogen bonding compound, other than the compounds shown in the foregoing, include the compounds described in European Patent No. 1096310, JP-A Nos. 2002-156727 and 2002-318431.

The compound of the formula (D) of the invention, like the reducing agent, may be adde in the coating solution for example in a form of a solution, an emulsified dispersion or a dispersion of fine solid particles, however is preferably added in a form of a solid dispersion. The compound of the invention forms, in a solution state, a complex by a hydrogen bonding with a compound having a phenolic hydroxyl group or an amino group, and may be isolated in a crystalline state depending on a combination of the reducing agent and the compound of the formula (D) of the invention. It is particularly preferable, for obtaining a stable performance, to use thus isolated crystalline powder in a form of a dispersion of fine solid particles. There is also preferably employed a method of mixing the reducing agent and the compound of the formula (D) of the invention in a powder state, and allowing a complex formation during the dispersion in a sand grinder mill or the like with a suitable dispersant.

The compound of the formula (D) of the invention is preferably used in an amount of 1 to 200 mol % with respect to the reducing agent, more preferably in an amount of 10 to 150 mol % and further preferably in an amount of 20 to 100 mol %.

Explanation of Silver Halide

1) Halogen Composition

A photosensitive silver halide used in the invention is silver iodobromide, silver iodochlorobromide or silver iodide with a silver iodide content of 40 mol % or higher. The silver iodide content is preferably 80 to 100 mol %, more preferably 90 to 100 mol %. A component other than silver iodide is not particularly limited and can be selected from silver chloride, silver bromide, silver thiocyanate, silver phosphate and the like, but is preferably silver bromide or silver chloride.

A halogen composition within a grain may be uniform, or show a stepwise change or a continuous change. A silver halide grain having a core/shell structure is also preferable. There is preferred a core/shell grain with a 2- to 5-layered structure, more preferably 2- to 4-layered structure. It is also possible to advantageously employ a technology of localizing silver bromide or silver iodide on a surface of grains of silver chloride, silver bromide or silver chlorobromide.

2) Grain Forming Method

A method for forming photosensitive silver halide grains is well known in the related art, and there can be utilized, for example, the methods described in *Research Disclosure* 17029 June 1978, and U.S. Pat. No. 3,700,458. More specifically, there is known a method of adding a silver supplying compound and a halogen supplying compound to a solution of gelatin or another polymer thereby preparing a photosensitive silver halide, and thereafter mixing the photosensitive silver halide with an organic silver salt. There are also known a method described in JP-A No. 11-119374, paragraphs 0217 to 0224, and methods described in JP-A Nos. 11-352627 and 2000-347335.

In the invention, formation of grains of the photosensitive silver halide, an optional chemical ripening thereof, an optional chemical sensitization thereof, and an optional spectral sensitization thereof may be conducted preferably in the absence of the non-photosensitive organic silver salt. The photosensitive silver halide grains may be mixed with the non-photosensitive organic silver salt preferably after these sensitizing processes.

3) Average Grain Size

A grain size of the photosensitive silver halide is particularly important in the invention. The photosensitive silver halide of the invention preferably has a grain size of 1 nm to 80 nm, more preferably 5 nm to 50 nm. The grain size mentioned above means the diameter of the circle having the same area as a projected area of a silver halide grain (a projected area of a principal plane in the case of a flat plate-shaped grain).

4) Grain Shape

Silver halide grains can assume a cubic shape, an octahedral shape, a flat plate shape, a spherical shape, a rod shape, a potato-like shape and the like, but cubic grains are particularly preferable in the invention. Grains of which corners are rounded are also preferable. The photosensitive silver halide grains are not particularly restricted in a plane index (Miller's index) of an external surface, but it is preferable that a [100] plane, which shows a high spectral sensitization efficiency when adsorbing a spectral sensitizing dye, has a high proportion. Such proportion is preferably 50% or higher, more preferably 65% or higher and further preferably 80% or higher.

The Miller's index or a proportion of the [100] plane can be determined by a method described in T. Tani; *J. Imaging Sci.*, 29, 165 (1985), which utilizes adsorption dependences of [111] and [100] planes in the adsorption of sensitizing dye.

5) Heavy Metal

The photosensitive silver halide grains of the invention may include a metal or a metal complex of groups 8 to 10 of the periodic table (having groups 1 to 18). A metal or a central metal of a metal complex belonging to the groups 8 to 10 of the periodic table is preferably rhodium, ruthenium or iridium. Such a metal complex may be used singly. Alternatively, two or more complexes of a same metal or different metals may be used in combination. A preferred content is within a range of $1\times10^{-9}$ to $1\times10^{-3}$ moles per 1 mole of silver. Such heavy metals, complexes thereof and method of addition thereof are described in JP-A Nos. 7-225449, 11-65021, paragraphs 0018 to 0024, and 11-119374, paragraphs 0227 to 0240.

In the invention, silver halide grains in which a hexacyano metal complex is present at the outermost surface of the grains are preferable. Examples of the hexacyano metal complex includes $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, a hexacyano Fe complex is preferred.

A counter cation is not important since the hexacyano metal complex is present in a state of an ion in an aqueous solution, but it is preferable to employ a counter ion that is easily miscible with water and is suitable to a precipitating operation of silver halide emulsion. For example, the counter cation may be an alkali metal ion such as sodium ion, potassium ion, rubidium ion, cesium ion or lithium ion, an ammonium ion or an alkylammonium ion (such as tetramethylammonium ion, tetraethylammonium ion, tetrapropylammonium ion or tetra(n-butyl)ammonium ion).

The hexacyano metal complex can be added after mixed with water, or a mixed solvent of water and a suitable water-miscible organic solvent (for example an alcohol, an ether, a glycol, a ketone, an ester or an amide), or gelatin.

An amount of addition of hexacyano metal complex is preferably $1\times10^{-5}$ to $1\times10^{-2}$ moles per 1 mole of silver, more preferably $1\times10^{-4}$ to $1\times10^{-3}$ moles.

In order to cause the hexacyano metal complex to be present on the outermost surface of silver halide grains, the hexacyano metal complex is directly added within a period from the end of an addition of an aqueous silver nitrate solution for grain formation to the starting of a chemical sensitization step for a sulfur sensitization, a chalcogen sensitization such as selenium sensitization or tellurium sensitization, or a precious metal sensitization such as gold sensitization, namely before the end of a charging step, during a rinsing step or a dispersing step, or before a chemical sensitization step. In order not to cause a growth of the silver halide fine grains, it is preferable to add the hexacyano metal complex promptly after the grain formation, thus it is preferable to execute the addition before the end of the charging step.

The addition of the hexacyano metal complex may be started after 96 mass % of the total silver nitrate for grain formation is added, preferably after 98 mass % and particularly preferably after 99 mass %.

Such hexacyano metal complex, when added after the addition of aqueous silver nitrate solution but immediately before the completion of grain formation, can be adsorbed by the outermost surface of silver halide grains, and mostly forms a scarcely-soluble salt with silver ions on the surface of the grains. Such silver salt of hexacyano ferrate (II), being less soluble than AgI, can avoid re-dissolution of small grains, thereby enabling to produce fine silver halide grains having a smaller grain size.

Also metal atoms (for example $[Fe(CN)_6]^{4-}$) that can be included in the silver halide grains according to the invention, a desalting method and a chemical sensitizing method of the silver halide emulsion are described in JP-A Nos. 11-84574, paragraphs 0046-0050, 11-65021, paragraphs 0025-0031, and 11-119374, paragraphs 0242-0250.

6) Gelatin

Various gelatins can be used as gelatin contained in the photosensitive silver halide emulsion used in the invention. It is necessary to maintain a satisfactory dispersion state of the photosensitive silver halide emulsion in a coating solution containing an organic silver salt, and it is preferable to use gelatin having a molecular weight of 10,000 to 1,000,000. It is also preferable to execute a phthalation process on a substituent of gelatin. Such gelatin may be used at grain formation or at dispersion after desalting process, however it is preferably used at the grain formation.

7) Sensitizing Dye

The sensitizing dye used in the invention is preferably a sensitizing dye that can spectrally sensitize the silver halide grains in a desired wavelength region when adsorbed by the silver halide and has a spectral sensitivity matching the spectral characteristics of an exposure light source. Explanations of examples of sensitizing dye and a method of addition thereof include a description in JP-A No. 11-65021, paragraphs 0103-0109, a compound represented by a formula (II) in JP-A No. 10-186572, a dye represented by a formula (I) and a description of a paragraph 0106 in JP-A No. 11-119374, a description in U.S. Pat. No. 5,510,236, a dye described in an example 5 of U.S. Pat. No. 3,871,887, dyes disclosed in JP-A Nos. 2-96131 and 59-48753, and descriptions in EP-A No. 0803764A1, page 19, line 38 to page 20, line 35, and JP-A Nos. 2001-272747, 2001-290238 and 2002-23306. The sensitizing dye may be used singly or two or more kinds of the sensitizing dyes may be used in combination. In the invention, the sensitizing dye is added to the silver halide emulsion preferably in a period from the end of a desalting process to a coating, and more preferably in a period from the end of the desalting process to the end of a chemical ripening process.

An amount of the sensitizing dye in the invention can be selected according to a target sensitivity or a target fog level, however it is preferably within a range of $10^{-6}$ to 1 mole per 1 mole of photosensitive silver halide in the photosensitive layer, preferably $10^{-4}$ to x $10^{-1}$ moles.

In the invention, in order to improve the spectral sensitizing efficiency, it is possible to use a super-sensitizer. Examples of the super-sensitizer usable in the invention include the compounds described in EP-A No. 587,338, U.S. Pat. Nos. 3,877,943 and 4,873,184 and JP-A Nos. 5-341432, 11-109547 and 10-111543.

8) Chemical Sensitization

The photosensitive silver halide grains to be used in the invention are preferably chemically sensitized by a sulfur sensitizing method, a selenium sensitizing method or a tellurium sensitizing method. For a sulfur sensitization, a selenium sensitization and a tellurium sensitization, a known compound can be advantageously used such as the compound described in JP-A No. 7-128768. In the invention, a tellurium sensitization is preferable, and the compound described in JP-A No. 11-65021, paragraph 0030 and the compounds represented by formulas (II), (III) and (IV) in JP-A No. 5-313284 are more preferable.

The photosensitive silver halide grains of the invention are preferably chemically sensitized by a gold sensitization method either in combination with the aforementioned chalcogen sensitization or singly. A gold sensitizer with monovalent or trivalent gold is preferable, and is preferably an ordinarily employed gold sensitizer. Representative examples thereof include chloroauric acid, bromoauric acid, potassium chloroaurate, potassium bromoaurate, auric trichloride, potassium auricthiocyanate, potassium iodoaurate, tetracyanoauric acid, ammonium aurothiocyanate, and pyridyl trichlorogold. The gold sensitizers described in U.S. Pat. No. 5,858,637 and JP-A No. 2002-278016 are also preferable.

In the invention, the chemical sensitization may be executed at any time from completion of grain formation to the starting of coating, and can be executed at a time after desalting (1) before spectral sensitization, (2) simultaneous with spectral sensitization, (3) after spectral sensitization, or (4) immediately before coating.

An amount of the sulfur, selenium or tellurium sensitizer used in the invention is variable depending on the silver halide grains to be used and chemical ripening conditions, but is within a range of $10^{-8}$ to $10^{-2}$ moles per 1 mole of silver halide, preferably about $10^{-7}$ to about $10^{-3}$ moles.

An amount of the gold sensitizer is variable depending on various conditions, however it is generally within a range of $10^{-7}$ to $10^{-3}$ moles per 1 mole of silver halide, preferably $10^{-6}$ to $5\times10^{-4}$ moles.

The chemical sensitization in the invention is not particularly restricted in conditions. Generally, a pH may be from 5 to 8, a pAg may be from 6 to 11 and a temperature may be from 40 to 95° C.

In the silver halide emulsion used in the invention, a thiosulfonic acid compound may be added by a method described in EP-A No. 293,917.

In the preparation of the photosensitive silver halide grains of the invention, a reducing agent is preferably used. As a specific compound for the reduction sensitization, ascorbic acid or thiourea dioxide is preferable. Stannous chloride, aminoiminomethane sulfinic acid, a hydrazine derivative, a borane compound, a silane compound, or a polyamine compound is also preferable. The reduction sensitizer may be added in any step in the photosensitive emulsion preparing process from a grain growing step to immediate before coating. It is also preferred to execute the reduction sensitization by ripening the emulsion at a pH value of 7 or higher and/or at a pAg value of 8.3 or lower, or by introducing a single addition part of silver ions in the course of grain formation.

9) Compound Whose a 1-Electron Oxidized form, Formed by a 1-Electron Oxidation, is Capable of Releasing 1 or More Electrons.

The photothermographic material of the invention preferably includes a compound whose a 1-electron oxidized form, formed by a 1-electron oxidation, is capable of releasing 1 or more electrons.

Such compound is employed either singly or in combination with various aforementioned chemical sensitizers and can provide an increase in the sensitivity of silver halide.

The compound whose a 1-electron oxidized form, formed by a 1-electron oxidation, is capable of releasing 1 or more electrons, to be included in the photothermographic material of the invention is a compound selected from the following types 1 to 5.

(Type 1)

A compound whose a 1-electron oxidized form, formed by a 1-electron oxidation, is capable of causing an ensuing bond cleaving reaction thereby further releasing two or more electrons.

(Type 2)

A compound whose a 1-electron oxidized form, formed by a 1-electron oxidation, is capable of causing an ensuing bond cleaving reaction thereby further releasing an electron, and which has, within a same molecule, two or more groups adsorbable to the silver halide.

(Type 3)

A compound whose a 1-electron oxidized form, formed by a 1-electron oxidation, is capable, after an ensuing bond forming process, of further releasing one or more electrons.

(Type 4)

A compound whose a 1-electron oxidized form, formed by a 1-electron oxidation, is capable, after an ensuing intramolecular ring-opening reaction, of further releasing one or more electrons.

(Type 5)

A compound represented by X—Y in which X represents a reducing group while Y is a releasable group, and a 1-electron oxidized form, formed by a 1-electron oxidation of the reducing group represented by X, causes an ensuing X—Y bond cleaving reaction to release Y and to form an X radical, thereby further releasing therefrom one electron.

Among the aforementioned compounds of types 1 and 3 to 5, either "a compound having, in the molecule, a group adsorbable to silver halide" or "a compound having, in the molecule, a partial structure of a spectral sensitizing dye" is preferable, and "a compound having, in the molecule, a group adsorbable to silver halide" is more preferable. The compounds of the types 1 to 4 are more preferably "a compound having, as an adsorbable group, a nitrogen-containing heterocyclic group substituted by two or more mercapto groups".

In the following, a detailed explanation will be given on the compounds of the types 1 to 5.

In the compound of the type 1, "a bond-cleaving reaction" specifically means a cleaving of a carbon-carbon, carbon-silicon, carbon-hydrogen, carbon-boron, carbon-tin or carbon-germanium bond, and a cleaving of a carbon-hydrogen bond may further be involved. The compound of the type 1 can undergo a bond cleaving reaction thereby further releasing two or more (preferably three or more) electrons, only after the compound of the type 1 is subjected to a 1-electron oxidation thereby forming a 1-electron oxidized form.

Among the compounds of the type 1, preferred compounds are represented by the formula (A), (B), (1), (2) and (3).

Formula (A)

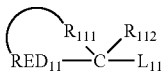

Formula (B)

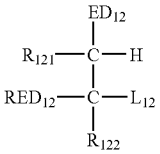

In the formula (A), $RED_{11}$ represents a reducing group that can be subjected to a 1-electron oxidation; $L_{11}$ represents a leaving group; $R_{112}$ represents a hydrogen atom or a substituent; and $R_{111}$ represents a non-metal atomic group capable of forming, together with a carbon atom (C) and $RED_{11}$, a ring structure corresponding to a tetrahydro form, a hexahydro form or an octahydro form of a 5- or 6-membered aromatic ring (including an aromatic hetero ring).

In the formula (B), $RED_{12}$ represents a reducing group that can be subjected to a 1-electron oxidation; $L_{12}$ represents a leaving group; $R_{121}$ and $R_{122}$ each independently represent a hydrogen atom or a substituent; and $ED_{12}$ represents an electron donating group. In the formula (B), $R_{121}$ and $RED_{12}$, $R_{121}$ and $R_{122}$, or $ED_{12}$ and $RED_{12}$ may be mutually bonded to form a ring structure.

The compound represented by the formula (A) or the formula (B) is capable, after the reducing group represented by $RED_{11}$ or $RED_{12}$ is subjected to a 1-electron oxidation, of spontaneously releasing $L_1$, or $L_{12}$ by a bond cleaving reaction, thereby releasing further two or more, preferably three or more, electrons.

Formula (1)

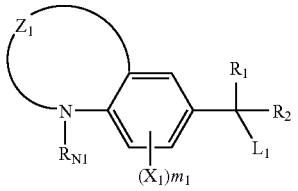

Formula (2)

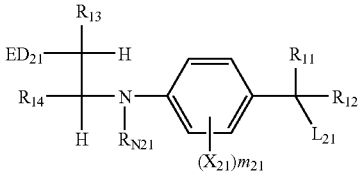

Formula (3)

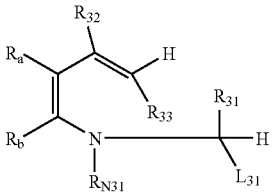

In the formula (1), $Z_1$ represents an atomic group capable of forming a 6-membered ring together with a nitrogen atom and two carbon atoms of the benzene ring; $R_1$, $R_2$ and $R_{N1}$ each independently represent a hydrogen atom or a substituent; $X_1$ represents a substituent that can substitute the benzene ring; $m_1$ represents an integer from 0 to 3; and $L_1$ represents a leaving group. In the formula (2), $ED_{21}$ represents an electron donating group; $R_{11}$, $R_{12}$) $R_{N21}$, $R_{13}$ and $R_{14}$ each independently represent a hydrogen atom or a substituent; $X_{21}$ represents a substituent that can substitute the benzene ring; $m_{21}$ represents an integer from 0 to 3; and $L_{21}$ represents a leaving group. $R_{N2}$, $R_{13}$, $R_{14}$, $X_{21}$ and $ED_{21}$ may be mutually bonded to form a ring structure. In the formula (3), $R_{32}$, $R_{33}$, $R_{31}$, $R_{N31}$, $R_a$ and $R_b$ each independently represent a hydrogen atom or a substituent; and $L_{31}$ represents a leaving group. However, in the case where $R_{N31}$ represents a group other than an aryl group, $R_a$ and $R_b$ are mutually bonded to form an aromatic ring.

These compounds are capable, after being subjected to a 1-electron oxidation, of spontaneously releasing $L_1$, $L_{21}$ or $L_{31}$ by a bond cleaving reaction, thereby releasing further two or more, preferably three or more, electrons.

In the following, the compound represented by the formula (A) will be explained in detail.

In the formula (A), the reducing group represented by $RED_{11}$ that can be subjected to a 1-electron oxidation is a group capable of forming a specific ring by bonding to $R_{111}$ to be explained later, and can more specifically be a divalent group formed by eliminating a hydrogen atom, at a position suitable for ring formation, from a following monovalent group: an alkylamino group, an arylamino group (such as an anilino group and a naphthylamino group), a heterocyclic amino group (such as a benzothiazolylamino group and a pyrolylamino group), an alkylthio group, an arylthio group (such as a phenylthio group), a heterocyclic thio group, an alkoxy group, an arylxoy group (such as a phenoxy group), a heterocyclic oxy group, an aryl group (such as a phenyl group, a naphthyl group and an anthranyl group), or an aromatic or non-aromatic heterocyclic group (a 5- to 7-membered single-ringed or condensed-ringed heterocyclic group containing at least one hetero atom selected from the group consisting of a nitrogen atom, a sulfur atom, an oxygen atom and a selenium atom, such as a tetrahydroquinoline ring, a tetrahydroisoquinoline ring, tetrahydroquinoxaline ring, a tetrahydroquinazoline ring, an indoline ring, an indole ring, an indazole ring, a carbazole ring, a phenoxadine ring, a phenothiazine ring, a benzothiazoline ring, a pyrrole ring, an imidazole ring, a thiazoline ring, a piperidine ring, a pyrrolidine ring, a morpholine ring, a benzoimidazole ring, a benzoimidazoline ring, a benzoxazoline ring and a methylenedioxyphenyl ring) (hereinafter $RED_{11}$ being represented by a name of a monovalent group for the purpose of convenience). The $RED_{11}$ may also have a substituent.

In the invention, a substituent means one selected from the following groups, unless otherwise specified: a halogen atom, an alkyl group (including an araylkyl group, a cycloalkyl group, an active methine group, etc.), an alkenyl group, an alkinyl group, an aryl group, a heterocyclic group (substituting position is arbitrary), a heterocyclic group containing a quaternary nitrogen atom (such as pyridinio group, imidazolio group, quinolinio group or isoquinolinio group), an acyl group, an alkoxycarbonyl group, an aryloxycarbonyl group, carbamoyl group, carboxyl group or a salt thereof, sulfonylcarbamoyl group, an acylcarbamoyl group, sulfamoylcarbamoyl group, carbazoyl group, oxalyl group, oxamoyl group, cyano group, a carbonimidoyl group, thiocarbamoyl group, hydroxy group, an alkoxy group (including a group containing repeating ethyleneoxy units or repeating propyleneoxy units), an aryloxy group, a heterocyclic oxy group, an acyloxy group, an (alkoxy or aryloxy)carbonyloxy group, a carbamoyloxy group, a sulfonyloxy group, amino group, an (alkyl, aryl or heterocyclic)amino group, an acylamino group, a sulfonamide group, ureido group, thioureido group, an imide group, an (alkoxy or aryloxy)carbonylamino group, sulfamoylamino group, semicarbazide group, thiosemicarbazide group, hydrazino group, ammonio group, oxamoylamino group, an (alkyl or aryl)sulfonylureido group, an acylureido group, an acylsulfamoylamino group, nitro group, mercapto group, an (alkyl, aryl or heterocyclic)thio group, an (alkyl or aryl)sulfonyl group, an (alkyl or aryl)sulfinyl group, sulfo group or a salt thereof, sulfamoyl group, an acylsulfamoyl group, sulfonylsulfamoyl group or a salt thereof, and a group including a phosphoric acid amide or a phosphoric acid ester structure. Such substituent may be further substituted by (a) substituent(s) selected from these substituents.

$RED_{11}$ is preferably an alkylamino group, an arylamino group, a heterocyclic amino group, an aryl group, or an aromatic or non-aromatic heterocyclic group, and more preferably an arylamino group (particularly anilino group) or an aryl group (particularly phenyl group). In the case such group has a substituent, the substituent is preferably a halogen atom, an alkyl group, an alkoxy group, carbamoyl group, sulfamoyl group, an acylamino group or a sulfonamide group.

However, in the case $RED_{11}$ represents an aryl group, the aryl group preferably includes at least an "electron donating group". The "electron donating group" means a hydroxyl group, an alkoxy group, a mercapto group, a sulfonamide group, an acylamino group, an alkylamino group, an arylamino group, a heterocyclic amino group, an active methine group, a 5-membered single-ringed or condensed-ringed electron-excessive aromatic heterocyclic group containing at least one nitrogen atom in the ring (such as indolyl group, pyrrolyl group, imidazolyl group, benzimidazolyl group, thiazolyl group, benzothiazolyl group, or indazolyl group), or non-aromatic nitrogen-containing heterocyclic group substituted at a nitrogen atom (such as pyrrolidinyl group, indolinyl group, piperidinyl group, piperadinyl group or morpholino group which may also be called a cyclic amino group). An active methine group means a methine group substituted by two "electron attracting groups", wherein "electron attracting group" used here means an acyl group, an alkoxycarbonyl group, an aryloxycarbonyl group, carbamoyl group, an alkylsulfonyl group, an arylsulfonyl group, sulfamoyl group, trifluoromethyl group, cyano group, nitro group or a carbonimidoyl group. The two electron attracting groups may be mutually bonded to form a ring structure.

In the formula (A), $L_{11}$ specifically represents carboxy group or a salt thereof, a silyl group, a hydrogen atom, a triarylboron anion, a trialkylstannyl group, a trialkylgermyl group or $—CR_{C1}R_{C2}R_{C3}$. The silyl group specifically represents a trialkylsilyl group, an aryldialkylsilyl group, a triarylsilyl group, etc. and may have an arbitrary substituent.

In the case where $L_{11}$ represents a salt of carboxy group, the counter ion constituting the salt can be, for example, an alkali metal ion, an alkali earth metal ion, a heavy metal ion, ammonium ion, or phosphonium ion, preferably is an alkali metal ion or ammonium ion and most preferably an alkali metal ion (particularly $Li^+$, $Na^+$ or $K^+$ ion).

In the case where $L_{11}$ represents $—CR_{C1}R_{C2}R_{C3}$, $R_{C1}$, $R_{C2}$ and $R_{C3}$ each independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or hydroxyl group, which may be mutually bonded to form a ring structure and may have an arbitrary substituent. However, in the case where one of $R_{C1}$, $R_{C2}$ and $R_{C3}$ represents a hydrogen atom or an alkyl group, the remaining two neither represent a hydrogen atom nor an alkyl group. Preferably, $R_{C1}$, $R_{C2}$ and $R_{C3}$ each independently represent an alkyl group, an aryl group (particularly phenyl group), an alkylthio group, an arylthio group, an alkylamino group, an arylamino group, a heterocyclic group, an alkoxy group, or a hydroxy group. Specific examples of $R_{C1}$, $R_{C2}$ and $R_{C3}$ include phenyl group, p-dimethylaminophenyl group, p-methoxyphenyl group, 2,4-dimethoxyphenyl group, p-hydroxyphenyl group, methylthio group, phenylthio group, phenoxy group, methoxy group, ethoxy group, dimethylamino group, N-methylanilino group, diphenylamino group, morpholino group, thiomorpholino group and hydroxy group. Also examples of a ring structure formed by mutual bonding of these groups include 1,3-dithiolan-2-yl group, 1,3-dithian-2-yl group, N-methyl-1,3-thiazolidin-2-yl group and N-benzyl-benzothiazolidin-2-yl group.

There is also preferred a case where, as a result of selection of $R_{C1}$, $R_{C2}$ and $R_{C3}$ within the aforementioned ranges, $—CR_{C1}R_{C2}R_{C3}$ represents the same group as a residue obtained by eliminating $L_{11}$ from the formula (A).

In the formula (A), $L_{11}$ preferably represents a carboxy group or a salt thereof, or a hydrogen atom, more preferably a carboxy group or a salt thereof.

In the case $L_{11}$ represents a hydrogen atom, the compound represented by the formula (A) preferably has a base portion within the molecule. An action of such base portion causes, after an oxidation of the compound represented by the formula (A), a deprotonation of the hydrogen atom represented by $L_{11}$ thereby releasing an electron therefrom.

The base mentioned above is more specifically a conjugate base of an acid having a pKa of about 1 to about 10. It can be, for example, a nitrogen-containing heterocyclic compound (such as a pyridine, an imidazole, a benzimidazole or a thiazole), an aniline, a trialkylamine, amino group, a carbonic acid (such as an active methylene anion), thioacetate anion, a carboxylate ($—COO^-$), a sulfate ($—SO_{3-}$) or an aminoxide ($>N^+(O^-)—$). It is preferably a conjugate base of an acid having a pKa of about 1 to about 8, more preferably a carboxylate, a sulfate or an aminoxide, and particularly preferably a carboxylate. In the case where such base has an anion, a counter cation may be present, which can be, for example, an alkali metal ion, an alkali earth metal ion, a heavy metal ion, ammonium ion or phosphonium ion. Such base is bonded at an arbitrary position to the compound represented by the formula (A). As for the bonding position, such base portion may be bonded to any of $RED_{11}$, $R_{111}$ and $R_{112}$ of the formula (A), or may be bonded to a substituent on such groups.

In the formula (A), $R_{112}$ represents a hydrogen atom or a substituent that can be substituted for a substituent on a carbon atom. However, $R_{112}$ does not represent the same group as $L_{11}$.

$R_{112}$ preferably represents a hydrogen atom, an alkyl group, an aryl group (such as phenyl group), an alkoxy group (such as methoxy group, ethoxy group, or benzyloxy group), hydroxy group, an alkylthio group (such as methylthio group or butylthio group), amino group, an alkylamino group, an arylamino group, or a heterocyclic amino group, and more preferably a hydrogen atom, an alkyl group, an alkoxy group, hydroxy group, phenyl group or an alkylamino group.

In the formula (A), a ring structure formed by $R_{111}$ is a ring structure corresponding to a tetrahydro form, a hexahydro form or an octahydro form of a 5- or 6-membered aromatic ring (including an aromatic hetero ring), wherein a hydro form means a ring structure in which carbon-carbon (a) double bond(s) (or (a) carbon-nitrogen double bond(s)) present in the aromatic ring (including an aromatic hetero ring) is/are partially halogenated, and a tetrahydro form, a hexahydro form, or an octahydro form respectively means a structure in which two, three or four carbon-carbon double bonds (or carbon-nitrogen double bonds) are hydrogenated, respectively. By such hydrogenation, the aromatic ring becomes a partially hydrogenated non-aromatic ring structure.

Specific examples of the ring structure include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperazine ring, a tetraline ring, a tetrahydroquinoline ring, a tetrahydroisoquinoline ring, a tetrahydroquinazoline ring, a tetrahydroquinoxaline ring, a tetrahydrocarbazole ring, or an octahydrophenanthridine ring. Such ring structures may have an arbitrary substituent.

A ring structure formed by $R_{111}$ is more preferably a pyrrolidine ring, an imidazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring, or a tetrahydrocarbazole ring, and particularly preferably a pyrrolidine ring, a piperidine ring, a piperazine ring, a tetrahydropyridine ring, a tetrahydroquinoline ring, a tetrahydroisoquinoline ring, a tetrahydroquinazoline ring, or a tetrahydroquinoxaline ring, and most preferably a pyrrolidine ring, a piperidine ring, a tetrahydropyridine ring, a tetrahydroquinoline ring, or a tetrahydroisoquinoline ring.

In the formula (B), $RED_{12}$ represents a group having the same difinition as that of $RED_{11}$ in the formula (A), and has the same range of preferable examples as that of $RED_{11}$. In the formula (B), $L_{12}$ represents a group having the same difinition as that of $L_{11}$ in the formula (A), and has the same range of preferable examples as that of $L_{11}$. However $RED_{12}$ is a monovalent group except for a case of forming the following ring structure, and more specifically can be a monovalent group cited as an example of $RED_{11}$. $R_{121}$ and $R_{122}$ represent groups having the same difinition as in $R_{112}$ in the formula (A), and have the same preferable range as that of $R_{112}$. $ED_{12}$ represents an electron donating group. $R_{121}$ and $RED_{12}$, $R_{121}$ and $R_{122}$, or $ED_{12}$ and $RED_{12}$ may be mutually bonded to form a ring structure.

In the formula (B), an electron donating group represented by $ED_{12}$ has the same definition as the electron donating group explained as a substituent on $RED_{11}$ in the case $RED_{11}$ represents an aryl group. $ED_{12}$ is preferably hydroxy group, an alkoxy group, mercapto group, a sulfonamide group, an alkylamino group, an arylamino group, an active methine group, a 5-membered single- or condensed-ringed electron-excessive aromatic heterocyclic group containing at least one nitrogen atom in the ring, a non-aromatic nitrogen-containing heterocyclic group that has the unpaired electron on a nitrogen atom, or a phenyl group substituted by such electron donating group, and more preferably a hydroxy group, a mercapto group, a sulfonamide group, an alkylamino group, an arylamino group, an active methine group, a non-aromatic nitrogen-containing heterocyclic group that has the unpaired electron on a nitrogen atom, or a phenyl group substituted by such electron donating group (for example p-hydroxyphenyl group, a p-dialkylaminophenyl group, an o,p-dialkoxyphenyl group, etc.).

In the formula (B), $R_{121}$ and $RED_{12}$, $R_{122}$ and $R_{121}$, or $ED_{12}$ and $RED_{12}$ may be mutually bonded to form a ring structure. The ring structure thus formed is a substituted or non-substituted, 5- to 7-membered, single-ringed or condensed-ringed, non-aromatic, carbocycle or heterocycle. In the case where $R_{121}$ and $RED_{12}$ form a ring structure, examples thereof include, in addition to the examples of the ring structure formed by $R_{111}$ in the formula (A), a pyroline ring, an imidazoline ring, a thiazoline ring, a pyrrazoline ring, an oxazoline ring, an indane ring, a morpholine ring, an indoline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazine ring, a 2,3-dihydrobenzofuran ring, and a 2,3-dihydrobenzothiophene ring. In the case where $ED_{12}$ and $RED_{12}$ form a ring structure, $ED_{12}$ preferably represents an amino group, an alkylamino group, or an arylamino group, and specific examples of the formed ring structure include a tetrahydropyradine ring, a piperazine ring, a tetrahydroquinoxaline ring, and a tetrahydroisoquinoline ring. In the case where $R_{122}$ and $R_{121}$ form a ring structure, specific examples thereof include a cyclohexane ring and a cyclopentane ring.

In the following an explanation of the formulas (1) to (3) will be given.

In the formulas (1) to (3), $R_1$, $R_2$, $R_{11}$, $R_{12}$ and $R_{31}$ have the same difinition as that of $R_{112}$ in the formula (A) and have the same range of preferable examples as that of $R_{112}$. $L_1$, $L_{21}$ and $L_{31}$ each independently represent any of leaving groups that are cited as specific examples of $L_{11}$ in the formula (A), and has the same range of preferable examples as that of $L_{11}$. $X_1$ or $X_{21}$ each independently represent any of substituents that are cited as examples of the substituent on $RED_{11}$ in the formula (A) in the case where $RED_{11}$ in the formula (A) has a substituent, and has the same range of preferable examples as that of such substituents in the case where $RED_{11}$ in the formula (A) has a substituent. Each of $m_1$ and $m_{21}$ is preferably an integer of 0 to 2, more preferably 0 or 1.

In the case where any of $R_{N1}$, $R_{N21}$ and $R_{N31}$ represents a substituent, such substituent is preferably an alkyl group, an aryl group or a heterocyclic group, which may further have an arbitrary substituent. Each of $R_{N1}$, $R_{N21}$ and $R_{N31}$ is preferably a hydrogen atom, an alkyl group or an aryl group, more preferably a hydrogen atom or an alkyl group.

In the case where any of $R_{13}$, $R_{14}$, $R_{33}$, $R_a$ and $R_b$ represents a substituent, such substituent is preferably an alkyl group, an aryl group, an acyl group, an alkoxycarbonyl group, a carbamoyl group, a cyano group, an alkoxy group, an acylamino group, a sulfonamide group, an ureido group, a thioureido group, an alkylthio group, an arylthio group, an alkylsulfonyl group, an arylsulfonyl group or a sulfamoyl group.

In the formula (1), a 6-membered ring formed by $Z_1$ is a non-aromatic hetero ring condensed with the benzene ring of the formula (1), and is more specifically, as a ring structure including the condensed benzene ring, a tetrahydroquinoline ring, a tetrahydroquinoxaline ring, or a tetrahydroquinazoline ring, and preferably a tetrahydroquinoline ring, or a tetrahydrdoquinoxaline ring. Such rings may have a substituent.

In the formula (2), $ED_{21}$ has the same definition as that of $ED_{12}$ in the formula (B), and has the same preferable range as that of $ED^{12}$.

In the formula (2), any two of $R_{N21}$, $R_{13}$, $R_{14}$, $X_{21}$ and $ED_{21}$ may be mutually bonded to each other to form a ring structure. A ring structure formed by a bonding of $R_{N21}$ and $X_{21}$ is preferably a 5- to 7-membered non-aromatic, carbocycle or heterocycle condensed with a benzene ring, and specific examples include a tetrahydroquinoline ring, a tetrahydroquinoxaline ring, an indoline ring, or a 2,3-dihydro-5,6-benzo-1,4-thiazine ring, preferably a tetrahydrdoquinoline ring, a tetrahydroquinoxaline ring or an indoline ring.

In the formula (3), in the case $R_{N31}$ represents a group other than an aryl group, $R_a$ and $R_b$ are mutually bonded to each other to form an aromatic ring. The aromatic ring can be an aryl group (for example phenyl group or naphthyl group), or an aromatic heterocyclic group (for example a pyridine ring group, a pyrrole ring group, a quinoline ring group or an indol ring group), and is preferably an aryl group. Such aromatic ring group may have an arbitrary substituent.

In the formula (3), $R_a$ and $R_b$ are preferably mutually bonded to each other to form an aromatic ring (particularly phenyl group).

In the formula (3), $R_{32}$ is preferably a hydrogen atom, an alkyl group, an aryl group, a hydroxy group, an alkoxy group, a mercapto group, or an amino group, and, in the case where $R_{32}$ represents a hydroxy group, it is preferable that $R_{33}$ simultaneously represents an "electron attracting group". The "electron attracting group" has the same definition as that explained in the foregoing and is preferably an acyl group, an alkoxycarbonyl group, a carbamoyl group or a cyano group.

In the following, the compound of the type 2 will be explained.

In the compound of the type 2, "a bond-cleaving reaction" means a cleaving of a carbon-carbon, carbon-silicon, carbon-hydrogen, carbon-boron, carbon-tin or carbon-germanium bond, and a cleaving of a carbon-hydrogen bond may further be involved.

The compound of the type 2 is a compound having, in the molecule thereof, two or more (preferably two to six and more preferably two to four) groups adsorbable to silver halide. More preferably it is a compound having, as an adsorbable group, a nitrogen-containing heterocyclic group substituted by two or more mercapto groups. The number of the adsorbable groups is preferably 2 to 6, more preferably 2 to 4. The adsorbable group will be explained later.

Among the compounds of the type 2, a preferred compound is represented by the formula (C).

Formula (C)

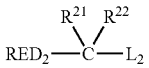

A compound represented by the formula (C) is a compound capable, after a 1-electron oxidation of a reducing group represented by $RED_2$, of spontaneously releasing $L_2$ by a bond cleaving reaction, thereby further releasing an electron.

In the formula (C), $RED_2$ has the same definition as that of $RED_{12}$ in the formula (B), and has the same range of preferable examples as that of $RED_{12}$ in the formula (B). $L_2$ has the same definition as that of $L_{11}$ in the formula (A), and has the same range of preferable examples as that of $L_{11}$ in the formula (A). In the case $L_2$ represents a silyl group, the compound represented by the formula (C) has, within the molecule thereof, a nitrogen-containing heterocyclic group substituted by two or more mercapto groups as an adsorbable group. $R_{21}$ and $R_{22}$ each independently represent a hydrogen atom or a substituent, have the same definition as that of $R_{112}$ in the formula (A), and have the same range of preferable examples as that of $R_{112}$ in the formula (A). $RED_2$ and $R_{21}$ may be mutually bonded to form a ring structure.

The above-mentioned ring structure is a 5- to 7-membered, single-ringed or condensed-ringed, non-aromatic, carbocycle or heterocycle, which may have a substituent. However, such ring structure cannot be a ring structure corresponding to a tetrahydro, hexahydro, or octahydro form of an aromatic ring or an aromatic hetero ring. Such ring structure preferably corresponds to a dihydro form of an aromatic ring or a dihydro form of an aromatic hetero ring, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, and a 1,2-dihydroquinoxaline ring. It is preferably a 2-imidazoline ring, a 2-thiazoline ring, an indoline ring, a benzoimidazoline ring, a benzothiazoline ring, a benzoxazoline ring, a 1,2-dihydropyridine ring, a 1,2-dihydroquinoline ring, a 1,2-dihydroquinazoline ring or a 1,2-dihydroquinoxaline ring, and more preferably an indoline ring, a benzoimidazoline ring, a benzothiazoline ring, or a 1,2-dihydroquinoline ring, and particularly preferably an indoline ring.

In the following, the compound of the type 3 will be explained.

In the compound of the type 3, a "bond forming process" means formation of an interatomic bond such as carbon-carbon, carbon-nitrogen, carbon-sulfur or carbon-oxygen bond.

The compound of the type 3 is preferably a compound characterized in that a 1-electron oxidized form, formed by a 1-electron oxidation, is capable of further releasing one or more electrons, after forming a bond by reacting with a reactive group portion (a carbon-carbon double bond portion, a carbon-carbon triple bond portion, an aromatic group portion or a non-aromatic heterocyclic group portion of a benzo condensed ring) existing in the molecule.

More specifically, the compound of the type 3 is characterized in that a 1-electron oxidized form thereof (cation radical species, or neutral radical species generated therefrom by a proton release), formed by a 1-electron oxidation, reacts with the above-mentioned reactive group present in the same molecule to form a bond, thereby generating new radical species having a ring structure within the molecule, and that a second electron is released from such radical species, either directly or with a proton release.

In a certain compound of the type 3, a 2-electron oxidized form thus generated is subjected to a hydrolysis reaction or directly cause a tautomeric reaction involving a proton transfer, thereby further releasing one or more electrons, usually two or more electrons. Examples of compounds of the type 3 also include a compound capable, without going through such tautomeric reaction, of releasing one or more electrons, usually two or more electrons directly from the 2-electron oxidized form.

The compound of the type 3 is preferably represented by the formula (D'):

$$RED_3—L_3—Y_3 \qquad \text{Formula (D')}$$

In the formula (D'), $RED_3$ represents a reducing group that can be subjected to a 1-electron oxidation; $Y_3$ represents a reactive group portion which reacts after $RED_3$ is 1-electron oxidized, and specifically represents an organic group including a carbon-carbon double bond portion, a carbon-carbon triple bond portion, an aromatic group portion or a non-aromatic heterocyclic group portion of a benzo condensed ring; and $L_3$ represents a connecting group which connects $RED_3$ and $Y^3$.

$RED_3$ has the same definition as that of $RED_{12}$ in the formula (B), and is preferably an arylamino group, a heterocyclic amino group, an aryloxy group, an arylthio group, an aryl group, an aromatic or non-aromatic heterocyclic group (particularly preferably a nitrogen-containing heterocyclic group), and is further preferably an arylamino group, a heterocyclic amino group, an aryl group or an aromatic or non-aromatic heterocyclic group. Among these, the heterocyclic group is preferably a tetrahydroquinoline ring group, a tetrahydroquinoxaline ring group, a tetrahydroquinazoline ring group, an indoline ring group, an indole ring group, a carbazole ring group, a phenoxadine ring group, a phenothiazine ring group, a benzothiazoline ring group, a pyrrol ring group, an imidazole ring group, a thizaole ring group, a benzoimidazole ring group, a benzoimidazoline ring group, a benzothiazoline ring group, or a 3,4-methylenedioxyphenyl-1-yl group.

$RED_3$ is particularly preferably an arylamino group (particularly anilino group), an aryl group (particularly phenyl group), or an aromatic or non-aromatic heterocyclic group.

In the case where $RED_3$ represents an aryl group, the aryl group preferably includes at least one "electron donating group". The meaning of "electron donating group" is the same as that explained in the foregoing.

In the case where $RED_3$ represents an aryl group, a substituent of the aryl group is more preferably an alkylamino group, a hydroxy group, an alkoxy group, a mercapto group, a sulfonamide group, an active methine group, or a non-aromatic nitrogen-containing heterocyclic group that has the unpaired electron on a nitrogen atom, further preferably an alkylamino group, a hydroxy group, an active methine group, or a non-aromatic nitrogen-containing heterocyclic group that has the unpaired electron on a nitrogen atom, and most preferably an alkylamino group or a non-aromatic nitrogen-containing heterocyclic group that has the unpaired electron on a nitrogen atom.

In the case where the organic group including a carbon-carbon double bond portion (for example vinyl group) represented by $Y_3$ has a substituent, such substituent is preferably an alkyl group, a phenyl group, an acyl group, a cyano group, an alkoxycarbonyl group, a carbamoyl group, or an electron donating group, and such electron donating group is preferably an alkoxy group, a hydroxy group (which may be protected with a silyl group and can for example be a trimethylsilyloxy group, a t-butyldimethylsilyloxy group, a triphenylsilyloxy group, a triethylsilyloxy group, or a phenyldimethylsilyloxy group), an amino group, an alkylamino group, an arylamino group, a sulfonamide group, an active methine group, a mercapto group, an alkylthio group or a phenyl group having such electron donating group as a substituent.

In the case where the organic group including a carbon-carbon double bond portion has a hydroxy group as a substituent, $Y_3$ includes a partial structure: $>C_1{=}C_2(-OH)-$, which may be converted, by a tautomerism, to a partial structure: $>C_1H-C_2(=O)-$. Also in such a case, it is also preferable that a substituent on the carbon $C_1$ is an electron attracting group, thus $Y_3$ has a partial structure of "an active methylene group" or "an active methine group". The definition of such an electron attracting group capable of providing such partial structure of an active methylene group or an active methine group, is the same as that explained in the foregoing description of the "active methine group".

In the case where the organic group including a carbon-carbon triple bond portion (for example ethynyl group) represented by $Y_3$ has a substituent, such substituent is preferably an alkyl group, a phenyl group, an alkoxycarbonyl group, a carbamoyl group, or an electron donating group.

In the case $Y_3$ represents an organic group including an aromatic group portion, such aromatic group is preferably an aryl group (particularly preferably phenyl group) having an electron donating group as a substituent, or an indole ring group, and such electron donating group is preferably a hydroxy group (which may be protected with a silyl group), an alkoxy group, an amino group, an alkylamino group, an active methine group, a sulfonamide group or a mercapto group.

In the case $Y_3$ represents an organic group including a non-aromatic heterocyclic group portion of a benzo condensed ring, the non-aromatic heterocyclic group of a benzo condensed ring is preferably a group comprising an aniline structure as a partial structure, such as an indoline ring group, a 1,2,3,4-tetrahydroquinoline ring group, a 1,2,3,4-tetrahydroquinoxaline ring group or a 4-quinolone ring group.

The reactive group represented by $Y_3$ is more preferably an organic group including a carbon-carbon double bond portion, an aromatic group portion or a non-aromatic heterocyclic group portion of a benzo condensed ring. It is further preferably a carbon-carbon double bond portion, a phenyl group having an electron donating group as a substituent, an indole ring group, or a non-aromatic heterocyclic group of a benzo condensed ring comprising an aniline structure as a partial structure. It is further preferred that the carbon-carbon double bond portion has at least one electron donating group as a substituent.

A case where the reactive group represented by $Y_3$, as a result of selection within the aforementioned range, has the same partial structure which is the same as the reducing group represented by $RED_3$ is also a preferred example of the compound represented by the formula (D').

$L_3$ represents a connecting group which connects $RED_3$ and $Y_3$, and more specifically represents a single bond, an alkylene group, an arylene group, a heterocyclic group, —O—, —S—, $—NR_N—$, —C(=O)—, $—SO_2—$, —SO—, —P(=O)—, or a group obtained by combining these groups. RN represents a hydrogen atom, an alkyl group, an aryl group, or a heterocyclic group. The connecting group represented by $L_3$ may have an arbitrary substituent. The connecting group represented by $L_3$ may be connected to an arbitrary position of the groups represented by $RED_3$ and $Y_3$, by substituting an arbitrary hydrogen atom in each of $RED_3$ and $Y^3$.

Preferred examples of $L_3$ include a single bond, an alkylene group (particularly a methylene group, an ethylene group or a propylene group), an arylene group (particularly a phenylene group), —C(=O)—, —O—, —NH—, an —N(alkyl)— group, and a divalent connecting group formed by a combination of these groups.

The connecting group represented by $L_3$ is preferably selected such that, when a cation radical species ($X^{+}\bullet$) generated by an oxidation of $RED_3$ or a radical species ($X\bullet$) generated by proton liberation therefrom reacts with the reactive group represented by $Y_3$ to form a bond, the atomic groups involved in the reaction can form a 3- to 7-membered ring including $L_3$. For this purpose, it is preferred that the radical species ($X^{+}\bullet$ or $X\bullet$), the reactive group represented by Y, and L are connected by a group of 3 to 7 atoms.

In the following, the compound of the type 4 will be explained.

The compound of the type 4 is a compound having a ring structure which is substituted by a reducing group, wherein after a 1-electron oxidation of such reducing group, the compound can release one or more electrons accompanied by a ring-opening reaction. The ring-opening reaction of the ring structure means a reaction indicated in the following:

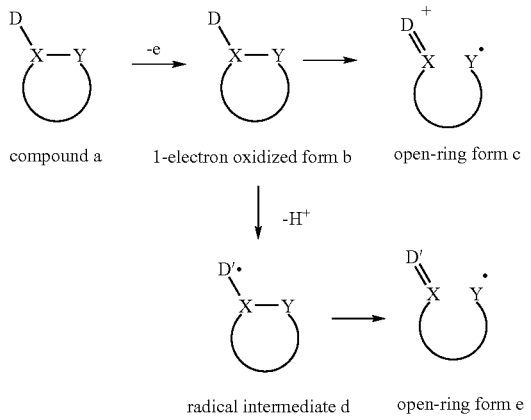

In the formula, a compound a represents the compound of the type 4. In the compound a, D represents a reducing group, and X and Y represent atoms constituting a bond in the ring structure, to be opened after the 1-electron oxidation. At first the compound a is subjected to a 1-electron oxidation to generate a 1-electron oxidized form b. Then a single bond D—X becomes a double bond and a bond X—Y is simultaneously opened to generate an open-ring form c. A process in which the 1-electron oxidized form b causes a proton release to generate a radical intermediate d, from which an open-ring form e is generated in a similar manner, is also possible. The compound of the invention is characterized in that thus generated open-ring form c or e further releases one or more electrons.

The ring structure of the compound of the type 4 is a 3- to 7-membered, single-ringed or condensed-ringed, saturated or unsaturated, non-aromatic, carbocycle or heterocycle. It is preferably a saturated ring structure, and more preferably a 3-membered ring or a 4-membered ring. Preferred examples of the ring structure include a cyclopropane ring, a cyclobutane ring, an oxylane ring, a oxetane ring, an aziridine ring, azetidine ring, an episulfide ring and a thietane ring. It is more preferably a cyclopropane ring, a cyclobutane ring, an oxylane ring, a oxetane ring, or an azetidine ring, and particularly preferably a cyclopropane ring, a cyclobutane ring, or an azetidine ring. The ring structure may have an arbitrary substituent.

The compound of the type 4 is preferably represented by the formula (E) or (F).

Formula (E)

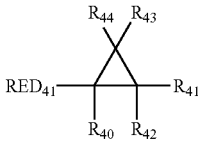

Formula (F)

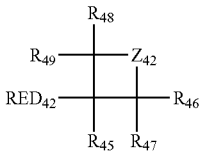

In the formulas (E) and (F), $RED_{41}$ and $RED_{42}$ have the same definition as that of $RED_{12}$ in the formula (B), and have the same range of preferable examples as that of $RED_{12}$ in the formula (B). $R_{40}$ to $R_{44}$ and $R_{45}$ to $R_{49}$ each independently represent a hydrogen atom or a substituent. In the formula (F), $Z_{42}$ represents —$CR_{420}R_{421}$—, —$NR_{423}$—, or —O—. $R_{420}$ and $R_{421}$ each independently represent a hydrogen atom or a substituent, and $R_{423}$ represents a hydrogen atom, an alkyl group, an aryl group or a heterocyclic group.

In the formulas (E) and (F), $R_{40}$ and $R_{45}$ each preferably represents a hydrogen atom, an alkyl group, an aryl group, or a heterocyclic group, more preferably a hydrogen atom, an alkyl group, or an aryl group. $R_{41}$ to $R_{44}$ and $R_{46}$ to $R_{49}$ each preferably represents a hydrogen atom, an alkyl group, an alkenyl group, an aryl group, a heterocyclic group, an arylthio group, an alkylthio group, an acylamino group, or a sulfonamide group, more preferably a hydrogen atom, an alkyl group, an aryl group or a heterocyclic group.

There are preferred a case where at least one of $R_{41}$ to $R_{44}$ is a donor group and a case where both $R_{41}$ and $R_{42}$, or both $R_{43}$ and $R_{44}$ are electron attracting groups. There is more preferred a case where at least one of $R_{41}$ to $R_{44}$ is a donor group. There is further preferred a case where at least one of $R_{41}$ to $R_{44}$ is a donor group and the other non-donor group(s) in $R_{41}$ to $R_{44}$ is a hydrogen atom or an alkyl group.

The aforementioned donor group means an "electron donating group", or an aryl group substituted by at least one "electron donating group". The donor group is preferably an alkylamino group, an arylamino group, a heterocyclic amino group, a 5-membered, single-ringed or condensed-ringed, electron-excessive aromatic heterocyclic group containing at least a nitrogen atom in the ring, a non-aromatic, nitrogen-containing heterocyclic group which has the unpaired electron at a nitrogen atom, or a phenyl group substituted by at least an electron donating group. The doner group is more preferably an alkylamino group, an arylamino group, a 5-membered, single-ringed or condensed-ringed, electron-excessive aromatic heterocyclic group containing at least one nitrogen atom in the ring (such as an indole ring, a pyrrole ring or a carbazole ring), or a phenyl group substituted by an electron donating group (such as a phenyl group substituted by three or more alkoxy groups, or a phenyl group substituted by a hydroxy group, an alkylamino group or an arylamino group). Particularly preferably, the doner group is an arylamino group, a 5-membered, single-ringed or condensed-ringed, electron-excessive aromatic heterocyclic group containing at least a nitrogen atom in the ring (particularly 3-indolyl group), or a phenyl group substituted by an electron donating group (particularly a phenyl group substituted by a trialkoxyphenyl group, an alkylamino group or an arylamino group).

$Z_{42}$ is preferably —$CR_{420}R_{421}$— or —$NR_{423}$—, and more preferably —$NR_{423}$—. Each of $R_{420}$ and $R_{421}$ is preferably a hydrogen atom, an alkyl group, an aryl group, a heterocyclic group, an acylamino group, or a sulfonamino group, and more preferably a hydrogen atom, an alkyl group, an aryl group, or a heterocyclic group. $R_{423}$ preferably represents a hydrogen atom, an alkyl group, an aryl group or an aromatic heterocyclic group, more preferably a hydrogen atom, an alkyl group or an aryl group.

In the case each of $R_{40}$ to $R_{49}$, $R_{420}$, $R_{421}$ and $R_{423}$ represents a substituent, it preferably has a total carbon number of 40 or less, more preferably 30 or less, and particularly preferably 15 or less. Also these substituents may be bonded mutually, or bonded with another portion ($RED_{41}$, $RED_{42}$ or $Z_{42}$) in the molecule, to form a ring.

In the compounds of the types 1 to 4 of the invention, an adsorbable group to silver halide means a group that can be directly adsorbed by silver halide or a group capable of accelerating an adsorption on silver halide, and is specifically a mercapto group (or a salt thereof), a thion group (—C(=S)—), a heterocyclic group containing at least an atom selected from the group consisting of a nitrogen atom, a sulfur atom, a selenium atom and a tellurium atom, a sulfide group, a cationic group, or an ethynyl group. However, in the case of a compound of the type 2 of the invention, the adsorbable group cannot be a sulfide group.

A mercapto group (or a salt thereof) as the adsorbable group means not only a mercapto group (or a salt thereof) itself but also, more preferably, a heterocyclic group substituted by at least one mercapto group (or a salt thereof), an aryl group substituted by at least one mercapto group (or a salt thereof), or an alkyl group substituted by at least one mercapto group (or a salt thereof). The heterocyclic group is a 5- to 7-membered, single-ringed or condensed-ringed, aromatic or non-aromatic heterocyclic group such as an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline group, a pyrimidine ring group or a triazine ring group. It can also be a heterocyclic group including a quaternary nitrogen atom, and, in such case, a mercapto group as a substituent may be dissociated to form a meso ion. Examples of such heterocyclic group include an imidazolium ring group, a pyrazolium ring group, a thiazolium ring group, a triazolium ring group, a tetrazolium ring group, a thiadiazolium ring group, a pyridinium ring group, a pyrimidinium ring group, and a triazinium ring group, among which a triazolium ring group (such as 1,2,4-triazolium-3-thiolate ring group) is preferable. The aryl group can be a phenyl group or a naphthyl group. Also the alkyl group can be a linear, branched or cyclic alkyl group with 1 to 30 carbon atoms. In the case where the mercapto group forms a salt, a counter ion can be a cation such as: an alkali metal, an alkali earth metal, and a heavy metal ($Li^+$, $Na^+$, $K^+$, $Mg^{2+}$, $Ag^+$, $Zn^{2+}$ etc.); an ammonium ion; a heterocyclic group containing a quaternary nitrogen atom; or a phosphonium ion.

The mercapto group as the adsorbable group may become a thion group by tautomerism, and can specifically be a thioamide group (—C(=S)—NH— in this case) or a group including a partial structure of such thioamide group, such as a linear or cyclic thioamide group, a linear or cyclic thioureido group, a linear or cyclic thiourethane group, or a dithiocarbamate ester group. Examples of the cyclic group include a thiazolidine-2-thion group, an oxazolidine-2-thion group, a 2-thiohidantoin group, a rhodanin group, an isorhodanin group, a thiobarbituric acid group, and 2-thioxo-oxazolidin-4-on group.

Examples of the thion group as the adsorbable group includes not only the aforementioned thion group formed by tautomerism from a mercapto group, but also a linear or cyclic thioamide group, a linear or cyclic thioureido group, a linear or cyclic thiourethane group and a dithiocarbamate ester group, each of which cannot be converted to a mercapto group by tautomerism (not having a hydrogen atom in α-position of thion group).

The heterocyclic group containing at least one atom selected from a nitrogen atom, a sulfur atom, a selenium atom and a tellurium atom, as the adsorbable group, is a nitrogen-containing heterocyclic group having, as a partial structure of the hetero ring, an —NH— group capable of forming an imino silver (>NAg), or a heterocyclic group having, as a partial structure of the hetero ring, —S—, —Se—, —Te— or=N— capable of coordinating to a silver ion by a coordinate bond. Examples of the former include a benzotriazole group, a triazole group, an indazole group, a pyrrazole group, a tetrazole group, a benzimidazole group, an imidazole group and a purine group, while examples of the latter include a thiophene group, a thiazole group, an oxazole group, a benzothiazole group, a benzoxazole group, thiadiazole group, an oxadiazole group, a triazine group, a selenoazole group, a benzselenoazole group, a tellurazole group and a benztellurazole group. The former is preferable.

A sulfide group as the adsorbable group can be any group having an —S— partial structure, and is preferably a group having a partial structure of alkyl(or alkylene)-S-alkyl(or alkylene), aryl(or arylene)-S-alkyl(or alkylene) or aryl(or arylene)-S-aryl(or arylene). Also such sulfide group may form a ring structure or may form a —S—S— group. Specific examples in the case of forming a ring structure include a group containing a thiolan ring, a 1,3-dithiolan ring, a 1,2-dithiolan ring, a thian ring, a dithian ring, or a tetrahydro-1,4-thiazine ring (a thiomorpholine ring). A sulfide group is particularly preferably a group having a partial structure of alkyl(or alkylene)-S-alkyl(or alkylene).

A cationic group as the adsorbable group means a group containing a quaternary nitrogen atom, and is specifically a group including an ammonio group or a group including a nitrogen-containing heterocyclic group containing a quaternary nitrogen atom. However, such cationic group does not become a part of an atomic group constituting a dye structure (for example, a cyanine chromophore). The ammonio group is, for example, a trialkylammonio group, a dialkylarylammonio group or an alkyldiarylammonio group, and can be, for example, benzyldimethylammonio group, trihexylammonio group or phenyldiethylammonio group. A nitrogen-containing heterocyclic group including a quaternary nitrogen atom can be, for example, a pyridinio group, a quinolinio group, an isoquinolinio group or an imiazolio group. It is preferably a pyridinio group or an imidazolio group, and particularly preferably a pyridinio group. Such nitrogen-containing heterocyclic group including a quaternary nitrogen atom may have an arbitrary substituent, however, in the case of pyridinio group or imidazolio group, the substituent is preferably an alkyl group, an aryl group, an acylamino group, a chlorine atom, an alkoxycarbonyl group or a carbamoyl group, and, in the case of a pyridinio group, the substituent is particularly preferably a phenyl group.

An ethynyl group as the adsorbable group means —C≡CH, in which the hydrogen atom may be substituted.

Such adsorbable group may have an arbitrary substituent.

Specific examples of the adsorbable group also include the adsorbable groups described in JP-A No. 11-95355, pages 4 to 7.

In the invention, the adsorbable group is preferably a mercapto-substituted nitrogen-containing heterocyclic group (such as a 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzothiazole group, or 1,5-dimethyl-1,2,4-triazolium-3-thiolate group), or a nitrogen-containing heterocyclic group having an —NH— group capable of forming imino silver (>NAg) as a partial structure of the hetero ring (such as a benzotriazole group, a benzimidazole group, or an indazole group). It is particularly preferably a 5-mercaptotetrazole group, 3-mercapto-1,2,4-triazole group, or a benzotriazole group, and most preferably a 3-mercapto-1,2,4-triazole group or a 5-mercaptotetrazole group.

Among the compounds of the invention, there is also preferred a compound having two or more mercapto groups as a partial structure within the molecule. The mercapto group (—SH) may become a thion group in the case tautomerism is possible. Such compound may be a compound having, within the molecule, two or more adsorbable groups which have the aforementioned mercapto or thion group as a partial structure (such as a ring-forming thioamide group, an alkylmercapto group, an arylmercapto group or a heterocyclic mercapto group), or a compound having at least an adsorbable group which includes two or more mercapto or thion groups as a partial structure (for example a dimercapto-substituted nitrogen-containing heterocyclic group).

Examples of the adsorbable group having two or more mercapto groups as a partial structure (such as a dimercapto-substituted nitrogen-containing heterocyclic group) include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, 2,7-dimercapto-5-methyl-s-triazolo(1,5-A)-pyrimidine, 2,6,8-trimercaptopurine, 6,8-dimercaptopurine, 3,5,7-trimercapto-s-triazolotriazine, 4,6-dimercaptopyrazolopyrimidine, and 2,5-dimercaptoimidazole, and particularly preferably a 2,4-dimercaptopyrimidine group, a 2,4-dimercaptotriazine group or a 3,5-dimercapto-1,2,4-triazole group.

The adsorbable group may be bonded to any position in the formulas (A) to (F) and the formulas (1) to (3), but it is preferably substituted on $RED_{11}$, $RED_{12}$, $RED_2$ or $RED_3$ in the formulas (A) to (D), on $RED_{41}$, $R_{41}$, $RED_{42}$ or $R_{46}$ to $R_{48}$ in the formula (E) or (F), or on an arbitrary position excluding $R_1$, $R_2$, $R_{11}$, $R_{12}$, $R_{31}$, $L_1$, $L_{21}$ and $L_{31}$ in the formulas (1) to (3), and is more preferably substituted, in all the formulas (A) to (F), on $RED_{11}$ to $RED_{42}$.

A partial structure of a spectral sensitizing dye is a group including a chromophore of the spectral sensitizing dye, and is a residue obtained by eliminating a hydrogen atom or a substituent in an arbitrary position from the spectral sensitizing dye compound. The partial structure of the spectral sensitizing dye may be substituted in any position in the formulas (A) to (F) and the formulas (1) to (3), but is preferably substituted on $RED_{11}$, $RED_{12}$, $RED_2$ or $RED_3$ in the formulas (A) to (D), on $RED_{41}$, $R_{41}$, $RED_{42}$ or $R_{46}$ to $R_{48}$ in the formula (E) or (F), or on an arbitrary position excluding $R_1$, $R_2$, $R_{11}$, $R_{12}$, $R_{31}$, $L_1$, $L_{21}$ and $L_{31}$ in the formulas (1) to (3), and is more preferably substituted, in all the formulas (A) to (F), on $RED_{11}$ to $RED_{42}$. A preferred spectral sensitizing dye is a spectral sensitizing dye typically employed in the color sensitizing technology, and examples thereof includes, for example, a cyanine dye, a complex cyanine dye, a melocyanine dye, a complex melocyanine dye, a homopolar cyanine dye, a styryl dye and a hemicyanine dye. Representative spectral sensitizing dyes are described in Research Disclosure, item 36544, September 1994. These dyes can be synthesized by those skilled in the art according to procedures described in such Research Disclosure and in F. M. Hamer, The Cyanine dyes and Related Compounds (Interscience Publishers, New York, 1964). Also all the dyes described in JP-A No. 11-95355 (U.S. Pat. No. 6,054,260), pages 7 to 14, can be applied.

The compound of the types 1 to 4 of the invention preferably has a total number of carbon atoms within a range of 10 to 60, more preferably 15 to 50, further preferably 18 to 40 and particularly preferably 18 to 30.

The compound of the types 1 to 4 of the invention is subjected to a 1-electron oxidation which is triggered by an exposure of a silver halide photosensitive material comprising such compound to radiation, and, after an ensuing reaction, is oxidized by releasing an electron or two or more electrons based on the type of the compound, and an oxidation potential for such first electron is preferably about 1.4 V or less, and more preferably 1.0 V or less. Such oxidation potential is preferably higher than 0 V and more preferably higher than 0.3 V. Therefore, the oxidation potential is preferably within a range of about 0 to about 1.4 V, more preferably about 0.3 to about 1.0 V.

The oxidation potential can be measured by a cyclic voltammetry method, more specifically by dissolving a sample in a solution of acetonitrile : water (containing 0.1 M lithium perhydrochlorate)=80%: 20% (vol. %), aerate the solution with nitrogen gas for 10 minutes, and executing a measurement with a potential scanning rate of 0.1 V/sec at 25° C., utilizing a glass-like carbon disk as an operating electrode, a platinum wire as a counter electrode and a calomel electrode (SCE) as a reference electrode. An oxidation potential relative to SCE is measured at a peak potential of a cyclic voltammetry wave.

In the case the compound of the types 1 to 4 of the invention is a compound which, after a 1-electron oxidation and an ensuing reaction, further releases one electron, an oxidation potential of such latter oxidation is preferably from −0.5 to −2 V, more preferably from −0.7 to −2 V and further preferably from −0.9 to −1.6 V.

In the case where the compound of the types 1 to 4 of the invention is a compound which, after a 1-electron oxidation and an ensuing reaction, is oxidized by further releasing two or more electrons, an oxidation potential of such latter oxidation is not particularly restricted. This is because the oxidation potential for the second electron and the oxidation potential for the third or later electron cannot be clearly distinguished and it is often difficult to exactly measure and distinguish these values.

In the following, the compound of the type 5 will be explained.

The compound of the type 5 is represented by X—Y, in which X represents a reducing group and Y represents a leaving group, wherein a 1-electron oxidized form, generated by a 1-electron oxidation of the reducing group represented by X, causes a cleaving reaction of X—Y bond thereby releasing Y and generating an X radical, thus further releasing an electron therefrom. The oxidation of such compound of the type 5 can be represented by the following formula:

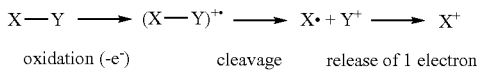

The compound of the type 5 preferably has an oxidation potential from 0 to 1.4 V, more preferably 0.3 to 1.0 V. Also the radical X. generated in the foregoing reaction formula preferably has an oxidation potential from 0.7 to −2.0 V, more preferably from −0.9 to −1.6 V.

The compound of the type 5 is preferably represented by the formula (G).

Formula (G)

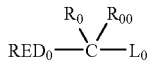

In the formula (G), $RED_0$ represents a reducing group; $L_0$ represents a leaving group; $R_0$ and $R_{00}$ each independently represent a hydrogen atom or a substituent. $RED_0$ and $R_0$, or $R_0$ and $R_{00}$ may be mutually bonded to form a ring structure. $RED_0$ has the same definition as $RED_2$ in the formula (C), and has the same range of preferable examples as $RED_2$ in the formula (C). $R_0$ and $R_{00}$ have the same definition as $R_{21}$ and $R_{22}$ in the formula (C), and have the same range of preferable examples as $R_{21}$ and $R_{22}$ in the formula (C). However, each of $R_0$ and $R_{00}$ does not represent the same group as $L_0$, except in the case where $L_0$ represents a hydrogen atom. $RED_0$ and $R_0$ may be mutually bonded to form a ring structure. Examples of such a ring structure are the same as the examples of the ring structure formed by bonding of $RED_2$ to $R_{21}$ in the formula (C). And the preferable range of the ring structure formed by the bond between $RED_0$ and $R_0$ is also the same as that of the ring structure formed by the bond between $RED_2$ to $R_{21}$ in the formula (C). Examples of the ring structure formed by mutual bonding of $R_0$ and $R_{00}$ include a cyclopentane ring and a tetrahydrofuran ring. In the formula (G), $L_0$ has the same definition as $L_2$ in the formula (C), and has the same range of preferable examples as $L_2$ in the formula (C).

The compound represented by the formula (G) preferably has an adsorbable group to silver halide, or a partial structure of a spectral sensitizing dye. However, in the case where $L_0$ represents a group other than a silyl group, the compound does not have two or more adsorbable groups at the same time within the molecule. However, two or more sulfide groups as adsorbable groups may be present in the compound regardless of $L_0$.

Examples of an adsorbable group to silver halide, in the compound represented by the formula (G), include the adsorbable groups that can be included in the compound of the types 1 to 4 of the invention, and also include all compounds that is described as "adsorbable group to silver halide" in JP-A No. 11-95355, pages 4 to 7, and the preferable range is also the same.

A partial structure of a spectral sensitizing dye which may be included in the compound represented by the formula (G) has the same definition as the partial structure of the spectral sensitizing dye which may be included in the compound of the types 1 to 4 of the invention. However examples of the partial structure of a spectral sensitizing dye in the compound represented by the formula (G) also include all structures described as "light absorbing groups" in JP-A No. 11-95355, pages 7 to 14, and the preferable range is also the same.

In the following, specific examples of the compound of the types 1 to 5 of the invention are shown, but the invention is not limited to such examples.

1

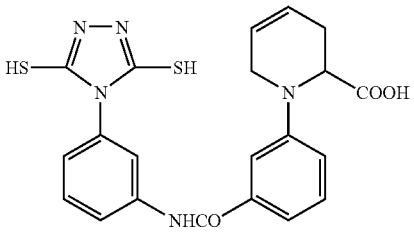

2

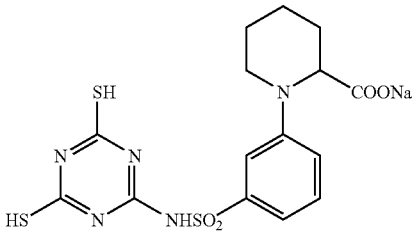

3

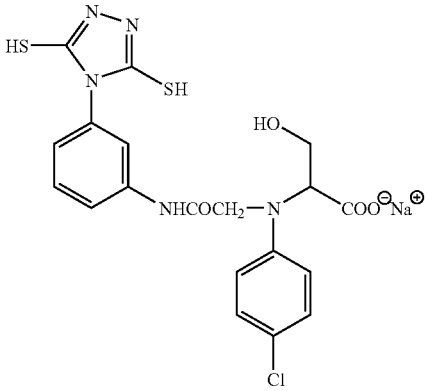

-continued

4

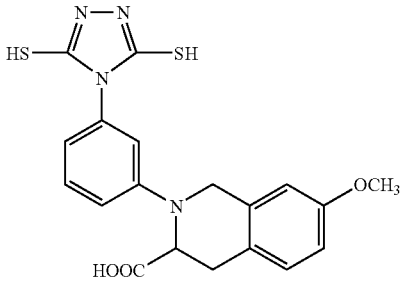

5

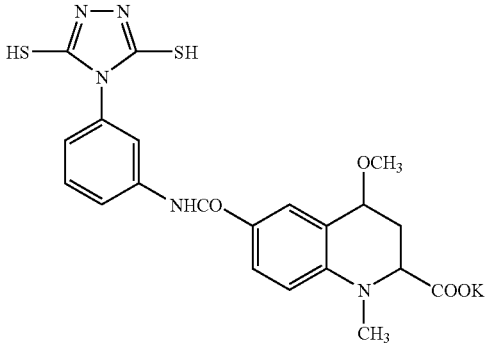

6

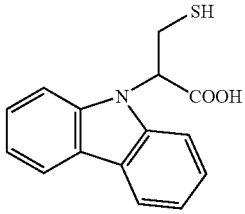

7

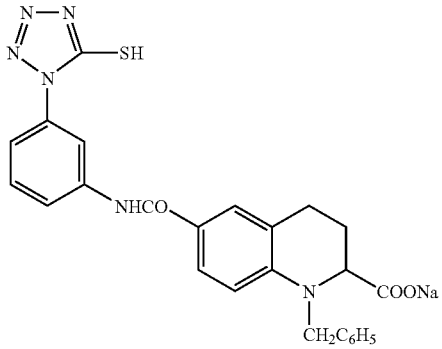

8

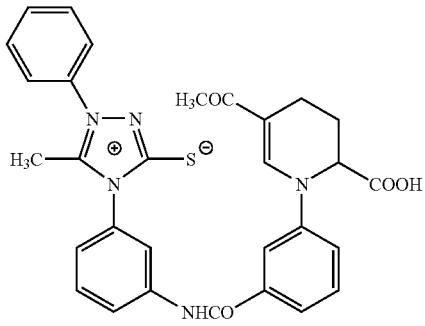

-continued
9
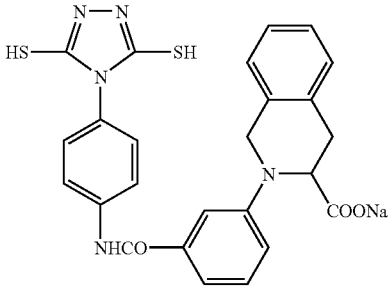
10
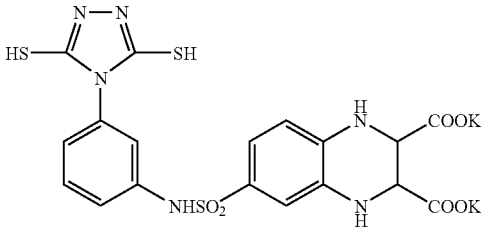
11
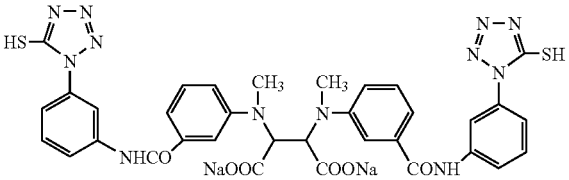
12
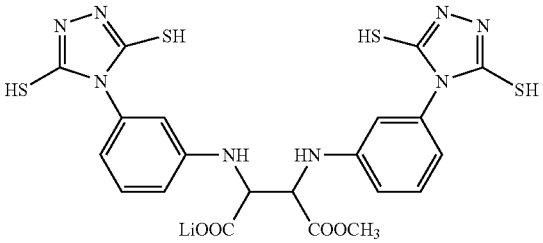
13
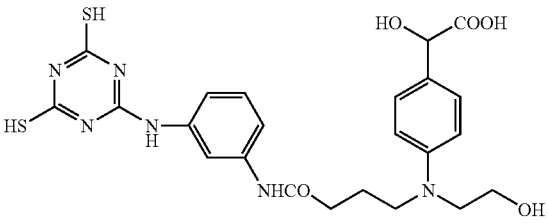
14
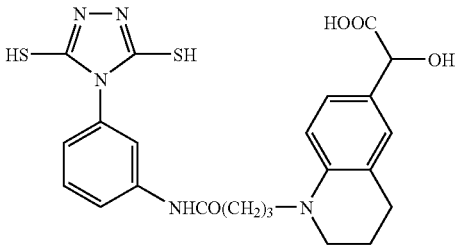
-continued
15
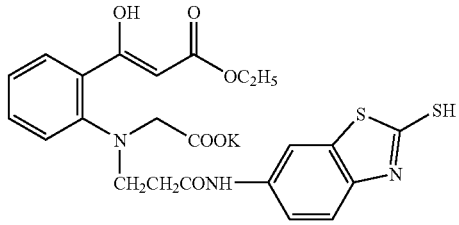
16
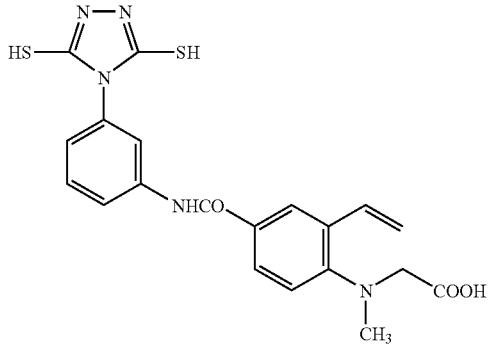
17
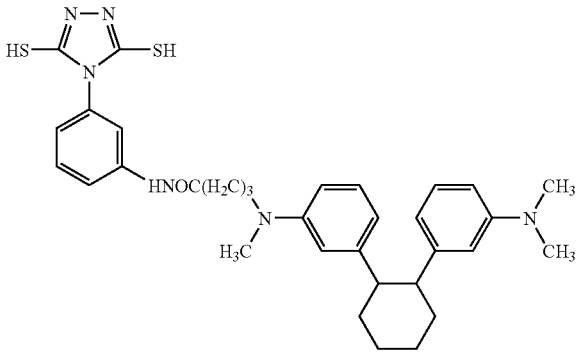
18
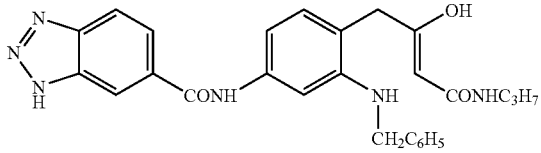
19
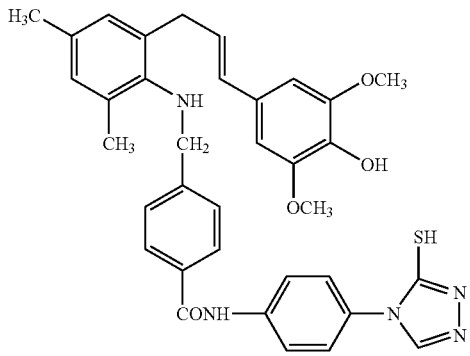

-continued
20
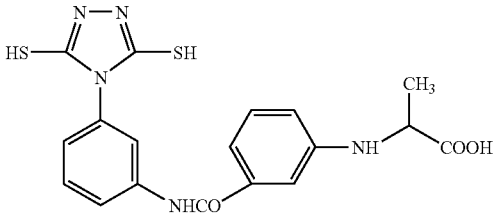
21
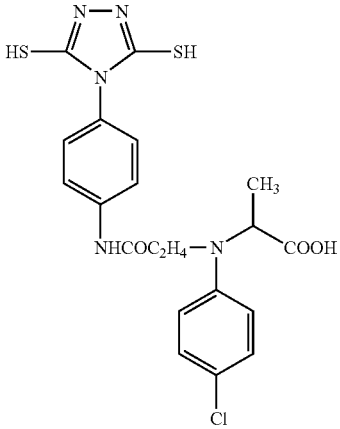
22
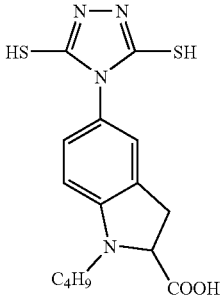
23
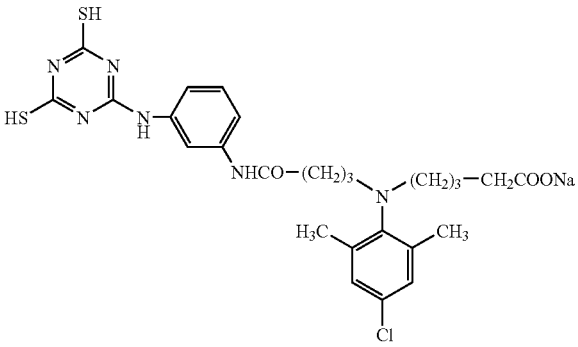
-continued
24
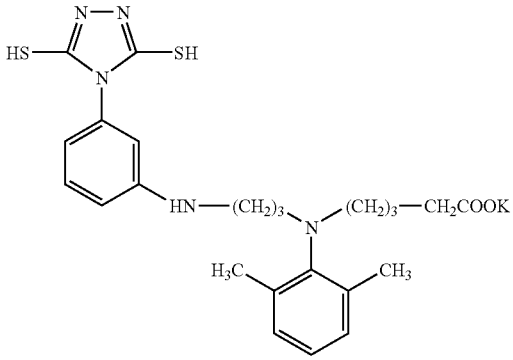
25
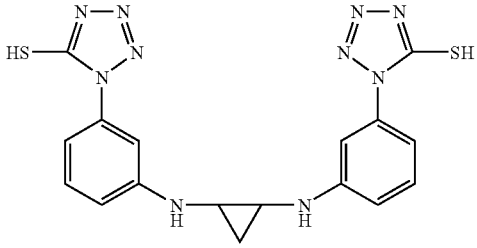
26
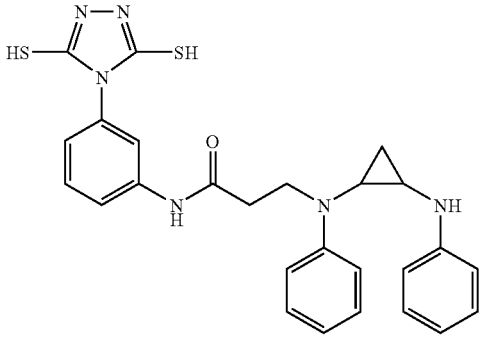
27
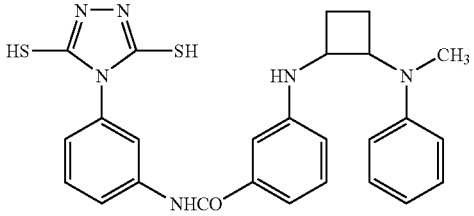
28
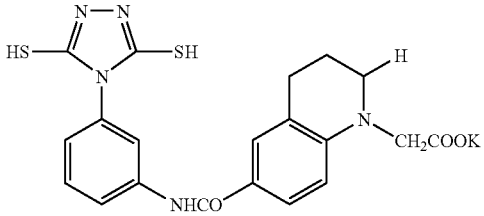

-continued
29
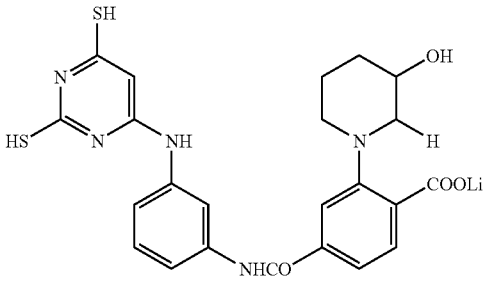
30
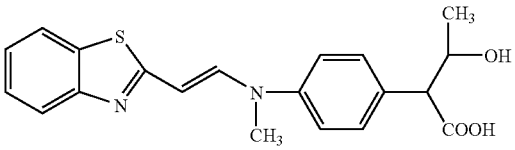
31
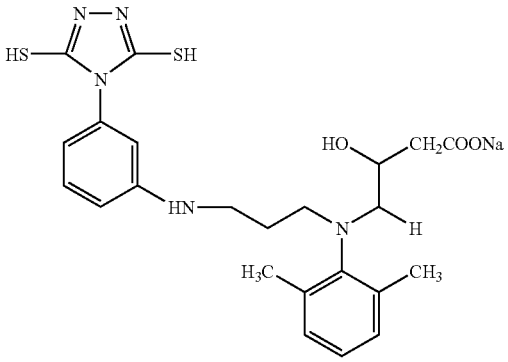
32
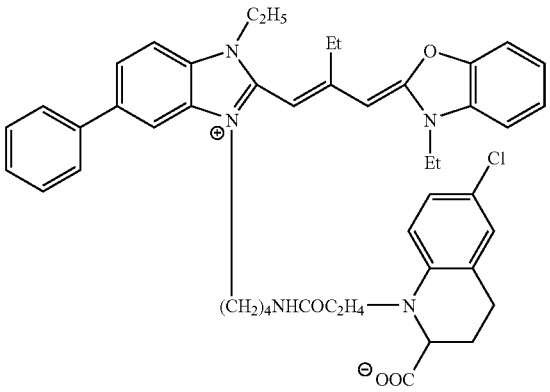
33
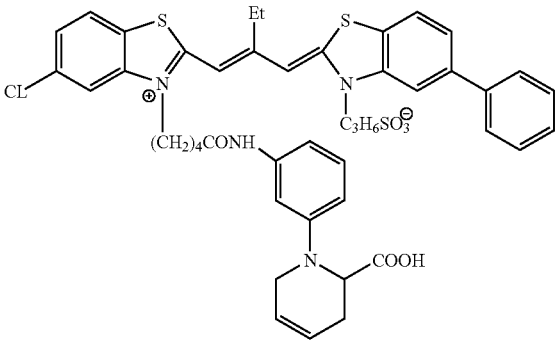
-continued
34
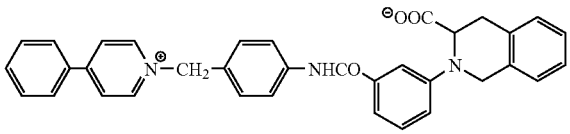
35
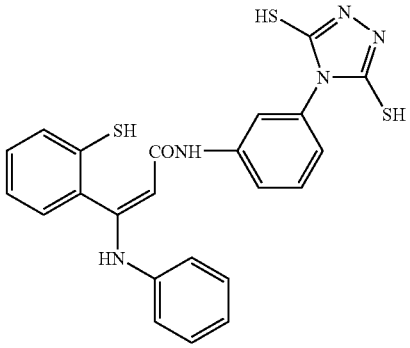
G-1
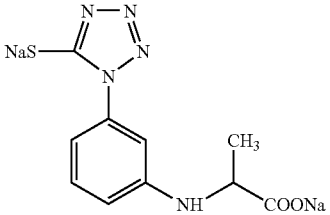
G-2
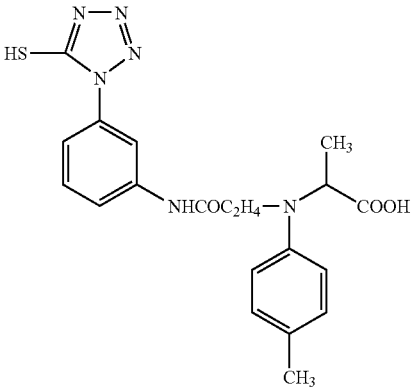
G-3
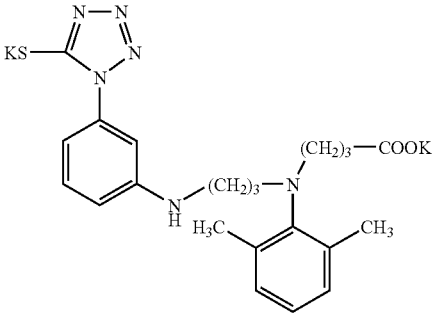
G-4
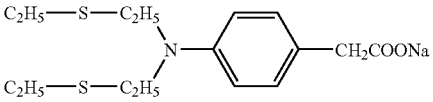

-continued

G-5

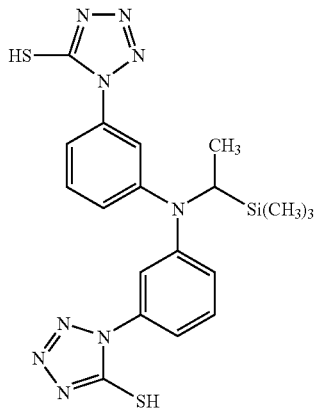

The compounds of the types 1 to 4 of the invention are the same as the compounds explained in detail in JP-A Nos. 2003-114487, 2003-114486, 2003-140287, 2003-075950, and 2003-114488. The specific examples of the compounds described in these patent applications can also be included in specific examples of the compounds of the types 1 to 4 of the invention. Also synthesis examples of the compounds of the types 1 to 4 of the invention are the same as those described in these patent applications.

Examples of the compound of the type 5 of the invention include compounds described as "1-photon 2-electron sensitizer" or "deprotonation electron donating sensitizer" in JP-A No. 9-211769 (compounds PMT-1 to S-37 described in Tables E and F on pages 28 to 32), JP-A No. 9-211774, JP-A No. 11-95355 (compounds INV1-36), WO99/05570 (compounds 1-74, 80-87, 92-122), U.S. Pat. Nos. 5,747,235 and 5,747,236, EP No. 786692A1 (compounds INV1-35), EP No. 893732A1, U.S. Pat. Nos. 6,054,260 and 5,994,051.

The compound of the types 1 to 5 of the invention may be used in any stage in the preparation of a photosensitive silver halide emulsion or in the production process of a photothermographic material. For example the compound may be used in a formation of photosensitive silver halide grains, in a desalting step, at a chemical sensitization or before coating. The compound may also be added plural times in such process. The timing of addition is preferably within a period from the completion of silver halide grain formation to a time just before the desalting step, or at the chemical sensitization (from immediately before the start of the chemical sensitization to immediately after the completion of the chemical sensitization), or at a step just befor the coating, and more preferably within a period from the chemical sensitization to a time just before the mixing with a non-photosensitive organic silver halide.

The compound of the types 1 to 5 of the invention is added preferably after being dissolved in water, a water-soluble solvent such as methanol or ethanol, or a mixture thereof. In the case of dissolving the compound in water, a compound that changes its solubility depending on pH may be dissolved at a higher or lower pH to increase the solubility.

The compound of the types 1 to 5 of the invention is preferably used in an emulsion layer including a photosensitive silver halide and a non-photosensitive organic silver salt, however it may be added in a protective layer or an intermediate layer in addition to an emulsion layer which includes a photosensitive silver halide and a non-photosensitive organic silver salt, and may be diffused at the coating. In both cases where the compound of the invention is added before the addition of a sensitizing dye and where the compound of the invention is added after the addition of a sensitizing dye, the compound of the invention is included in the silver halide emulsion layer in an amount of $1\times10^{-9}$ to $5\times10^{-1}$ moles per 1 mole of silver halide, more preferably $1\times10^{-8}$ to $5\times10^{-2}$ moles.

10) Adsorbable Redox Compound

The photothermographic material according to the invention prefrably includes an adsorbable redox compound having a group which is can be adsorbed by silver and a reducing group within a molecule.

The adsorbable redox compound used in the invention is preferably a compound represented by the following formula (I):

$$A—(W)_n—B \quad (I)$$

In the formula, A represents a group that can be adsorbed by silver halide (hereinafter called an adsorbable group); W represents a divalent connecting group; n represents 0 or 1; and B represents a reducing group.

In the following, a detailed explanation will be given of the compound of the formula (I).

In the formula (I), an adsorbable group represented by A is a group that can be directly adsorbed by silver halide or a group capable of accelerating an adsorption on silver halide, and can specfically be a mercapto group (or a salt thereof), a thion group (—C(═S)—), a heterocyclic group containing at least an atom selected from a nitrogen atom, a sulfur atom, a selenium atom and a tellurium atom, a sulfide group, a disulfide group, a cationic group, or an ethynyl group.

A mercapto group (or a salt thereof as the adsorbable group refers to not only a mercapto group (or a salt thereof) itself but also and more preferably, a heterocyclic group, an aryl group or an alkyl group substituted by at least a mercapto group (or a salt thereof). The heterocyclic group means a 5- to 7-membered, single-ringed or condensed-ringed, aromatic or non-aromatic heterocyclic group such as an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline group, a pyrimidine ring group or a triazine ring group. The heterocyclic group may include a quaternary nitrogen atom, and, in such a case, the mercapto group on the heterocyclic group may be dissociated to form a meso ion. Examples of such a heterocyclic group include an imidazolium ring group, a pyrazolium ring group, a thiazolium ring group, a triazolium ring group, a tetrazolium ring group, a thiadiazolium ring group, a pyridinium ring group, a pyrimidinium ring group, and a triazinium ring group, among which a triazolium ring group (such as 1,2,4-triazolium-3-thiolate ring group) is preferable. An aryl group can be a phenyl group or a naphthyl group. Also an alkyl group can be a linear, branched or cyclic alkyl group with 1 to 30 carbon atoms. When the mercapto group forms a salt, a counter ion can be a cation of an alkali metal, an alkali earth metal or a heavy metal (for example, $Li^+$, $Na^+$, $K^+$, $Mg^{2+}$, $Ag^+$, $Zn^{2+}$ etc.), an ammonium ion, a heterocyclic group containing a quaternary nitrogen atom, or a phosphonium ion.

The mercapto group as the adsorbable group may become a thion group by a tautomerism, and can specifically be a thioamide group (—C(═S)—NH— in this case) or a group including a partial structure of such a thioamide group, for example, a linear or cyclic thioamide group, a thioureido group, a thiourethane group, or a dithiocarbamate ester group.

Examples of the cyclic group include a thiazolidine-2-thion group, an oxazolidine-2-thion group, a 2-thiohidantoin group, a rhodanin group, an isorhodanin group, a thiobarbituric acid group, and a 2-thioxo-oxazolidin-4-one group.

The thion group as the adsorbable group includes not only the aforementioned thion group formed by a tautomerism from a mercapto group, but also a linear or cyclic thioamide group, a thioureido group, a thiourethane group and a dithiocarbamate ester group each of which cannot be converted to a mercapto group by a tautomerism (not having a hydrogen atom in a-position of thion group).

The heterocyclic group containing at least an atom selected from a nitrogen atom, a sulfur atom, a selenium atom and a tellurium atom, as the adsorbable group, is a nitrogen-containing heterocyclic group comprising an —NH— group which can form an imino silver (>NAg) as a partial structure of the hetero ring, or a heterocyclic group comprising —S—, —Se—, —Te— or ═N—, each of which can coordinate to a silver ion by a coordinate bond, as a partial structure of the hetero ring. Examples of the former include a benzotriazole group, a triazole group, an indazole group, a pyrrazole group, a tetrazole group, a benzimidazole group, an imidazole group and a purine group, while examples of the latter include a thiophene group, a thiazole group, an oxazole group, a benzothiophene group, a benzothiazole group, a benzoxazole group, thiadiazole group, an oxadiazole group, a triazine group, a selenoazole group, a benzselenoazole group, a tellurazole group and a benztellurazole group. The former is preferable.

A sulfide group or a disulfide group as the adsorbable group can be any group having a partial structure of —S— or —S—S—, and is preferably a group having a partial structure of alkyl(or alkylene)-X-alkyl(or alkylene), aryl(or arylene)-X-alkyl(or arkylene) or aryl(or arylene)-X-aryl(or arylene), wherein X represents —S— or —S—S—. Also such a sulfide group or disulfide group may form a cyclic structure, and specific examples of such a cyclic structure include a group containing a thiolan ring, a 1,3-dithiolan ring, a 1,2-dithiolan ring, a thian ring, a dithian ring, or a thiomorpholine ring. The sulfide group is particularly preferably a group having a partial structure of alkyl(or alkylene)-S-alkyl(or alkylene), and the disulfide group is particularly preferably a 1,2-dithiolan ring.

A cationic group as the adsorbable group means a group containing a quaternary nitrogen atom, and specifically includes an ammonio group and a nitrogen-containing heterocyclic group containing a quaternary nitrogen atom. An ammonio group is, for example, a trialkylammonio group, a dialkylarylammonio group or an alkyldiarylammonio group, and can specifically be, for example, benzyldimethylammonio group, trihexylammonio group or phenyldiethylammonio group. A nitrogen-containing heterocyclic group including a quaternary nitrogen atom can be, for example, a pyridinio group, a quinolinio group, an isoquinolinio group or an imiazolio group, and can preferably be a pyridinio group or an imidazolio group, and particularly preferably a pyridinio group. Such nitrogen-containing heterocyclic group including a quaternary nitrogen atom may have an arbitrary substituent. In the case of a pyridinio group or an imidazolio group, the substituent is preferably an alkyl group, an aryl group, an acylamino group, a chlorine atom, an alkoxycarbonyl group or a carbamoyl group, and, in the case of a pyridinio group, the substituent is particularly preferably a phenyl group.

An ethynyl group as the adsorbable group means —C≡CH, in which the hydrogen atom may be substituted.

The adsorbable group may have an arbitrary substituent. Examples of the substituent include a halogen atom (a fluorine atom, a chlorine atom, a bromine atom or an iodine atom), an alkyl group (a linear, branched or cyclic alkyl group, and may be a bicycloalkyl group or an active methine group), an alkenyl group, an alkynyl group, an aryl group, a heterocyclic group (the adsorbable group may be bonded to any position), an acyl group, a heterocyclic oxycarbonyl group, an alkoxycarbonyl group, an aryloxycarbonyl group, a carbamoyl group, an N-hydroxycarbamoyl group, an N-acylcarbamoyl group, an N-sulfonylcarbamoyl group, an N-carbamoylcarbamoyl group, a thiocarbamoyl group, an N-sulfamoylcarbamoyl group, a carbazoyl group, a carboxyl group or a salt thereof, an oxalyl group, an oxamoyl group, a cyano group, a carbonimidoyl group, a formyl group, a hydroxy group, an alkoxy group (may be a group containing a repeating ethyleneoxy group or a repeating propyleneoxy group), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, an acylamino group, a sulfonamide group, an ureido group, a thioureido group, an N-hydroxyureido group, an imide group, an (alkoxy or aryloxy)carbonylamino group, a sulfamoylamino group, a semicarbazide group, a thiosemicarbazide group, a hydrazino group, an ammonio group, an oxamoylamino group, an N-(alkyl or aryl)sulfonylureido group, an N-acylureido group, an N-acylsulfamoylamino group, a hydroxyamino group, a nitro group, a heterocyclic group containing a quaternary nitrogen atom (such as a pyridinio group, an imidazolio group, a quinolinio group or an isoquinolinio group), an isocyano group, an imino group, a mercapto group, an (alkyl, aryl or heterocyclic)thio group, an (alkyl, aryl or heterocyclic)dithio group, an (alkyl or aryl)sulfonyl group, an (alkyl or aryl)sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group and a silyl group. The active methane group refers to a methine group substituted by two electron attracting groups, and the electron attracting group refers to an acyl group, an alkoxycarbonyl group, an aryooxycarbonyl group, a carbamoyl group, an alkylsulfonyl group, an arylsulfonyl group, a sulfamoyl group, a trifluoromethyl group, a cyano group, a nitro group, or a carbonimidoyl group. The two electron attracting groups may be mutually bonded to form a ring structure. Also a salt means a salt formed by a cation such as of an alkali metal ion, an alkali earth metal ion or a heavy metal ion, or an organic cation such as an ammonium ion or a phosphonium ion.

Specific examples of the adsorbable group also include those described in JP-A No. 11-95355, pages 4 to 7.

In the formula (I), the adsorbable group represented by A is more preferably a mercapto-substituted heterocyclic group (such as a 2-mercaptothiadiazole group, a 3-mercapto-1,2,4-triazole group, a 5-mercaptotetrazole group, a 2-mercapto-1,3,4-oxadiazole group, a 2-mercaptobenzothiazole group, a 2-mercaptobenzimidazole group or a 1,5-dimethyl-1,2,4-triazolium-3-thiolate group), a dimercapto-substituted heterocyclic group (such as a 2,4-dimercaptopyrimidine group, a 2,4-dimercaptotriazine group, a 3,5-dimercapto-1,2,4-triazole group, or a 2,5-dimercapto-1,3-thiazole group), or a nitrogen-containing heterocyclic group comprising an —NH— group that can form imino silver (>NAg) as a partial structure of the hetero ring (such as a benzotriazole group, a benzimidazole group, or an indazole group). Among them, a dimercapto-substituted heterocyclic group is particularly preferable.

In the formula (I), W represents a divalent connecting group. The divalent connecting group is not restricted as long as it does not exert a detrimental effect on the photographic characteristics. For example it is possible to utilize a divalent connecting group constituted of a carbon atom, a hydrogen atom, an oxygen atom, a nitrogen atom, and/or a sulfur atom. More specifically, the divalent connecting group can be an alkylene group with 1 to 20 carbon atoms (for example a methylene group, an ethylene group, a trimethylene group, a tetramethylene group or a hexamethylene group), an alkenylene group with 2 to 20 carbon atoms, an alkynylene group with 2 to 20 carbon atoms, an arylene group with 6 to 20 carbon atoms (such as a phenylene group or a naphthylene group), —CO—, —$SO_2$—, —O—, —S—, —$NR_1$— or a combination of these groups, wherein $R_1$ represents a hydrogen atom, an aliphatic group or an aryl group. An aliphatic group represented by $R_1$ preferably can be a linear, branched or cyclic, alkyl, alkenyl, alkynyl or aralkyl group with 1 to 30 carbon atoms, particularly preferably with 1 to 20 carbon atoms (such as a methyl group, an ethyl group, an isopropyl group, a t-butyl group, an n-octyl group, an n-decyl group, an n-hexadecyl group, a cyclopropyl group, a cyclopentyl group, a cyclohexyl group, an allyl group, a 2-butenyl group, a 3-pentenyl group, a propargyl group, a 3-pentynyl group or a benzyl group). An aryl group represented by $R_1$ is preferably a single-ringed or condensed-ringed aryl group with 6 to 30 carbon atoms, more preferably 6 to 20 carbon atoms, such as a phenyl group or a naphthyl group. A connecting group represented by W may have an arbitrary substituent, and such arbitrary substituent may be an aforementioned example of the substituent on the adsorbable group.

In the formula (I), a reducing group represented by B represents a group capable of reducing a silver ion, and can be, for example, a formyl group, an amino group, a triple bond group such as an acetylene group or a propargyl group, a mercapto group, or a residue derived from a compound selected from a hydroxylamine, a hydroxame acid, a hydroxyurea, a hydroxyurethane, a hydroxysemicarbazide, a reductone (including a reductone derivative), an aniline, a phenol (may be a polyol such as a chroman-6-ol, a 2,3-dihydrobenzofuran-5-ol, an aminophenol, a sulfonamidophenol, a hydroquinone, a cathecol, a resorcinol, a benzenetriol, or a bisphenol), a hydrazine, a hydrazide and a phenidone.

In the formula (I), a preferable reducing group represented by B is a residue derived from a compound represented by following formulas $B_1$ to $B_{13}$.

($B_1$)

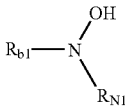

($B_2$)

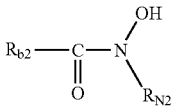

($B_3$)

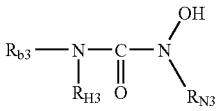

-continued ($B_4$)

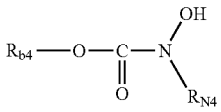

($B_5$)

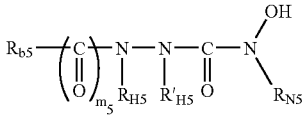

($B_6$)

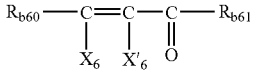

($B_7$)

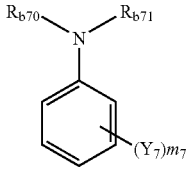

($B_8$)

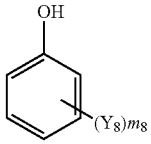

($B_9$)

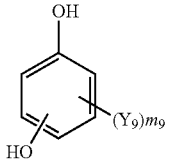

($B_{10}$)

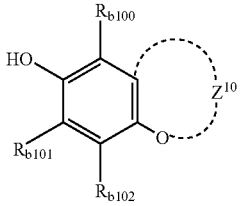

($B_{11}$)

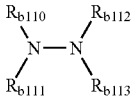

($B_{12}$)

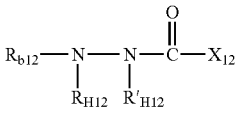

($B_{13}$)

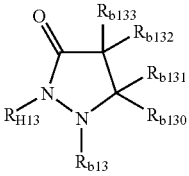

In the formulas ($B_1$) to ($B_{13}$), $R_{b1}$, $R_{b2}$, $R_{b3}$, $R_{b4}$, $R_{b5}$, $R_{b70}$, $R_{b71}$, $R_{b110}$, $R_{b111}$, $R_{b112}$, $R_{b113}$, $R_{b12}$, $R_{b13}$, $R_{N1}$, $R_{N2}$, $R_{N3}$, $R_{N4}$ and $R_{N5}$ each independently represent a hydrogen atom, an alkyl group, an aryl group or a heterocyclic group; $R_{H3}$, $R_{H5}$, $R'_{H5}$, $R_{H12}$, $R'H_{12}$ and $R_{H13}$ each independently represent a hydrogen atom, an alkyl group, an aryl group, an acyl group, an alkylsulfonyl group or an arylsulfonyl group, in which $R_{H3}$ may alternatively represent a hydroxy group; $R_{b100}$, $R_{b101}$, $R_{b102}$, $R_{b130}$ to $R_{b133}$ each independently represent a hydrogen atom or a substituent; $Y_7$ and $Y_8$ each independently represent a substituent other than a hydroxy group; $Y_9$ represents a substituent; $m_5$ represents 0 or 1; $m_7$ represents an integer from 0 to 5; $m_8$ represents an integer from 1 to 5; and $m_9$ represents an integer from 0 to 4. $Y_7$, $Y_8$ and $Y_9$ each may independently represent an aryl group condensed with a benzene ring (for example a ring condensed with benzene), and may further have a substituent. $Z_{10}$ represents a non-metal atomic group capable of forming a ring; and $X_{12}$ represents a hydrogen atom, an alkyl group, an aryl group, a heterocyclic group, an alkoxy group, an amino group (may be an alkylamino group, an arylamino group, a heterocyclic amino group or a cyclic amino group), or a carbamoyl group.

In the formula ($B_6$), $X_6$ and $X'_6$ each independently represent a hydroxy group, an alkoxy group, a mercapto group, an alkylthio group, an amino group (may be an alkylamino group, an arylamino group, a heterocyclic amino group or a cyclic amino group), an acylamino group, a sulfonamide group, an alkoxycarbonylamino group, an ureido group, an acyloxy group, an acylthio group, an alkylaminocarbonyloxy group, or an arylaminocarbonylxoy group. $R_{b60}$ and $R_{b61}$ each independently represent an alkyl group, an aryl group, an amino group, an alkoxy group or an aryloxy group, and $R_{b60}$ and $R_{b61}$ may be mutually bonded to form a cyclic structure.

In the description of the groups in the foregoing formulas ($B_1$) to ($B_{13}$), the alkyl group means a linear, branched or cyclic, substituted or non-substituted alkyl group with 1 to 30 carbon atoms; the aryl group means a single-ringed or condensed-ringed, substituted or non-substituted aromatic hydrocarbon ring such as a phenyl group or a naphthyl group; and the heterocyclic group means an aromatic or non-aromatic, single-ringed or condensed-ringed, substituted or non-substituted heterocyclic group containing at least a hetero arom.

In the description of the groups in the foregoing formulas ($B_1$) to ($B_{13}$), the substituents each has the same definition as the definition of the substituent on the adsorbable group. Such substituents may be further substituented by such substituents.

In the formulas ($B_1$) to ($B_5$), $R_{N1}$, $R_{N2}$, $R_{N3}$, $R_{N4}$ and $R_{N5}$ each preferably represents a hydrogen atom or an alkyl group, and such an alkyl group is preferably a linear, branched or cyclic, substituted or non-substituted alkyl group with 1 to 12 carbon atoms, more preferably a linear or branched, substituted or non-substituted alkyl group with 1 to 6 carbon atoms, such as a methyl group, an ethyl group, a propyl group or a benzyl group.

In the formula ($B_1$), $R_{b1}$ preferably represents an alkyl group or a heterocyclic group, and the alkyl group is preferably a linear, branched or cyclic, substituted or non-substituted alkyl group preferably with 1 to 30 carbon atoms, more preferably with 1 to 18 carbon atoms. The heterocyclic group is a 5- or 6-membered singled-ringed or condensed-ringed, aromatic or non-aromatic heterocyclic group, which may have a substituent. The heterocyclic group is preferably an aromatic heterocycloic group, such as a pyridine ring group, a pyrimidine ring group, a triazine ring group, a thiazole ring group, a benzothiazole ring group, an oxazole ring group, a benzoxazole ring group, an imidazole ring group, a benzoimidazole ring group, a pyrazole ring group, an indazole ring group, an indole ring group, a purine ring group, a quinoline ring group, an isoquinoline ring group, or a quinazoline ring group, and particularly preferably a triazine ring group, or a benzothiazole ring group. The compound represented by the formula ($B_1$) in which an alkyl group or a heterocyclic group represented by $R_{b1}$ additionally has at least one —N($R_{N1}$)OH group as substituent(s) is also preferable.

In the formula ($B_2$), $R_{b2}$ preferably represents an alkyl group, an aryl group or a heterocyclic group, and more preferably an alkyl group or an aryl group. A preferable range of the alkyl group is the same as in the case of $R_{b1}$. The aryl group is preferably a phenyl group or a naphthyl group, particularily preferably a phenyl group, which may have a substituent. The compound represented by the formula ($B_2$) in which a group represented by $R_{b2}$ additionally has at least one —CON($R_{N2}$)OH group as substituent(s) is also preferable.

In the formula ($B_3$), $R_{b3}$ preferably represents an alkyl group or an aryl group, and preferable ranges thereof are the same as in the case of $R_{b1}$ and $R_{b2}$. $R_{H3}$ is preferably a hydrogen atom, an alkyl group or a hydroxy group, more preferably a hydrogen atom. The compound represented by the formula ($B_3$) in which a group represented by $R_{b3}$ additionally has at least one —N($R_{H3}$)CON($R_{N3}$)OH group as substituent(s) is also preferable. Also $R_{b3}$ and $R_{N3}$ may be bonded to form a ring structure (preferably 5- or 6-membered saturated hetero ring).

In the formula ($B_4$), $R_{b4}$ is preferably an alkyl group, and a preferable range thereof is the same as in the case of $R_{b1}$. The compound represented by the formula ($B_4$) in which a group represented by $R_{b4}$ additionally has at least one —OCON ($R_{N4}$)OH group as substituent(s) is also preferable.

In the formula ($B_5$), $R_{b5}$ is preferably an alkyl group or an aryl group, more preferably, an aryl group. Preferable ranges thereof are the same as in the case of $R_{b1}$ and $R_{b2}$. $R_{H5}$ and $R'H_5$ each preferably represent a hydrogen atom or an alkyl group, more preferably, a hydrogen atom.

In the formula ($B_6$), $R_{b60}$ and $R_{b61}$ are preferably mutually bonded to form a ring structure. In such a case, the ring structure thus formed is a 5- to 7-membered non-aromatic carbon or hetero ring, which may be a single ring or condensed rings. Specific preferable examples of such ring structure include a 2-cyclopenten-1-one ring, a 2,5-dihydrofuran-2-one ring, a 3-pyrrolin-2-one ring, a 4-pyrazolin-3-one ring, a 2-cyclohexen-1-one ring, a 5,6-dihydro-2H-pyran-2-one ring, a 5,6-dihydro-2-pyrridone ring, a 1,2-dihydronaphthalen-2-one ring, a coumarin(benzo-α-pyran-2-one) ring, a 2-quinolone ring, a 1,4-dihydronaphthalen-1-one ring, a chromone ring (benzo-γ-pyran-4-one ring), a 4-quinolone ring, an inden-1-one ring, a 3-pyrroline-2,4-dione ring, an uracyl ring, a thiouracyl ring, and a dithiouracyl ring. Among them, a 2-cyclopenten-1-one ring, a 2,5-dihydrofuran-2-one ring, a 3-pyrrolin-2-one ring, a 4-pyrazolin-3-one ring, a 1,2-dihydronaphthalen-2-one ring, a coumarin(benzo-a-pyran-2-one) ring, a 2-quinolone ring, a 1,4-dihydronaphthalen-1-one ring, a chromone ring (benzo-y-pyran-4-one ring), a 4-quinolone ring, an inden-1-one ring, and a dithiouracyl ring are more preferable. A 2-cyclopenten-1-one ring, a 2,5-dihydrofuran-2-one ring, a 3-pyrrolin-2-one ring, an inden-1-one ring, and a 4-pyrrazolin-3-one ring are further preferable.

In case $X_6$ or $X'_6$ represents a cyclic amino group, the cyclic amino group is a nitrogen-containing non-aromatic heterocyclic group containing the nitrogen atom which is bonded to the main skelton, and may be, for example, a pyrrolidino group, a piperidino group, a piperazino group, a morpholino group, a 1,4-thiazin-4-yl group, a 2,3,5,6-tetrahydro-1,4-thiazin-4-yl group or an indolyl group.

Each of $X_6$ and $X'_6$ is preferably a hydroxy group, a mercapto group, an amino group (may be an alkylamino group, an arylamino group or a cyclic amino group), an acylamino group, a sulfonamino group, an acyloxy group or an acylthio group, more preferably a hydroxy group, a mercapto group, an amino group, an alkylamino group, a cyclic amino group, a sulfonamide group, an acylamino group or an acyloxy group, and particularly preferably a hydroxy group, an amino group, an alkylamino group or a cyclic amino group. It is further preferred that at least one of $X_6$ and $X'_6$ should be a hydroxy group.

In the formula ($B_7$), $R_{b70}$ and $R_{b71}$ each preferably represent a hydrogen atom, an alkyl group or an aryl group, and more preferably an alkyl group. A preferable range of the alkyl group is the same as in the case of $R_{b1}$. $R_{b70}$ and $R_{b71}$ may be mutually bonded to form a ring structure (such as a pyrrolidine ring, a piperidine ring, a morpholino ring, or a thiomorpholino ring). The substituent represented by $Y_7$ is preferably an alkyl group (with a preferable range same as that in the case of $R_{b1}$), an alkoxy group, an amino group, an acylamino group, a sulfonamide group, an ureido group, an acyl group, an alkoxycarbonyl group, a carbamoyl group, a sulfamoyl group, a chlorine atom, a sulfo group or a salt thereof, or a carboxy group or a salt thereof; and $m_7$ preferably represents an integer of 0 to 2.

In the formula ($B_8$), m is preferably an integer of 1 to 4, and when a plurality of $Y_8$ groups are present, they may be same as or different from each other. In both cases, at least one $Y_8$ is preferably an amino group (may be an alkylamino group or an arylamino group), a sulfonamide group, or an acylamino group. When $m_8$ is 2 or larger, the other $Y_8$'s are each preferably a sulfonamide group, an acylamino group, an ureido group, an alkyl group, an alkylthio group, an acyl group, an alkoxycarbonyl group, a carbamoyl group, a sulfo group or a salt thereof, a carboxy group or a salt thereof, or a chlorine atom. When the benzene ring is substituted, at an ortho-position or a para-position relative to hydroxy group, by an o'- (or p'—)hydroxyphenylmethyl group (which may further have a substituent) as the substituent represented by $Y_8$, the formula ($B_8$) represents a compound which is generally called "bisphenols", which is also a preferred example of the compound represented by the formula ($B_8$). It is also preferable that $Y_8$ should represent a ring condensed with the benzene whereby the formula ($B_8$) represents a naphthol.

In the formula ($B_9$), the relationship of the two hydroxy groups may be ortho-positions (cathecols), meta-positions (resorcinols), or para-positions (hydroquinones). $m_9$ is preferably 1 or 2, and when a plurality of $Y_9$'s are present, they may be same as or different from each other. The substituent represented by $Y_9$ is preferably a chlorine atom, an acylamino group, an ureido group, a sulfonamide group, an alkyl group, an alkylthio group, an alkoxy group, an acyl group, an alkoxycarbonyl group, a carbamoyl group, a sulfo group or a salt thereof, a carboxy group or a salt thereof, a hydroxy group, an alkylsulfonyl group, or an arylsulfonyl group. It is preferable that $Y_9$ should represent a benzen ring condensed with the benzene ring and the formula ($B_9$) should represent a 1,4-naphthohydroquinone. When the formula ($B_9$) represents a cathecol, $Y_9$ is particularly preferably a sulfo group or a salt thereof, or a hydroxy group.

In the formula ($B_{10}$), when any of $B_{b100}$, $B_{b101}$ and $B_{b102}$ represents a substituent, preferred examples of such a substitutent are the same as in the case of $Y_9$. Among them, an alkyl group (particularly a methyl group) is preferable. A ring structure including $Z_{10}$ is preferably a chromane ring or a 2,3-dihydrobenzofuran ring, and the ring structure may have a substituent or may be a spiro ring.

In the formula ($B_{11}$), $B_{b110}$, $B_{b111}$, $B_{b112}$ and $B_{b113}$ each independently represent preferably an alkyl group, an aryl group or a heterocyclic group, having the same preferable ranges as in the case of $R_{b1}$ and $R_{b2}$. Among them, an alkyl group is preferable, and two alkyl groups selected from $R_{b110}$ to $R_{b113}$ may be bonded to form a ring structure. The ring structure is a 5- or 6-membered non-aromatic hetero ring, such as a pyrrolidine ring, a piperidine ring, a morpholino ring, a thiomorpholino ring, or a hexahydropyridazine ring.

In the formula ($B_{12}$), $R_{b12}$ is preferably an alkyl group, an aryl group or a heterocyclic group, with preferable ranges which are the same as in the case of $R_{b1}$ and $R_{b2}$. $X_{12}$ is preferably an alkyl group, an aryl group (particularly a phenyl group), a heterocyclic group, an alkoxy group, an amino group (may be an alkylamino group, an arylamino group, a heterocyclic amino group and a cyclic amino group), or a carbamoyl group, and more preferably an alkyl group (particularly preferably an alkyl group with 1 to 8 carbon atoms), an aryl group (particularly preferably a phenyl group), or an amino group (may be an alkyl amino group, an arylamino group, and a cyclic amino group). $R_{H12}$ and $R'_{H12}$ each preferably represent a hydrogen atom or an alkyl group, more preferably a hydrogen atom.

In the formula ($B_{13}$), $R_{b13}$ preferably represents an alkyl group or an aryl group, with preferable ranges which are the same as in the case of $R_{b1}$ and $R_{b2}$, $B_{b130}$, $B_{b131}$, $B_{b132}$ and $B_{b133}$ each independently represent a hydrogen atom, an alkyl group (particularly with 1 to 8 carbon atoms), or an aryl group (particularly preferably a phenyl group). $R_{H13}$ is preferably a hydrogen atom or an acyl group, more preferably a hydrogen atom.

In the formula (I), the reducing group represented by B is preferably a hydroxylamine, a hydroxam acid, a hydroxyurea, a hydroxysemicarbazide, a phenol, a hydrazine, a hydrazide, or a phenidone, and particularly preferably a hydroxyurea, a hydroxysemicarbazide, a phenol, a hydrazide, or a phenidone.

A redox potential of the reducing group represented by B in the formula (I) can be measured by a method described in Akira Fujishima, *Denki Kagaku Sokutei-ho* (Electrochemistry Measurements) (Giho-do): pp. 150-208, or *Jikken Kagaku Kouza* (Experimental Chemistry Textbook) 4th edition, vol 9, edited by Chemical Society of Japan (Maruzen): pp. 282-344. For example it can be measured by a rotary disk voltammetry method, more specifically by dissolving a sample in a solution of methanol : pH6.5 Britton-Robinson buffer=10:90 (vol. %), then passing nitrogen gas for 10 minutes, and measure a potential under conditions of a sweeping rate of 20 mV/sec at 25° C. and 1000 rpm, utilizing a glassy carbon rotary disk (RDE) as an operating electrode, a platinum wire as a counter electrode and a saturated calomel electrode as a reference electrode. A half wave potential (E½) can be determined from an obtained voltammogram.

An oxidation potential of the reducing group represented by B in the invention measured in the above-mentioned measurement is preferably within a range of about −0.3 to about 1.0 V. The oxidation potential is more preferably within a range of about −0.1 to about 0.8 V, particularly preferably from about 0 to about 0.7 V.

The reducing groups represented by B in the invention are mostly already known in photographic industry, and examples of such groups are also described for example in JP-A Nos. 2001-42466, 8-114884, 8-314051, 8-333325, 9-133983, 11-282117, 10-246931, 10-90819, 9-54384, 10-171060, and 7-77783. Also, examples of the phenols include those described in U.S. Pat. No. 6,054,260.

The compound of the formula (I) of the invention may also include a ballast group or a polymer chain which is commonly utilized in an immobile photographic additive such as a coupler. Also such a polymer can be the polymer described for example in JP-A No. 1-100530.

The compound of the formula (I) of the invention may be a bis-form or a tris-form. The compound of the formula (I) of the invention preferably has a molecular weight within a range of 100 to 10000, more preferably 120 to 1000 and particularly preferably 150 to 500.

In the following, examples of the compound of the formula (I) of the invention are shown, but the present invention is not limited to such examples. Also, the compounds described in JP-A Nos. 2000-330247 and 2001-42446 are preferable.

(1)

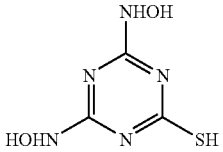

(2)

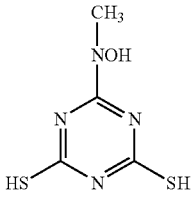

(3)

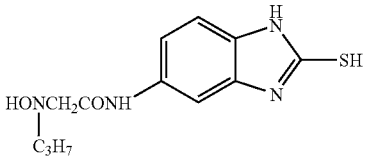

(4)

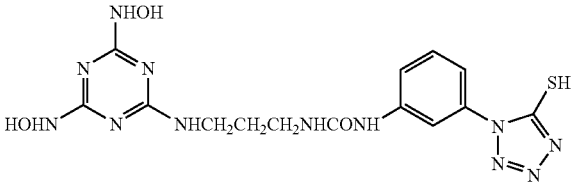

(5)

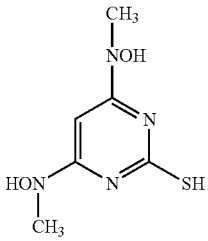

(6)

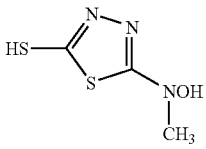

-continued (7)

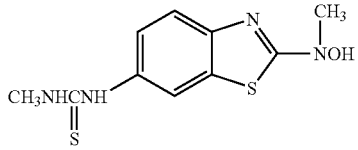

(8)

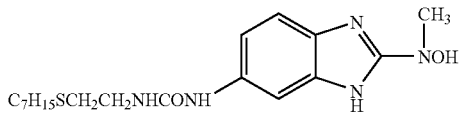

(9)

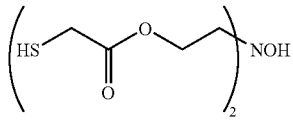

(10)

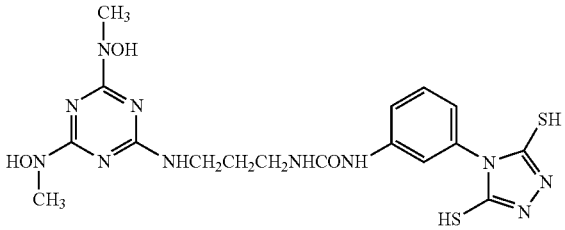

(11)

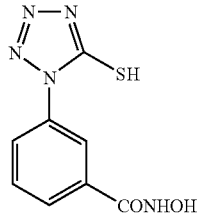

(12)

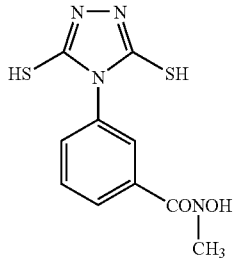

(13)

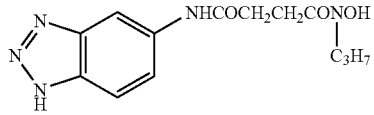

(14)

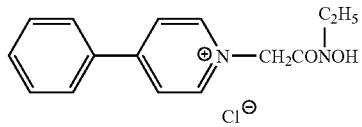

(15)

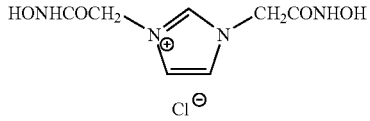

-continued
(16)
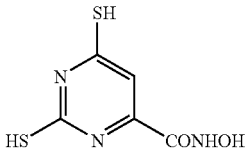
(17)
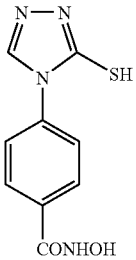
(18)
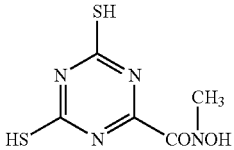
(19)
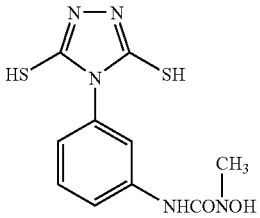
(20)
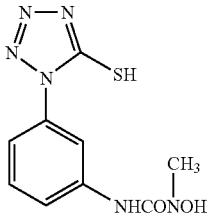
(21)
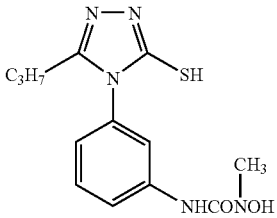
(22)
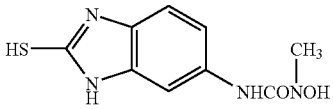
-continued
(23)
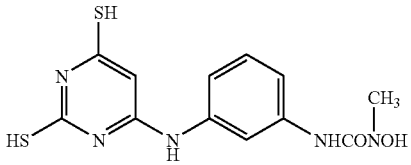
(24)
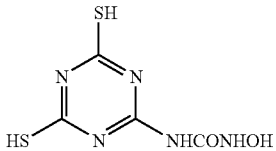
(25)
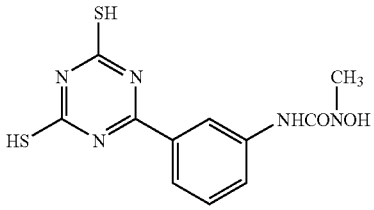
(26)
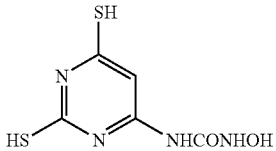
(27)
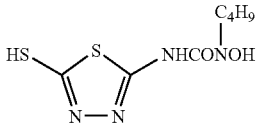
(28)
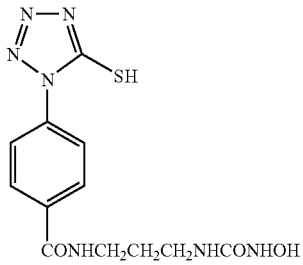
(29)
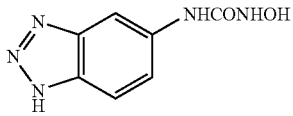
(30)
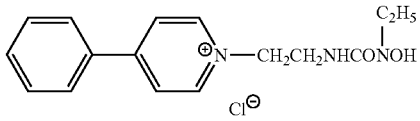

-continued
(31)
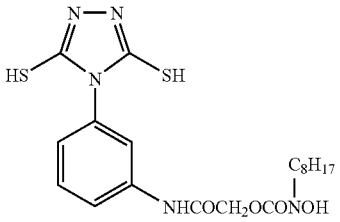
(32)
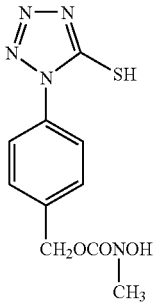
(33)
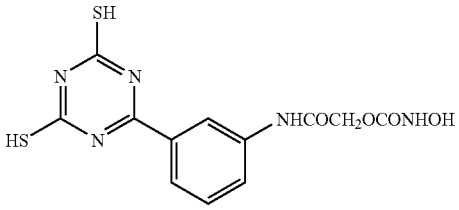
(34)
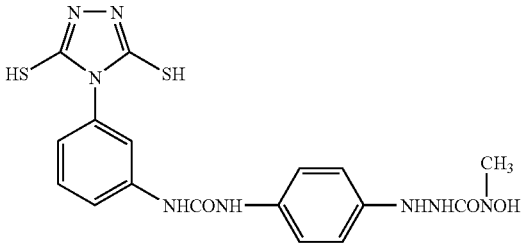
(35)
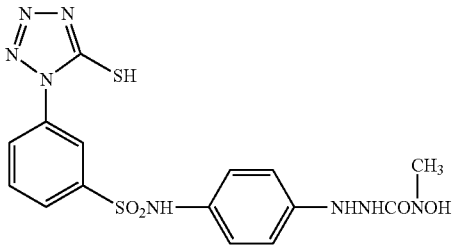
(36)
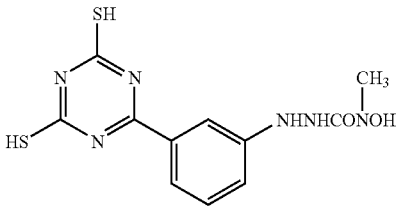
-continued
(37)
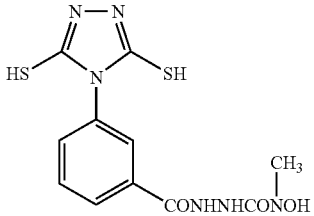
(38)
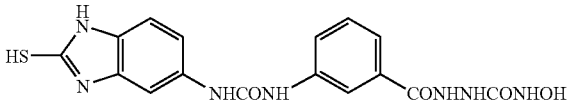
(39)
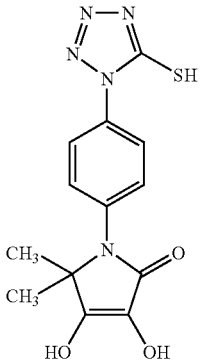
(40)
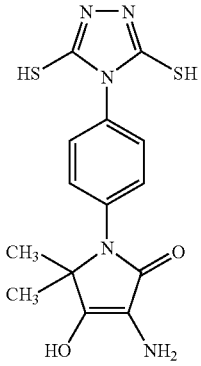
(41)
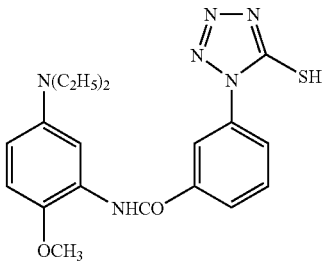

-continued
(42)
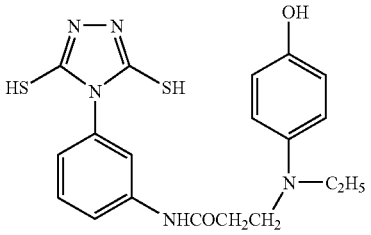
(43)
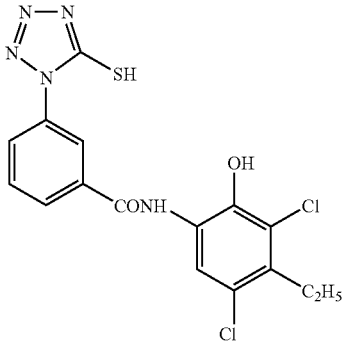
(44)
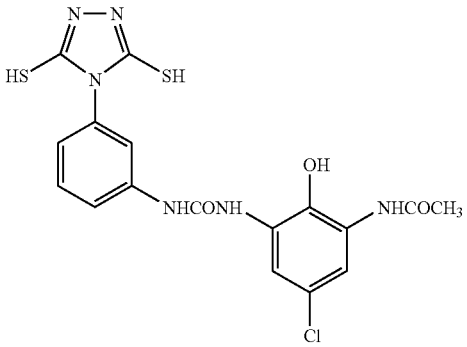
(45)
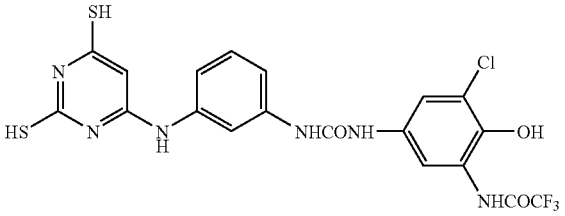
(46)
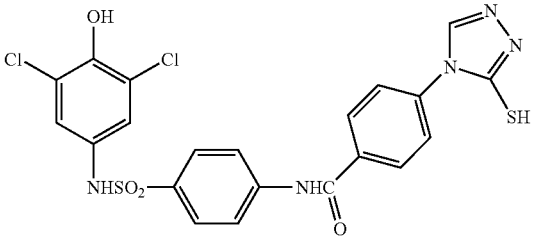
-continued
(47)
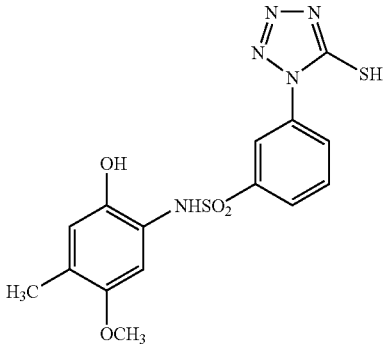
(48)
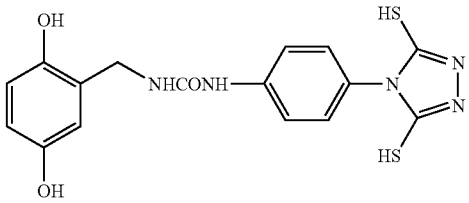
(49)
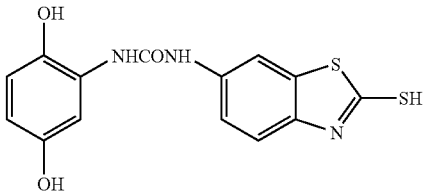
(50)
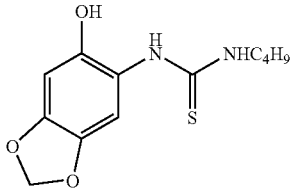
(51)
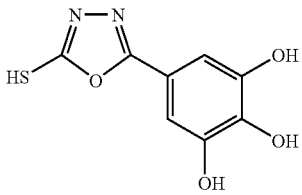
(52)
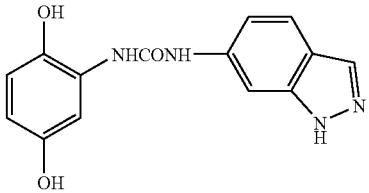

-continued
(53)
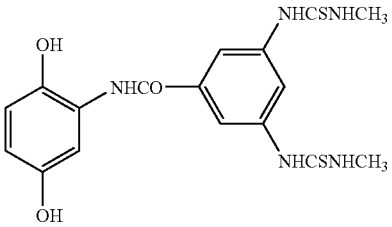
(54)
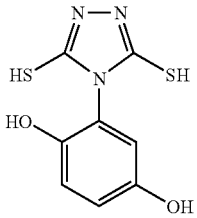
(55)
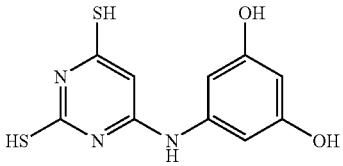
(56)
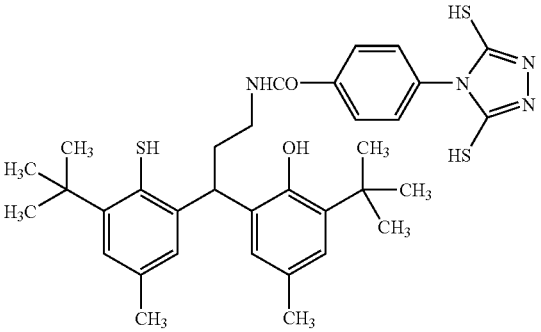
(57)
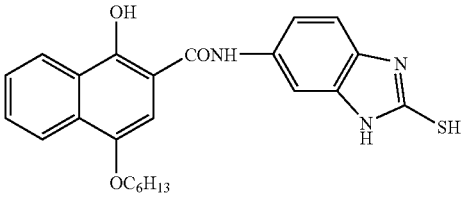
(58)
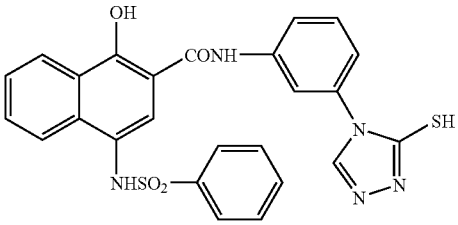
-continued
(59)
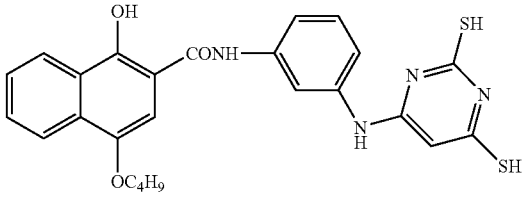
(60)
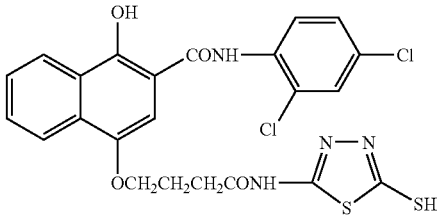
(61)
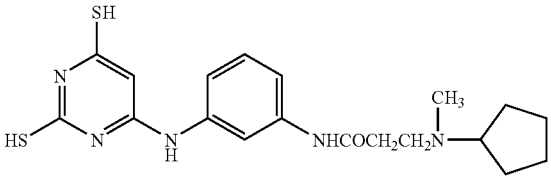
(62)
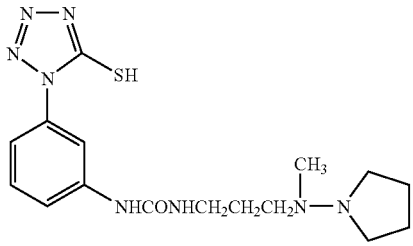
(63)
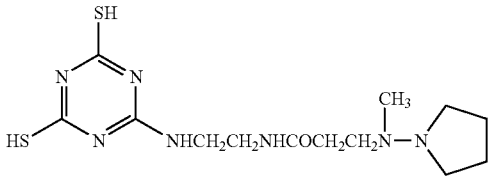
(64)
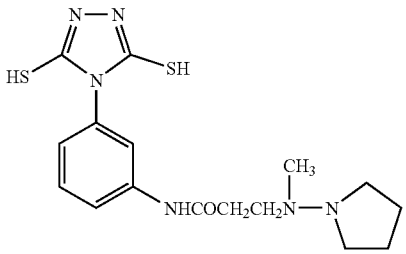

-continued
(65)
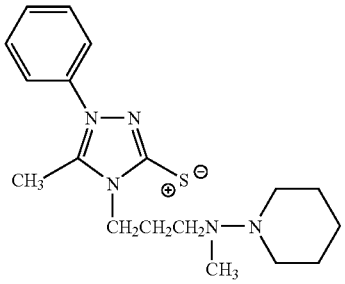
(66)
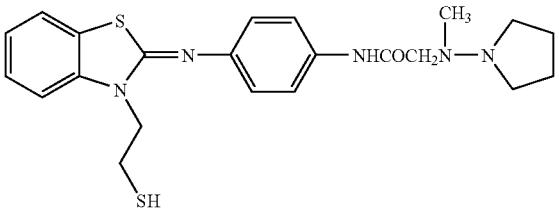
(67)
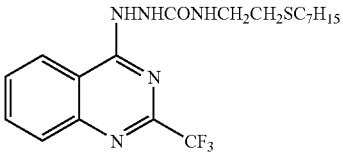
(68)
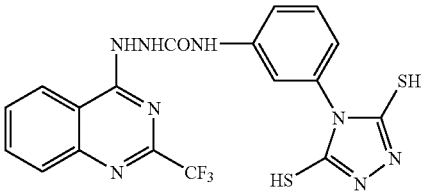
(69)
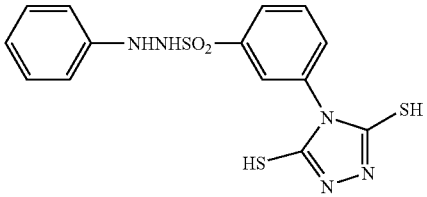
(70)
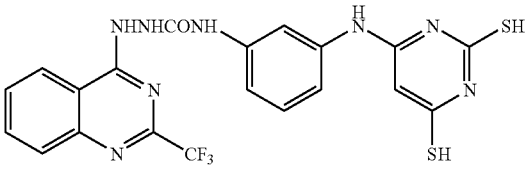
(71)
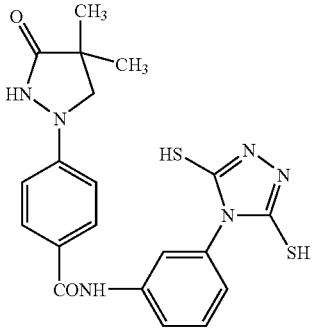
-continued
(72)
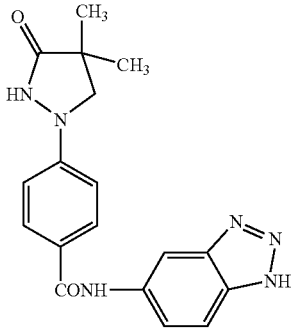
(73)
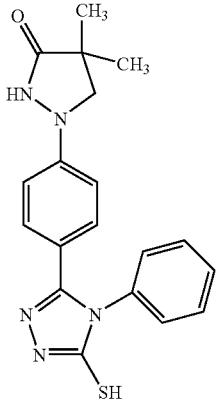
(74)
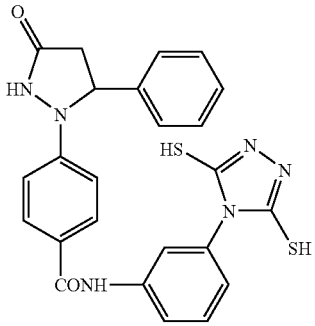
(75)
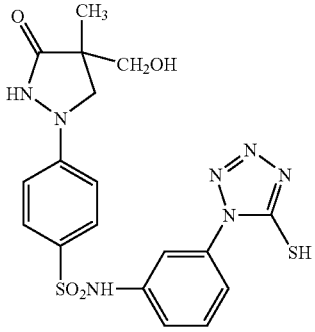

-continued
(76)
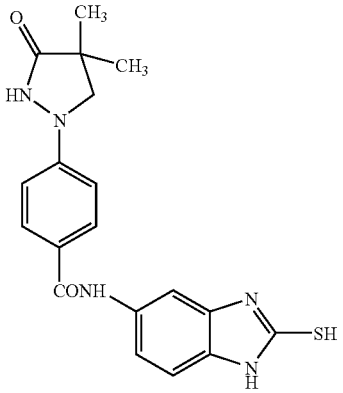
(77)
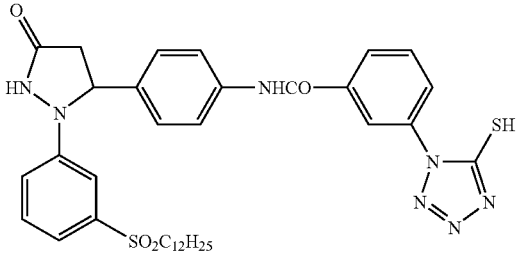
(78)
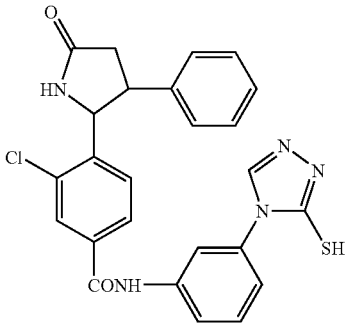
(79)
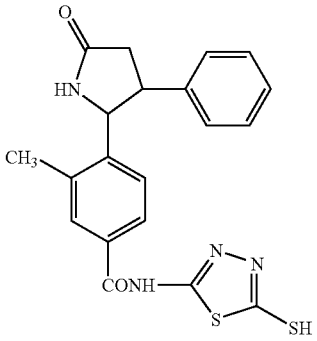
(80)
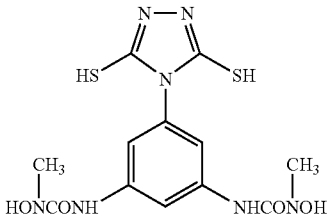
-continued
(81)
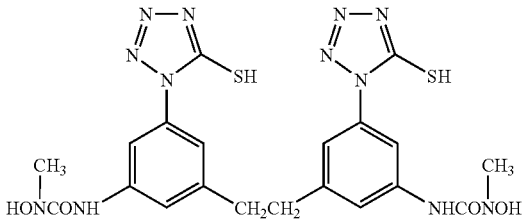
(82)
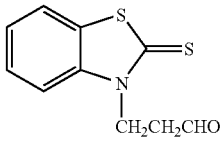
(83)
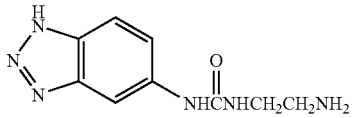
(84)
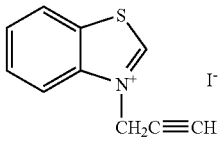
(85)
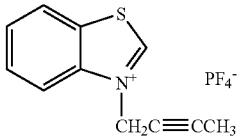
(86)
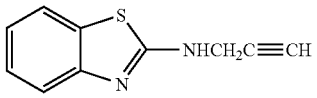
(87)
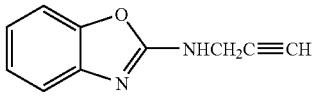
(88)
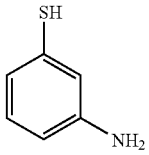
(89)
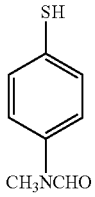
(90)
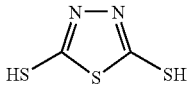

-continued (91)

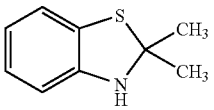

(92)

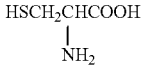

(93)

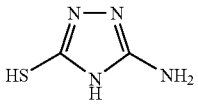

(94)

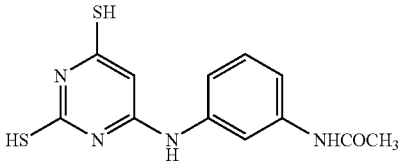

(95)

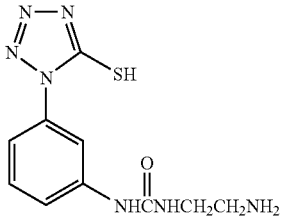

(96)

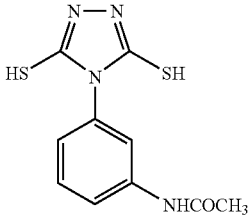

The compound of the invention can be easily synthesized by a known method.

A single kind of the compound of the formula (I) may be used, or two or more kinds of the compounds of the formula (I) may be preferably used. When two or more kinds of the compounds are used, they may be added in a same layer or in different layers. And the compounds may be added to layer(s) in different manners.

The compound of the formula (I) of the invention may be included preferably in a silver halide emulsion layer, and more preferably added during the preparation of the silver halide emulsion. When the compound is added during the preparation of the silver halide emulsion, the compound may be added in any stage in the preparation of the photosensitive silver halide emulsion, for example in a step of forming silver halide grains, before the start of a desalting step, in a desalting step, before the start of a chemical ripening, a step of a chemical ripening, or a step before preparation of a completed emulsion. The compound may also be added plural times in such processes. The compound is preferably added to the silver halide emulsion layer, however it may be added, in addition to the silver halide emulsion layer, to a protective layer or an intermediate layer adjacent to the emulsion layer, then allowed to diffuse during the coating.

A preferred amount of addition depends significantly on a manner of addition explained above and a kind of the compound to be added, however is generally within a range of $1\times10^{-6}$ to 1 mole per 1 mole of photosensitive silver halide, preferably $1\times10^{-5}$ to $5\times10^{-1}$ moles, and more preferably $1\times10^{-4}$ to $1\times10^{-1}$ moles.

The compound of the formula (I) of the invention may be added after dissolved in water or a water-soluble solvent such as methanol or ethanol, or a mixed solvent thereof. In such case, a pH value may be suitably adjusted with an acid or a base, and a surfactant may be present in the solution. The compound may also be added in a form of an emulsified dispersion which is prepared by dissolving the compound in a high-boiling organic solvent. The compound may also be added in a form of a solid dispersion.

11) Combined Use of Plural Silver Halides

According to the invention, a single kind of a silver halide emulsion may be used in the photosensitive material, or a plurality kinds of silver halide emulsions (each having different properties with respect to such as an average grain size, a halogen composition, and/or a crystal habit, and/or each subjected to chemical sensitization under a different condition) may be used in the photosensitive material. A gradation may be regulated by using a plurality kinds of photosensitive silver halides having different sensitivities. Technologies relating to such use of a plurality kinds of silver halide emulsions are described, for example, in JP-A Nos. 57-119341, 53-106125, 47-3929, 48-55730, 46-5187, 50-73627 and 57-150841. Each emulsion may have a sensitivity which is different from the sensitivities of the other emulsions preferably by at least 0.2 log E.

12) Coating Amount

An addition amount of the photosensitive silver halide, in terms of a coated silver amount per 1 $m^2$ of the photosensitive material, is preferably 0.03 to 0.6 $g/m^2$, more preferably 0.05 to 0.4 $g/m^2$, and most preferably 0.07 to 0.3 $g/m^2$. The amount of the photosensitive silver halide is preferably within a range of 0.01 to 0.5 moles per 1 mole of organic silver salt, more preferably 0.02 to 0.3 moles per 1 mole of organic silver salt, and further preferably 0.03 to 0.2 moles per 1 mole of organic silver salt.

13) Mixing of Photosensitive Silver Halide and Organic Silver Salt

As to methods and conditions of mixing the photosensitive silver halide and the organic silver salt, which have been prepared separately, a method of mixing the photosensitive silver halide and the organic silver salt, prepared respectively, by a high-speed agitator, a ball mill, a sand mill, a colloid mill, a vibration mill or a homogenizer, or a method of adding the already prepared photosensitive silver halide to the organic silver salt in the course of preparation of the organic silver salt, can be cited. However, no particular limitation exists as long as the effect of the invention can be sufficiently exhibited. It is also preferred, for regulating the photographic characteristics, to mix two or more aqueous dispersions of organic silver salts and two or more aqueous dispersions of photosensitive silver salts.

14) Addition of Silver Halide to Coating Solution

The silver halide of the invention is added to a coating solution for an image forming layer, in a period from 180 minutes before coating to immediately before coating, preferably from 60 minutes to 10 seconds before coating, however a mixing method and a mixing condition are not particularly restricted as long as the effect of the invention can be sufficiently exhibited. Specific examples of the mixing method include a mixing method in a tank, an average stay time calculated from a flow rate of addition and a liquid supply rate to a coater being adjusted to a target time in the method, and a method of using a static mixer described for example in N. Harnby, M. F. Edwards and A. W. Nienow, *Liquid mixing technology*, translated by Koji Takahashi and published by Nikkan Kogyo Shimbun, (1989), Chapter 8.

Explanation of a Binder

The binder for the organic silver salt-containing layer of the invention may be any polymer, is preferably a binder which is transparent or semi-transparent and generally colorless, and can be a natural resin, a natural polymer, a natural copolymer, a synthetic resin, a synthetic polymer, a synthetic copolymer, or another film-forming material, such as a gelatin, a rubber, a poly(vinyl alcohol), a hydroxyethyl cellulose, a cellulose acetate, a cellulose acetate butyrate, a poly(vinylpyrrolidone), casein, starch, a poly(acrylic acid), a poly (methylmethacrylic acid), a poly(vinyl chloride), a poly (methacrylic acid), a styrene-maleic anhydride copolymer, a styrene-acrylonitrile copolymer, a styrene-butadiene copolymer, a poly(vinylacetal) (such as poly(vinylformal) or poly (vinylbutyral)), a poly(ester), a poly(urethane), a phenoxy resin, a poly(vinylidene chloride), a poly(epoxide), a poly (carbonate), a poly(vinyl acetate), a poly(olefin), a cellulose ester or a poly(amide). The binder may be coated in a form of an aqueous solution, a solution in an organic solvent, or an emulsion.

In the invention, the binder in a layer containing an organic silver salt may have a glass transition temperature (Tg) preferably of 0 to 80° C. (hereinafter may be referred to as a high Tg binder), more preferably 10 to 70° C., and further preferably 15 to 60° C.

In the present specification, the glass transition temperature (Tg) is calculated from a following equation:

$$1/Tg=\Sigma(Xi/Tgi)$$

provided that the polymer is a copolymer of n monomer components (i=1 to n), wherein Xi represents a weight fraction of an i-th monomer ($\Sigma Xi=1$), and Tgi represents a glass transition temperature (absolute temperature) of a homopolymer of the i-th monomer. $\Sigma$ indicates a summation from i=1 to n. The glass transition temperature (Tgi) of a homopolymer of each monomer was obtained from J. Brandrup and E. H. Immergut, *Polymer Handbook* (3rd edition) (Wiley-Interscience, 1989).

A plurality kinds of binders may be used simultaneously if necessary. It is also possible to use a combination of a binder having a glass transition temperature equal to or higher than 20° C. and a binder having a glass transition temperature less than 20° C. When polymers with different Tgs are used simultaneously, it is preferred that a weight-averaged Tg should be within the above-mentioned range.

In the invention, an organic silver salt-containing layer is formed into a film by preferably coating and drying a coating solution in which 30 mass % or more of a solvent is water.

In the invention, the organic silver salt-containing layer is preferably formed by coating and drying a coating solution in which 30 mass % or more of the solvent is water from the viewpoint of improving performance. According to the invention, from the same viewpoint, it is more preferable that a binder of the organic silver salt-containing layer should be soluble or dispersible in an aqueous solvent (water solvent), and it is further preferable that the binder should be formed by a latex of a polymer having an equilibrated water content of 2 mass % or less in an environment of 25° C. and 60% RH. In a most preferable embodiment, the binder is so prepared that an ion conductivity becomes 2.5 mS/cm or less by, for example, a purification with a separating membrane after synthesis of the polymer.

The aforementioned aqueous solvent in which the polymer is soluble or dispersible is water or a mixture obtained by mixing water and 70 mass % or less of a water-miscible organic solvent. Examples of the water-miscible organic solvent include an alcohol such as methyl alcohol, ethyl alcohol or propyl alcohol, a cellosolve such as methyl cellosolve, ethyl cellosolve or butyl cellosolve, ethyl acetate and dimethylformamide.

The term "aqueous solvent" used herein refers also to a system in which the polymer is not thermodynamically dissolved but is present in a so-called dispersion state.

The "equilibrated water content in an environment of 25° C. and 60% RH" can be represented, with a polymer weight W1 in a moisture equilibrium state in an environment of 25° C. and 60% RH and a polymer weight W0 in an absolute dry state at 25° C., as follows:

equilibrated water content in an environment of 25° C., 60% RH=$[(W1-W0)/W0]\times100$ (mass %)

Regarding the definition of the water content and method for measuring the water content, for example, *Kobunshi Kogaku Koza* 14, *Kobunshi Zairyo Shikenho* (edited by Society of Polymer Science, publiched by Chijinshokan) can be referenced.

The binder polymer of the invention preferably has an equilibrated water content in an environment of 25° C., 60% RH of 2 mass % or less, more preferably 0.01 to 1.5 mass %, and further preferably 0.02 to 1 mass %.

In the invention, a polymer dispersible in an aqueous solvent is particularly preferable. Such dispersion state can be a latex in which fine particles of a water-insoluble hydrophobic polymer is dispersed or a dispersion in which polymer molecules are dispersed in a molecular state or in a micelle state. Particles dispersed in a form of a latex are more preferable. The dispersed particles have an average particle size of 1 to 50,000 nm, preferably 5 to 1,000 nm, more preferably 10 to 500 nm and further preferably 50 to 200 nm. A particle size distribution of the dispersed particles is not particularly limited, and can be a wide particle size distribution or a monodispersed particle size distribution. For controlling physical properties of the coating solution, it is also preferable to use a mixture of two or more dispersions, each having a monodispersed particle size distribution.

According to the invention, the polymer dispersible in an aqueous solvent may preferably be a hydrophobic polymer such as an acrylic polymer, a poly(ester), a rubber (such as SBR resin), a poly(urethane), a poly(vinyl chloride), a poly (vinyl acetate), a poly(vinylidene chloride) or a poly(olefin). Such polymer can be a linear, branched or crosslinked polymer, or can be a so-called homopolymer formed by polymerizing monomers of a single kind or a copolymer formed by polymerizing monomers of a plurality of kinds. The copolymer can be a random copolymer or a block copolymer. Such a polymer has a number-averaged molecular weight preferably of 5,000 to 1,000,000, more preferably 10,000 to 200,000. An excessively small molecular weight results in an insufficient mechanical strength of the emulsion layer, while an excessively large molecular weight provides an undesirably inferior film forming property. Also a crosslinkable polymer latex is particularly preferably used.

Specific Examples of Latex

Specific examples of the preferable polymer latex include the polymer latices listed in the following. Following examples are represented by monomers used as the raw material, with a parenthesized number indicating mass % and a molecular weight represented by a number-averaged molecular weight. In an example employing a polyfunctional monomer, since the concept of molecular weight is not applicable because of a crosslinked structure, "crosslinking" is described in place of the molecular weight. Tg indicates a glass transition temperature:

P-1: latex of —MMA(70)-EA(27)-MAA(3)-(molecular weight 37000, Tg 61° C.)

P-2: latex of -MMA(70)-2EHA(20)-St(5)-AA(5)-(molecular weight 40000, Tg 59° C.)

P-3: latex of -St(50)-Bu(47)-MAA(3)-(crosslinking, Tg −17° C.)

P-4: latex of -St(68)-Bu(29)-AA(3)-(crosslinking, Tg 17° C.)

P-5: latex of -St(71)-Bu(26)-AA(3)-(crosslinking, Tg 24° C.)

P-6: latex of -St(70)-Bu(27)-IA(3)-(crosslinking)

P-7: latex of -St(75)-Bu(24)-AA(1)-(crosslinking, Tg 29° C.)

P-8: latex of -St(60)-Bu(35)-DVB(3)-MAA(2)-(crosslinking)

P-9: latex of -St(70)-Bu(25)-DVB(2)-AA(3)-(crosslinking)

P-10: latex of -VC(50)-MMA(20)-EA(20)-AN(5)-AA(5)-(molecular weight 80,000)

P-11: latex of -VDC(85)-MMA(5)-EA(5)-MAA(5)-(molecular weight 67,000)

P-12: latex of -Et(90)-MMA(10)-(molecular weight 12,000)

P-13: latex of -St(70)-2EHA(27)-AA(3)-(molecular weight 130,000, Tg 43° C.)

P-14: latex of -MMA(63)-EA(35)-AA(2)-(molecular weight 33,000, Tg 47° C.)

P-15: latex of -St(70.5)-Bu(26.5)-AA(3)-(crosslinking, Tg 23° C.)

P-16: latex of -St(69.5)-Bu(27.5)-AA(3)-(crosslinking, Tg 20.5° C.)

In the foregoing, the abbreviations represent the following monomers: MMA: methyl methacrylate, EA: ethyl acrylate, MMA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

The polymer latex mentioned in the foregoing are also commercially available, and the following ones can be utilized. Examples of acrylic polymer include Cebien A-4635, 4718, 4601 (manufactured by Daicel Chemical Industries, Ltd.), Nipol Lx 811, 814, 821, 820, 857 (manufactured by Zeon Corp.) etc.; examples of poly(ester) include FINETEX ES 650, 611, 675, 850 (manufactured by Dainippon Ink and Chemicals Inc.), WD-size, WMS (manufactured by Eastman Chemical Co.) etc.; examples of poly(urethane) include HYDRAN AP 10, 20, 30, 40 (manufactured by Dainippon Ink and Chemicals Inc.) etc.; examples of rubber include LACSTAR 7310K, 3307B, 4700H, 7132C (manufactured by Dainippon Ink and Chemicals Inc.), Nipol Lx 416, 410, 438C, 2507 (manufactured by Zeon Corp.) etc.; examples of poly (vinyl chloride) include G351, G576 (manufactured by Zeon Corp.) etc.; examples of poly(vinylidene chloride) include L502, L513 (manufactured by Asahi Chemical Industries Ltd.) etc.; and examples of poly(olefin) include CHEMIPAR S120, SA100 (manufactured by Mitsui Chemical Co.) etc.

A single kind of the polymer latex may be used or a combination of two or more kinds of the polymer latices may be used, according to necessity.

Preferable Latex

The polymer latex used in the invention is particularly preferably a latex of a styrene-butadiene copolymer. In the styrene-butadiene copolymer, a weight ratio of a styrene monomer unit to a butadiene monomer unit is preferably 40:60 to 95:5. Also the total proportion of the styrene monomer unit and the butadiene monomer unit in the copolymer is preferably within a range of 60 to 99 mass %. Also the polymer latex of the invention preferably includes acrylic acid or methacrylic acid in an amount of 1 to 6 mass % with respect to the sum of the amount of styrene and the amount of butadiene, more preferably 2 to 5 mass %. The polymer latex of the invention preferably includes acrylic acid.

Preferred examples of the styrene-butadiene copolymer latex usable in the invention include P-3 to P-8, and P-15 mentioned in the foregoing and LACSTAR 3307B, 7132C and Nipol Lx 416 which are commercially available.

The organic silver salt-containing layer of the photosensitive material of the invention may include, if necessary, a hydrophilic polymer such as gelatin, polyvinyl alcohol, methyl cellulose, hydroxypropyl cellulose, or carboxymethyl cellulose. A total amount of such hydrophilic polymer(s) is preferably 30 mass % or less with respect to a total amount of binder(s) in the organic silver salt-containing layer, more preferably 20 mass % or less.

The organic silver salt-containing layer (namely image forming layer) of the invention preferably comprises a polymer latex. A weight ratio of (total amount of binder)/(total amount of organic silver salt) is preferably within a range from 1/10 to 10/1, more preferably 1/3 to 5/1, and further preferably 1/1 to 3/1.

Such organic silver salt-containing layer is usually also a photosensitive layer (emulsion layer) including a photosensitive silver halide, which is a photosensitive silver salt, and in such a case, a weight ratio of (total amount of binder)/(total amount of silver halide) is preferably within a range of 400 to 5, more preferably 200 to 10.

In the image forming layer of the invention, a total amount of binder is preferably 0.2 to 30 g/m$^2$, more preferably 1 to 15 g/m$^2$, and further preferably 2 to 10 g/m$^2$. The image forming layer of the invention may comprise a crosslinking agent for crosslinking, or a surfactant for improving coating property.

Preferable Solvent for Coating Solution

In a coating solution for the organic silver salt-containing layer of the photosensitive material of the invention, a solvent (indicating solvent and dispersion medium collectively, for the purpose of simplicity) is preferably an aqueous solvent containing 30 mass % or higher of water. A component other than water can be any water-miscible organic solvent, such as methyl alcohol, ethyl alcohol, isopropyl alcohol, methyl cellosolve, ethyl cellosolve, dimethylformamide or ethyl acetate. The water content of the solvent is preferably 50 mass % or higher, and more preferably 70 mass % or higher. Examples of the preferred solvent composition (number in mass %) include water, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5.

Explanation of Antifogging Agent

An antifogging agent, a stabilizer and a stabilizer precursor usable in the invention can be the compounds described in JP-A No. 10-62899, paragraph 0070, EP-A No. 0803764A1, page 20, line 57 to page 21, line 7, JP-A Nos. 9-281637 and 9-329864, U.S. Pat. No. 6,083,681, and European Patent No. 1048975. An antifogging agent preferably used in the invention is an organic halogen compound, which can be any of the compounds described in JP-A No. 11-65021, paragraphs 0111-0112. The organic halogen compound represented by the formula (P) in JP-A No. 2000-284399, the organic halogen compound represented by the formula (II) in JP-A No. 10-339934, and the organic polyhalogen compound described in JP-A Nos. 2001-31644 and 2001-33911 are particularly preferable.

Explanation of Polyhalogen Compound

In the following, an organic polyhalogen compound preferred in the invention will be explained in detail. A polyhalogen compound preferred in the invention is represented by the following formula (H).

$$Q—(Y)_n—C(Z_1)(Z_2)X \qquad \text{Formula (H)}$$

In the formula (H), Q represents an alkyl group, an aryl group or a heterocyclic group; Y represents a divalent connecting group; n represents 0 or 1; $Z_1$ and $Z_2$ each independently represent a halogen atom; and X represents a hydrogen atom or an electron attracting group.

In the formula (H), Q is preferably an aryl group or a heterocyclic group.

When Q is a heterocyclic group in the formula (H), a nitrogen-containing heterocyclic group including 1 or 2 nitrogen atoms is preferable, and a 2-pyridyl group or a 2-quinolyl group are particularly preferable.

When Q is an aryl group in the formula (H), Q preferably represents a phenyl group substituted by an electron attracting group of which Hammett's substituent constant σp is a positive value. As to the Hammett's substituent constant, reference may be made for example to *Joumal of Medicinal Chemistry* vol 16, No. 11 (1973): 1207-1216. Such an electron attracting group can be, for example, a halogen atom (such as fluorine atom (σp: 0.06), a chlorine atom (σp: 0.23), a bromine atom (σp: 0.23) or an iodine atom (σp: 0.18)), a trihalomethyl group (such as tribromomethyl (σp: 0.29), trichloromethyl (σp: 0.33) or trifluoromethyl (σp: 0.54)), a cyano group (σp: 0.66), a nitro group (σp: 0.78), an aliphatic, aryl or heterocyclic sulfonyl group (such as methanesulfonyl (σp: 0.72)), an aliphatic, aryl or heterocyclic acyl group (such as acetyl (σp: 0.50) or benzoyl (σp: 0.43)), an alkynyl group (such as C═CH (σp: 0.23)), an aliphatic, aryl or heterocyclic oxycarbonyl group (such as methoxycarbonyl (σp: 0.45) or phenoxycarbonyl (σp: 0.44)), a carbamoyl group (σp: 0.36), a sulfamoyl group (σp: 0.57), a sulfoxide group, a heterocyclic group or a phosphoryl group. The up value is preferably within a range of 0.2 to 2.0, more preferably 0.4 to 1.0. The electron attracting group is particularly preferably a carbamoyl group, an alkoxycarbonyl group, an alkylsulfonyl group, or an alkylphosphoryl group, and most preferably a carbamoyl group.

X is preferably an electron attracting group, more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group, and particularly preferably a halogen atom. The halogen atom is preferably a chlorine atom, a bromine atom or an iodine atom, further preferably a chlorine atom or a bromine atom and particularly preferably a bromine atom.

Y preferably represents —C(═O)—, —SO— or —$SO_2$—, more preferably —C(═O)— or —$SO_2$—, and particularly preferably —$SO_2$—, and n represents 0 or 1, preferably 1.

In the following, specific examples of the compound of the formula (H) are shown.

(H-1)

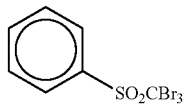

(H-2)

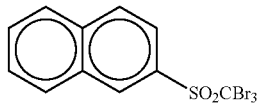

(H-3)

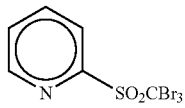

(H-4)

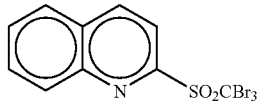

(H-5)

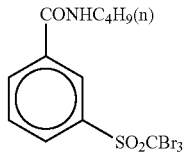

(H-6)

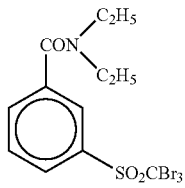

(H-7)

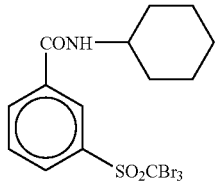

(H-8)

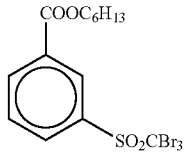

(H-9)

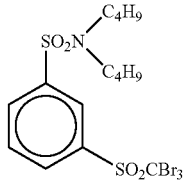

-continued (H-10)

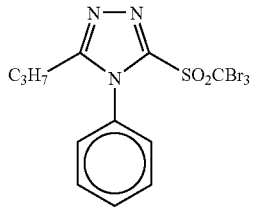

(H-11)

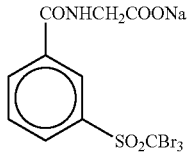

(H-12)

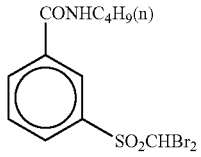

(H-13)

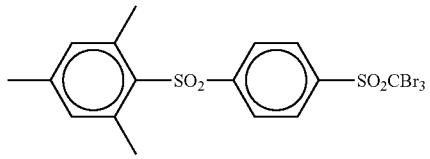

(H-14)

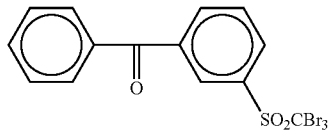

(H-15)

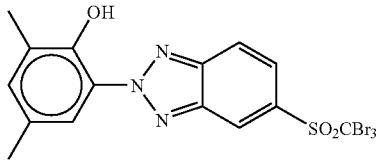

A polyhalogen compound preferred in the invention, other than those described above, can be a compound described in JP-A Nos. 2001-31644, 2001-56526 or 2001-209145.

The compound of the formula (H) of the invention is preferably used within a range of $10^{-4}$ to 1 mole per 1 mole of the non-photosensitive silver salt in the image forming layer, more preferably $10^{-3}$ to 0.5 moles, and further preferably $1\times10^{-2}$ to 0.2 moles.

In the invention, the anti-fogging agent can be added to the photosensitive material by the aforementioned method for adding the reducing agent, and it is preferable to add the organic polyhalogen compound in a state of a solid particle dispersion.

Other Anti-fogging Agents

Other than the above anti-fogging agents, a mercury (II) salt described in JP-A No. 11-65021, paragraph 0113, a benzoic acid described in paragraph 0114 JP-A No. 11-65021, a salicylic acid derivative described in JP-A No. 2000-206642, a formalin scavenger compound represented by a formula (S) in JP-A No. 2000-221634, a triazine compound described in claim 9 of JP-A No. 11-352624, a compound represented by a formula (III) in JP-A No. 6-11791, 4-hydroxy-6-methyl-1,3,3a,7-tetrazaindene, and the like can also be used as antifogging agents.

The photothermographic material of the invention may include an azolium salt for the purpose of fog prevention. The azolium salt can be the compound represented by the formula (XI) in JP-A No. 59-193447, a compound described in JP-B No. 55-12581, or the compound represented by the formula (II) in JP-A No. 60-153039. The azolium salt may be added to any part of the photosensitive material, and the azolium salt is preferably added to a layer on a side having the photosensitive layer, and more preferably added to the organic silver salt-containing layer. The azolium salt may be added in any step of preparation of the coating solution, and, when the azolium salt is added to the organic silver salt containing layer, the azolium salt can be added in any step from the preparation of the organic silver salt to the preparation of the coating solution, but preferably within a period from a time after the preparation of the organic silver salt to a time immediately before the coating. The azolium salt may be added in any form, such as powder, a solution or a dispersion of fine particles. Also, the azolium salt may be added in a form of a solution which also includes another additive such as a sensitizing dye, a reducing agent or a toning agent. In the invention, the azolium salt may be added in any amount. The amount is preferably from $1\times10^{-6}$ to 2 moles per 1 mole of silver, and more preferably, from $1\times10^{-3}$ to 0.5 moles.

Other Additives

1) Mercapto, Disulfide and Thion

In the invention, for the purposes of controlling development by suppression or acceleration, improving an efficiency of spectral sensitization, improving storability before and after the development etc., the photothermographic material may includes a mercapto compound, a disulfide compound and/or a thion compound such as the compounds described in JP-A No. 10-62899, paragraphs 0067-0069, the compounds represented by the formula (I) in JP-A No. 10-186572 and specific example described in paragraphs 0033-0052 of JP-A No. 10-186572, and the compounds described in EP-A No. 0803764A1, page 20, lines 36-56. Among them, particularly preferred is a mercapto-substituted heteroaromatic compound described for example in JP-A Nos. 9-297367, 9-304875, 2001-100358, 2002-303954, and 2002-303951.

2) Toning Agent

The photothermographic material of the invention preferably includes a toning agent. The toning agent is described in JP-A No. 10-62899, paragraphs 0054-0055, EP-A No. 0803764A1, p. 21, lines 23 to 48, JP-A Nos. 2000-356317 and 2000-187298. The toning agent is preferably a phthalazinone (phthalazinone, a phthalazinone derivative or a metal salt thereof, such as 4-(1-naphthyl)phthalazinone, 6-chlorophthalazinone, 5,7-dimethoxyphthazinone or 2,3-dihydro-1,4-phthalazindione); a combination of a phthalazinone and a phthalic acid (such as phthalic acid, 4-methylphthalic acid, 4-nitrophthalic acid, diammonium phthalate, sodium phthalate, potassium phthalate or tetrachlorophthalic anhydride); a phthalazine (phthalazine, a phthalazine derivative or a metal salt thereof, such as 4-(1-naphtyl)phthalazine, 6-isopropylphthalazine, 6-t-butylphthalazine, 6-chlorophthalazine, 5,7-dimethoxyphthalazine or 2,3-dihydrophthalazine); or a combination of a phthalazine and a phthalic acid, and more preferably, a combination of a phthalazine and a phthalic acid. A combination of 6-isopropylphthazine and phthalic acid or a combination of 6-isopropylphthazine and 4-methylphthalic acid are particularly preferable.

3) Plasticizer, Lubricant

A plasticizer and a lubricant usable in the photosensitive layer of the invention are described in JP-A No. 11-65021, paragraph 0117. An ultra-high contrast agent for forming an ultra-high contrast image, a method and an amount of addition thereof are described in a paragraph 0118 of JP-A No. 11-65021, JP-A No. 11-223898, paragraphs 0136-0193, JP-A No. 2000-284399, formulas (H), (1) -(3), (A) and (B), and Japanese Patent Application No. 11-91652, formulas (III) to (V) (specific compounds: 21 to 24). Also a high-contrast promoting agent is described in JP-A No. 11-65021, paragraph 0102 and JP-A No. 11-223898, paragraphs 0194-0195.

4) Dye, Pigment

In the photosensitive layer of the invention, for the purposes of tone improvement, prevention of interference fringes at the laser exposure and prevention of irradiation, there may be employed various dyes and pigments (for example C. I. Pigment Blue 60, C. I. Pigment Blue 64, or C. I. Pigment Blue 15:6). Such dyes and pigments are described in detail for example in WO98/36322, and JP-A Nos. 10-268465 and 11-338098.

5) Ultra-high Contrast Agent

For forming an ultra-high contrast image suitable for printing platemaking, it is preferable to add an ultra-high contrast agent to the image forming layer. The ultra-high contrast agent, a method of addition thereof and an amount of addition thereof are described for example in JP-A No. 11-65021, paragraph 0118, JP-A No. 11-223898, paragraphs 0136-0193, Japanese Patent Application No. 11-87297, formulas (H), (1) to (3), (A) and (B), Japanese Patent Application No. 11-91652, formulas (III) to (V) (specific compounds in formulas 21-24), while a high-contrast promoting agent is described in JP-A No. 11-65021, paragraph 0102 and JP-A No. 11-223898, paragraphs 0194-0195.

When formic acid or a formate salt is used as a strong fogging substance, the formic acid or the formate salt is preferably added in a side having the image forming layer which contains photosensitive silver halide, in an amount of 5 mmol. or less per 1 mole of silver, more preferably 1 mmol. or less.

When an ultra-high contrast agent is included in the photothermographic material of the invention, it is preferable to further use an acid formed by hydration of phosphorous pentoxide or a salt thereof simultaneously. Examples of the acid formed by hydration of phosphorous pentoxide or a salt thereof include metaphosphoric acid (and salt thereof), pyrophosphoric acid (and salt thereof), orthophosphoric acid (and salt thereof), triphosphoric acid (and salt thereof), tetraphosphoric acid (and salt thereof), and hexametaphosphoric acid (and salt thereof). The acid formed by hydration of phosphorous pentoxide or a salt thereof is particularly preferably orthophosphoric acid (or salt thereof), or hexametaphosphoric acid (or salt thereof). Specific examples of the salt include sodium orthophosphate, sodium dihydrogen orthophosphate, sodium hexametaphosphate and ammonium hexametaphosphate.

The amount (coating amount per 1 $m^2$ of the photosensitive material) of the acid formed by hydration of phosphorous pentoxide or the salt thereof may be suitably selected according to a target performances including sensitivity or fog level, and is preferably 0.1 to 500 $mg/m^2$ and more preferably 0.5 to 100 $mg/m^2$.

The reducing agent, the hydrogen bonding compound, the development accelerator and the polyhalogen compound of the invention are preferably used in a form of a solid dispersion, and a preferable method for producing such a solid dispersion is described in JP-A No. 2002-55405.

Preparation and Application of Coating Solution

A coating solution for the image forming layer of the invention is prepared preferably at a temperature of from 30° C. to 65° C., more preferably at a temperature which is equal to or higher than 35° C. and less than 60° C., further preferably a temperature of from 35° C. to 55° C. Also the coating solution for the image forming layer is preferably maintained, immediately after the addition of polymer latex, at a temperature from 30° C. to 65° C.

Layer Configuration and Components

At least one image forming layer of the invention is provided on a support. When only a single image forming layer is present, the image forming layer comprises an organic silver salt, a photosensitive silver halide, a reducing agent and a binder, and optionally comprises additional material(s) such as a toning agent, an auxiliary coating agent, and/or another auxiliary material. When the photothermographic material comprises two or more image forming layers, a first image forming layer (usually adjacent to the support), a second image forming layer, and the other image forming layers each comprise at least an photosensitive silver salt and a binder, at least one of the image forming layers comprises an organic silver salt and a reducing agent, and a toning agent, a coating auxiliary, or another auxiliary may be included in at least one of the image forming layers in accordance with necessity. In a configuration of a multi-color photothermographic material, a combination of these two layers may be included for each color, or, as described in U.S. Pat. No. 4,708,928, all the components may be included within a single layer. In the case of a multi-dye, multi-color photothermographic material, emulsion layers are generally maintained in a separate state, as described in U.S. Pat. No. 4,460,681, by employing a functional or non-functional barrier layer between the photosensitive layers.

The photothermographic material of the invention may comprise a non-photosensitive layer in addition to the image forming layer. The non-photosensitive layer can be classified, based on a position thereof, into (a) a surface protective layer provided on the image forming layer (namely farther from the support), (b) an intermediate layer provided between plural image forming layers or between an image forming layer and a protective layer, (c) an undercoat layer formed between an image forming layer and the support, and (d) a back layer formed at the side opposite to the image forming layer.

The photothermographic material may also includes a layer functioning as an optical filter, which is formed as a layer (a) or (b). Also an antihalation layer is provided as a layer (c) or (d) in the photosensitive material.

1) Surface Protective Layer

The photothermographic material of the invention may have a surface protective layer, for example for preventing sticking of the image forming layer. The photothermographic material may include a single surface protective layer or a plurality of surface protective layers.

The surface protective layer is described in JP-A No. 11-65021, paragraphs 0119-0120, and JP-A No. 2000-171936.

As a binder for the surface protective layer of the invention, gelatin is preferred, but it is also preferable to use polyvinyl alcohol (PVA) singly or in combination with gelatin. The gelatin may be an inert gelatin (for example Nitta gelatin 750) or a phthalated gelatin (for example Nitta gelatin 801). The PVA may be one described in JP-A No. 2000-171936, paragraphs 0009-0020, and preferably be a completely saponified product such as PVA-105, a partially saponified product such as PV-205, PVA-335, or a denatured polyvinyl alcohol such as MP-203 (foregoing being trade names of Kuraray Co.). A coating amount of polyvinyl alcohol (per 1 $m^2$ of support) in the protective layer (per one layer) is preferably 0.3 to 4.0 $g/m^2$, more preferably 0.3 to 2.0 $g/m^2$.

A total coating amount (per 1 $m^2$ of support) of the binder(s) (including water soluble polymer(s) and latex polymer(s)) in the surface protective layer (per one layer) is preferably 0.3 to 5.0 $g/m^2$, more preferably 0.3 to 2.0 $g/m^2$.

2) Antihalation Layer

In the photothermographic material of the invention, an antihalation layer may be provided at the side which is farther than the photosensitive layer from the exposure light source.

The antihalation layer is described in JP-A No. 11-65021, paragraphs 0123-0124, JP-A Nos. 11-223898, 9-230531, 10-36695, 10-104779, 11-231457, 11-352625 and 11-352626.

The antihalation layer includes an antihalation dye having an absorption at the exposure wavelength. When the exposure wavelength is in an infrared region, an infrared-absorbing dye may be used, and, in such a case, a dye which has no absorption in the visible region is preferable.

When halation is prevented with a dye having an absorption in the visible region, it is preferable that the color of the dye does not substantially remain after the image formation. It is preferable that the dye should be decolored by the heat at the thermal development, and particularly preferable that the non-photosensitive layer should include a thermally decolorable dye and a base precursor thereby achieving a function as an antihalation layer. Such technology is described, for example, in JP-A No. 11-231457.

The amount of addition of the decolorable dye is determined according to the purpose of the dye. In general, the dye is used in such an amount that the optical density (absorbance) measured at an object wavelength is higher than 0.1. The optical density is preferably within a range of from 0.15 to 2, more preferably 0.2 to 1. The amount of the dye used for obtaining such optical density is generally within a range of about 0.001 to 1 $g/m^2$.

By removing the color of the dye, it is possible to reduce the optical density after thermal development to 0.1 or less. It is also possible to use two or more decolorable dyes in combination, in a thermally decolorable recording material or in a photothermographic material. Similarly, it is possible to use two or more base precursors in combination.

In such thermal decoloration utilizing a thermally decolorable dye and a base precursor, it is preferable, for the thermal color-removing property, to use further a substance (such as diphenylsulfon, 4-chlorophenyl(phenyl)sulfon or 2-naphthyl benzoate) that can lower its melting point by 3° C. or more when mixed with the base precursor, as described in JP-A No. 11-352626.

3) Back Layer

A back layer usable in the invention is described in JP-A No. 11-65021, paragraphs 0128-0130.

In the invention, a coloring agent having an absorption maximum at 300 to 450 nm may be contained in the photothermographic material in order to improve a tone of silver image and a time-dependent change of the image. Such a coloring agent is described for example in JP-A Nos. 62-210458, 63-104046, 63-103235, 63-208846, 63-306436, 63-314535, 01-61745 and 2001-100363.

Such coloring agent is contained usually within a range of 0.1 $mg/m^2$ to 1 $g/m^2$, and preferably contained in a back layer which is formed on a side of a support, the side being opposite to the photosensitive layer.

Further, for adjusting a base color, it is preferable to use a dye having an absorption peak at 580 to 680 nm. Such a dye is preferably a dye with a low absorption intensity at a short wavelength side, such as an oil-soluble azomethine dye described in JP-A Nos. 4-359967 and 4-359968, or a water-soluble phthalocyanine dye described in JP-A No. 2003-295388. Such a dye may be included in any layer, but is preferably included in a non-photosensitive layer on the emulsion side, or in the back surface side.

The photothermographic material of the invention is preferably a so-called single-side photosensitive material, having at least a photosensitive layer containing a silver halide emulsion on a side of a support, and a back layer on the other side.

4) Matting Agent

In the invention, the photothermographic material may preferably comprise a matting agent in order to improving a transporting property. The matting agent is described in JP-A No. 11-65021, paragraphs 0126-0127. An amount of the matting agent, in terms of a coating amount per 1 $m^2$ of the photosensitive material, is preferably 1 to 400 $mg/m^2$, more preferably 5 to 300 $mg/m^2$.

In the invention, the matting agent may have a fixed shape or an amorphous shape, however it preferably has a fixed shape. The matting agent preferably has a spherical shape. An average particle size is preferably 0.5 to 10 μm, more preferably 1.0 to 8.0 μm and further preferably 2.0 to 6.0 μm. Also a variation factor of the size distribution is preferably 50% or less, more preferably 40% or less and further preferably 30% or less. The variation factor is a value represented by (standard deviation of particle size)/(average of particle size) x 100. It is also preferable to use, in combination, two matting agents having low fluctuation factors and having a ratio of the average particle sizes larger than 3.

A matting degree of an emulsion surface may be arbitrarily selected so long as a so-called stardust failure does not occur, but is preferably within a range of Beck's smoothness of 30 to 2000 seconds, particularly preferably 40 to 1500 seconds. The Beck's smoothness can be easily determined according to JIS P8119 "Smoothness testing method with Beck's tester for paper and board", and TAPPI standard method T479.

In the invention, a matting degree of the back layer is preferably within a range of Beck's smoothness of 10 to 1,200 seconds, more preferably 20 to 800 seconds and further preferably 40 to 500 seconds.

In the invention, the matting agent is preferably included in an outermost surface layer of the photosensitive material, a layer functioning as an outermost surface layer, and/or a layer close to the external surface. The matting agent is preferably included in a layer functioning as a protective layer.

5) Polymer Latex

A polymer latex is preferably included in a surface protective layer or in a back layer, when the photothermographic material of the invention is applied to a printing application, in which a dimensional change is a major concern. Such polymer latex is described for example in *Gosei Jushi Emulsion* (edited by Taira Okuda and Hiroshi Inagaki, published by Kobunshi Kankokai (1978)), *Gosei Latex no Ouyou*, (edited by Takaaki Sugimura, Yasuo Kataoka, Soichi Suzuki and Keiji Kasahara, published by Kobunshi Kankokai (1993)), and *Gosei Latex no Kagaku* (Soichi Muroi, published by Kobunshi Kankokai (1970)), The polymer latex can more specifically be a latex of a methyl methacrylate (33.5 mass %)/ethyl acrylate (50 mass %)/methacrylic acid (16.5 mass %) copolymer, a latex of a methyl methacrylate (47.5 mass %)/butadiene (47.5 mass %)/itaconic acid (5 mass %) copolymer, a latex of an ethyl acrylate/methacrylic acid copolymer, a latex of a methyl methacrylate (58.9 mass %)/2-ethylhexyl acrylate (25.4 mass %)/styrene (8.6 mass %)/2-hydroxyethyl methacrylate (5.1 mass %)/acrylic acid (2.0 mass %) copolymer, a latex of a methyl methacrylate (64.0 mass %)/styrene (9.0 mass %)/butyl acrylate (20.0 mass %)/2-hydroxyethyl methacrylate (5.0 mass %)/acrylic acid (2.0 mass %) copolymer etc. Also, regarding a binder in the surface protective layer, there may be applied a combination of polymer latices described in Japanese Patent Application No. 11-6872, a technology described in JP-A No. 2000-267226, paragraphs 0021-0025, a technology described in Japanese Patent Application No. 11-6872, paragraphs 0027-0028, or a technology described in JP-A No. 2000-19678, paragraphs 0023-0041. A proportion of the polymer latex in the surface protective layer is preferably from 10 to 90 mass % based on all the binder, particularly preferably 20 to 80 mass %.

6) Film Surface pH

The photothermographic material of the invention preferably has a film surface pH of 7.0 or less before the thermal development, more preferably 6.6 or less. A lower limit of the film surface pH is not particularly restricted but is generally about 3. A most preferred pH range is from 4 to 6.2. The film surface pH is regulated preferably with an organic acid such as a phthalic acid derivative, a non-volatile acid such as sulfuric acid, and/or a volatile base such as ammonia, in view of lowering the film surface pH. In particular, ammonia is preferable for attaining a low film surface pH, since ammonia easily evaporates and can be removed in the coating step and/or before the thermal development.

It is also preferable to use a non-volatile base such as sodium hydroxide, potassium hydroxide or lithium hydroxide in combination with ammonia. A method for measuring the film surface pH is described in JP-A No. 2000-284399, paragraph 0123.

7) Hardening Agent

A hardening agent may be included in the photosensitive layer, the protective layer, or the back layer of the invention. Examples of the hardening agent are described in T. H. James, *The Theory of the Photographic Process Fourth Edition* (Macmillan Publishing Co. Inc., 1977) pp. 77-87. The hardening agent can preferably be chromium alum, sodium 2,4-dichloro-6-hydroxy-s-triazine, N,N-ethylenebis(vinylsulfonacetamide), N,N-propylenebis(vinylsulfonacetamide), the polyvalent metal ion described in p. 78 of the aforementioned reference, the polyisocyanate described in U.S. Pat. No. 4,281,060, JP-A No. 6-208193 etc., the epoxy compound described in U.S. Pat. No. 4,791,042 etc. or the vinylsulfone compound described in JP-A No. 62-89048 etc.

The hardening agent is added in a form of a solution, and a timing of addition of such solution to the coating solution for the protective layer is within a period from 180 minutes before the coating operation to a time immediately before the coating operation, preferably within a period from 60 minutes before the coating operation to 10 seconds before the coating operation, but a mixing method and a mixing condition are not particularly restricted as long as the effect of the invention can be sufficiently exhibited. Specific examples of the mixing method include a mixing method in a tank in which an average stay time calculated from a flow rate of addition and a liquid supply rate to a coater is set at a target time, and a method of utilizing a static mixer, as described in N. Harnby, M. F. Edwards, A. W. Nienow, *Liquid Mixing Technologies* (translated by Koji Takahashi, Nikkan Kogyo Shimbunsha, 1989), chapter 8.

8) Surfactant

A surfactant usable in the invention is described in JP-A No. 11-65021, paragraph 0132. Also this references describes a solvent in a paragraph 0133, a support in a paragraph 0134, an antistatic agent or a conductive layer in a paragraph 0135, a method for obtaining a color image in a paragraph 0136. Also a lubricant is described in JP-A No. 11-84573, paragraphs 0061-0064 and Japanese Patent Application No. 11-106881, paragraphs 0049-0062.

In the invention, it is preferable to use a fluorine-type surfactant. Preferred specific examples of the fluorine-type surfactant include those described in JP-A Nos. 10-197985, 2000-19680 and 2000-214554. A fluorine-type polymer surfactant described in JP-A No. 9-281636 is also preferable. In the photothermographic material of the invention, it is particularly preferable to use a fluorine-type surfactant described in JP-A No. 2002-82411, and Japanese Patent Applications Nos. 2001-242357 and 2001-264110. In particular, the fluorine-type surfactant described in JP-A Nos. 2002-208782 and 2003-149766 is preferable from the viewpoint of charge regulating ability, stability of a coated surface and lubricating ability when an aqueous coating solution is used, and a fluorine-type surfactant described in JP-A No. 2003-149766 is most preferable because the fluorine-type surfactant has a high charge adjusting ability, thus can reduce its amount in the photothermographic material.

In the invention, the fluorine-type surfactant can be used in the emulsion surface and/or the back surface, and is preferably employed in both the surfaces. It is particularly preferable to employ the fluorine-type surfactant in combination with the aforementioned conductive layer including a metal oxide. In such a case, a sufficient performance can be obtained even if the fluorine-type surfactant on a surface having the conductive layer is reduced in amount or is eliminated.

The amount of the fluorine-type surfactant, in each of the emulsion surface and the back surface, is preferably within a range of 0.1 to 100 mg/m$^2$, more preferably 0.3 to 30 mg/m$^2$, and further preferably 1 to 10 mg/m$^2$. In particular, a fluorine-type surfactant described in JP-A No. 2003-149766 has a strong effect and is used preferably in an amount of from 0.01 to 10 mg/m$^2$, more preferably from 0.1 to 5mg/m$^2$.

9) Antistatic Agent

In the invention, a conductive layer including a metal oxide and/or a conductive polyer is preferably provided. The antistatic layer may function also as the undercoat layer, the back layer or the surface protective layer, or may be formed separately. The conductive material in the antistatic layer is preferably a metal oxide of which conductivity is improved by introducing an oxygen defect or a hetero-metal atom in a metal oxide. Preferable examples of the metal oxide include ZnO, $TiO_2$ and $SnO_2$. and there is preferred an addition of Al or In to ZnO, an addition of Sb, Nb, P or a halogen element to $SnO_2$, or an addition of Nb, Ta etc. to $TiO_2$. $SnO_2$ to which Sb has been added is particularly preferable. An amount of addition of a different element is preferably within a range of 0.01 to 30 mol %, more preferably 0.1 to 10 mol %. A shape of the metal oxide can be spherical, acicular or plate-shaped, however, in consideration of an effect of providing conductivity, there is preferred an acicular particle with a longer axis/shorter axis ratio of 2.0 or higher, preferably 3.0 to 50. An amount of the metal oxide is preferably within a range of 1 to 1000 mg/m$^2$, more preferably 10 to 500 mg/m$^2$, and further preferably 20 to 200 mg/m$^2$. The antistatic layer of the invention may be provided on the emulsion side and/or the back side, but is preferably provided between the support and the back layer. Specific examples of the antistatic layer of the invention are described in JP-A No. 11-65021, paragraph 0135, JP-A Nos. 56-143430, 56-143431, 58-62646 and 56-120519, JP-A No. 11-84573, paragraphs 0040-0051, U.S. Pat. No. 5,575,957 and JP-A No. 11-223898, paragraphs 0078-0084.

10) Support

A transparent support is preferably a polyester, particularly preferably, polyethylene terephthalate each of which has been subjected to a heat treatment at a temperature of from 130 to 185° C. This heat treatment is conducted in order to relax an internal strain in the film generated at a biaxial drawing and to prevent a thermal shrinking strain at the thermal development. In a photothermographic material for medical use, the transparent support may be colored with a blue dye (for example the dye 1 described in examples of JP-A No. 8-240877), or may be colorless. The support is preferably undercoated for example with a water-soluble polyester described in JP-A No. 11-84574, a styrene-butadiene copolymer described in JP-A No. 10-186565, or a vinylidene chloride copolymer described in JP-A No. 2000-39684 and Japanese Patent Application No. 11-106881, paragraphs 0063-0080. When the emulsion layer or the back layer is provided on the support, the support preferably has a water content of 0.5 wt. % or less.

11) Other Additives

The photothermographic material may further include an antioxidant, a stabilizer, a plasticizer, an ultraviolet absorber and/or an auxiliary coating agent. At least one of the photosensitive layer and the non-photosensitive layer may comprise such an additive. Regarding such an additive, reference may be made for example to WO No. 98/36322, EP No. 803764A1, JP-A Nos. 10-186567 and 10-186568.

12) Coating Method

The photothermographic material of the invention may be coated by any coating method. More specifically, various coating methods are applicable, including extrusion coating, slide coating, curtain coating, dip coating, knife coating, flow coating and an extrusion coating utilizing a hopper of a kind described in U.S. Pat. No. 2,681,294, and there is preferably employed an extrusion coating described in Stephen F. Kistler and Petert M. Schweizer, "Liquid Film Coating" (Chapman & Hall, 1997), pp. 399-536, or slide coating, and particularly preferably slide coating. An example of a shape of a slide coater to be used in the slide coating is shown in FIG. 11b.1 in the above-mentioned reference, p. 427. Also, two or more layers can be simultaneously applied by a method described in the above-mentioned reference, pp. 399-536, or any of methods described in U.S. Pat. No. 2,761,791 and BP No. 837,095. A coating method particularly preferable in the invention is a method described in JP-A Nos. 2001-194748, 2002-153808, 2002-153803, or 2002-182333.

The coating solution for the organic silver salt-containing layer of the invention is preferably a so-called thixotropic fluid. Regarding such technology, reference may be made to JP-A No. 11-52509. The coating solution for the organic silver salt-containing layer of the invention preferably has a viscosity at a shear speed of 0.1 $S^{-1}$ within a range from 400 to 100,000 mPa·s, and more preferably 500 to 20,000 mPa·s. Also a viscosity at a shear speed of 1000 $S^{-1}$ is preferably within a range from 1 to 200 mPa·s, and more preferably 5 to 80 mPa·s.

In the preparation of the coating solution of the invention, when two solutions are mixed, a known in-line mixer or an in-plant mixer may be preferably used. An in-line mixer and an in-plant mixer preferred in the invention are described respectively in JP-A Nos. 2002-85948 and 2002-90940.

The coating solution of the invention is preferably subjected to a defoaming process in order to maintain a satisfactory coated surface. A deforming process preferable in the invention is described in JP-A No. 2002-66431.

In applying the coating solution of the invention, a charge elimination is preferably executed in order to prevent deposition of dusts by a charging of the support. An example of a charge eliminating method preferable in the invention is described in JP-A No. 2002-143747.

In the invention, when a non-settable coating solution for the image forming layer is dried, it is important to precisely control a drying air and a drying temperature. A drying method preferred in the invention is described in detail in JP-A Nos. 2001-194749 and 2002-139814.

In the photothermographic material of the invention, a heat treatment is preferably applied immediately after coating and drying, in order to improve a film forming property. The heat treatment is executed at a film surface temperature preferably of 60 to 100° C. and with a heating time preferably of 1 to 60 seconds. More preferably, the film surface temperature should be within a range of 70 to 90° C., and the heating time should be within a range of 2 to 10 seconds. A method of heat treatment preferred in the invention is described in JP-A No. 2002-107872.

Also, in continuous manufacture of the photothermographic material of the invention in stable manner, manufacturing methods described in JP-A Nos. 2002-156728 and 2002-182333 can be preferably employed.

The photothermographic material is preferably a monosheet type, which is capable of forming an image on the photothermographic material without requiring another sheet such as an image receiving material.

13) Packaging Material

The photothermographic material of the invention is preferably packaged by a packaging material having a low oxygen permeation rate and/or a low moisture permeation rate, in order to suppress an alteration of the photographic performance during storage of an unprocessed stock, or to improve a curling or a bending. The oxygen permeation rate at 25° C. is preferably 50 ml/atm/m$^2$·day or less, more preferably 10 ml/atm/m$^2$ day or less, and further preferably 1.0 ml/atm/m$^2$·day or less. The moisture permeation rate is preferably 10 g/atm/m$^2$·day or less, more preferably 5 g/atm/m$^2$·day or less, and further preferably 1 g/atm/m$^2$·day or less.

Specific examples of the packaging material having a low oxygen permeation rate and/or a low moisture permeation rate include those described in JP-A Nos. 8-254793 and 2000-206653.

14) Other Applicable Technologies

In the photothermographic material of the invention, other technologies are also applicable, such as those described in EP No. 803764A1, EP No. 883022A1, WO No. 98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064 and 2000-171936.

In a multi-color photothermographic material, the emulsion layers are maintained in a mutually separated manner, as described in U.S. Pat. No. 4,460,681, by employing a functional or non-functional barrier layer between the photosensitive layers.

In a multi-color photothermographic material, a combination of these two layers may be included for each color, or all the components may be included in a single layer as described in U.S. Pat. No. 4,708,928.

Image Forming Method

In the image forming method according to the invention, the photothermographic according to the invention is used.

1) Exposure

In the image forming method of the invention, the photosensitive material of the invention may be exposed by any method, however exposure to a scanning laser beam is preferable. A He—Ne laser emitting red to infrared beam, a semiconductor laser emitting red beam, an $Ar^+$, He-Ne or He—Cd laser emitting blue to green beam, or a semiconductor laser emitting blue beam may be used for generating the laser beam. A semiconductor laser emitting red to infrared light is preferable, and a peak wavelength of the laser light is preferably 600 to 900 nm, more preferably 620 to 850 nm. On the other hand, an output apparatus emitting laser beam having a short wavelength is recently attracting particular attention, due to the development of an integrated module of an SHG (second harmonic generator) element and a semiconductor laser and of a blue light-emitting semiconductor laser. Demand for the blue light-emitting semiconductor laser is anticipated to increase in the future, since such laser is capable of recording a high-definition image, enabling an increase in the recording density and providing a stable output with a long service life. A peak wavelength of the blue laser light is preferably 300 to 500 nm, more preferably 390 to 430 nm.

An exposure method particularly preferred in the invention is a scan exposure with a blue light laser.

A laser light oscillated in a vertical multi mode for example by a high frequency superposing method can also be employed advantageously.

2) Thermal Development

In the image forming method of the invention, the photothermographic material of the invention may be developed by any method, however the development is usually executed by elevating the temperature of the photothermographic material after image-wise exposure. A developing temperature is preferably 80 to 250° C., more preferably 100 to 140° C., and further preferably 110 to 130° C.

In the invention, a developing time is extremely important. A thermal developing time means a period during which a photothermographic material is exposed to a temperature at which the thermal development can substantially proceed, and specifically corresponds to a period during which a photothermographic material contacts with a heating member explained in the following. The developing time in the invention is from 1 to 12 seconds, preferably from 2 to 10 seconds and more preferably from 4 to 8 seconds.

Thermal development may be conducted with a drum heater or a plate heater, preferably a plate heater. The thermal development with a plate heater is preferably the development described in JP-A No. 11-133572 utilizing a thermal development apparatus which brings a photothermographic material having a latent image in contact with heating means in a thermal development unit thereby obtaining a visible image, wherein the heating means is constituted by a plate heater, while plural pressing rollers are placed along a surface of the plate heater, and the thermal development is executed by passing the photothermographic material between the pressing rollers and the plate heater. It is preferable to divide the plate heater into 2 to 6 stages and to set the temperature of a leading end stage at a temperature which is lower than the temperature of other stages by 1 to 10° C. An example utilizes four sets of plate heaters whose temperatures can be independently controlled and the temperatures are controlled at at 112, 119, 121 and 120° C. respectively. Such a method, described also in JP-A No. 54-30032, allows to eliminate moisture or organic solvent, contained in the photothermographic material, from the system, and to suppress a change in the shape of the support of the photothermographic material at a rapid heating thereof.

From the viewpoint of reducing the size of the thermal developing apparatus and reducing the thermal developing time, a stabler heater control is preferable. It is also preferable that an exposure should be executed from a leading end of a photosensitive sheet and the thermal development should be initiated before the exposure reaches a trailing end. An imager capable of a rapid processing preferred in the invention is described for example in JP-A Nos. 2002-289804 and 2002-287668. Such an imager allows to execute a thermal development in 12 seconds or less with 3-stage plate heaters controlled at 107°-121°-121° C., and to shorten an output time of a first sheet to about 60 seconds or less.

3) System

Examples of a laser imager system for medical use, having an exposure unit and a thermal development unit, are Fuji Medical Dry Imager FM-DPL and DRYPIX 7000. The FM-DPL is described in Fuji Medical Review No. 8, p. 39-55, and such laser imager systems can be used for image formation with the photothermographic material of the invention. Also the photothermographic material according to the invention can be utilized in a laser imager in an AD Network, proposed by Fuji Film Medical Co. as a network system meeting the DICOM standard.

Application of Invention

The photothermographic material of the invention forms a black-and-white image based on silver by the image forming method of the invention, and is preferably utilized as a photothermographic material for medical diagnosis, a photothermographic material for industrial photography, a photothermographic material for printing and a photothermographic material for COM.

EXAMPLES

In the following, the present invention will be further clarified by examples thereof, but the invention is by no means limited to such examples.

Example 1

Preparation of PET Support

1) Preparation of Base

By an ordinary method, a PET having an intrinsic viscosity IV=0.66 (measured at 25° C. in phenol/tetrachloroethane=6/4 (weight ratio)) is synthesized from terephthalic acid and ethylene glycol. The PET was pelletized, then dried for 4 hours at 130° C., and fused at 300° C. Then the PET was extruded from a T-die and cooled rapidly to form an undrawn film having such a thickness as to provide a film thickness of 175 μm after thermal fixation.

The film was then drawn by 3.3-fold in a longitudinal direction with rollers of different peripheral speeds, and drawn by 4.5-fold in a transversal direction with a tenter. The temperatures were 110° C. and 130° C. respectively. Then, after a thermal fixation for 20 seconds at 240° C., a relaxation of 4% in the transversal direction was executed at 240° C. Then, after portions chucked by the tenter were slit off, a knurling was applied to both sides, and the film was wound under a tension of 4 kg/cm$^2$ to form a roll having a film of a thickness of 175 μm.

2) Surface Treatment with Corona Discharge

A solid-state corona discharge treating apparatus model 6KVA, manufactured by Pillar Inc., was employed to treat both sides of the support at a speed of 20 m/min. Based on current and voltage values read in this operation, it was identified that the support was treated under a condition of 0.375 kV·A·min/m$^2$. In this treatment, a frequency was 9.6 kHz and a clearance between an electrode and a dielectric roll was 1.6 mm.

3) Undercoating

Preparation of Coating Solution for Undercoat Layer

| Formulaion (1) (for undercoat layer on the photosensitive layer side) | |
|---|---|
| Pesresin A-520 (30 mass % solution) (manufactured by Takamatsu Yushi Co.) | 59 g |
| polyethylene glycol monononylphenyl ether (average number of ethylene oxide = 8.5), (10 mass % solution) | 5.4 g |
| MP-1000 (polymer particles, average particle size = 0.4 μm) (manufactured by Soken Kagaku Co.) | 0.91 g |
| distilled water | 935 ml |
| **Formulation (2) (for first undercoat layer on back side)** | |
| styrene-butadiene copolymer latex (solid content = 40 mass %, styrene/butadiene weight ratio = 68/32) | 158 g |
| 2,4-dichloro-6-hydroxy-S-triazine sodium salt (8 mass % aqueous solution) | 20 g |
| sodium laurylbenzenesulfonate (1 mass % aqueous solution) | 10 ml |
| distilled water | 854 ml |
| **Formulation (3) (for second undercoat layer on back side)** | |
| $SnO_2$/SbO (mass ratio of $SnO_2$/SbO = 9/1, average particle size = 0.038 μm, 17 mass % dispersion) | 84 g |
| gelatin (10 mass % aqueous solution) | 89.2 g |
| METOLOSE TC-5 (2 mass % aqueous solution) (manufactured by Shin-etsu Chemical Ltd.) | 8.6 g |
| MP-1000 (manufactured by Soken Chemical Co.) | 0.01 g |
| sodium dodecylbenzenesulfonate (1 mass % aqueous solution) | 10 ml |
| NaOH (1 mass %) | 6 ml |
| Proxel (manufactured by ICI Ltd.) | 1 ml |
| distilled water | 805 ml |

Undercoating

Both surfaces of the biaxially drawn polyethylene terephthalate support having a thickness of 175 μm was subjected to the aforementioned corona discharge treatment. Then the undercoating formulation (1) was coated on a surface of the support (on the photosensitive layer side) by a wire bar in a wet coating amount of 6.6 ml/m$^2$ (per one side) and dried for 5 minutes at 180° C. Then the undercoating formulation (2) was coated on a rear side (back surface) by a wire bar in a wet coating amount of 5.7 ml/m$^2$ and dried for 5 minutes at 180° C., and the undercoating formulation (3) was coated on the rear side (back surface) by a wire bar in a wet coating amount of 7.7 ml/m$^2$ and dried for 6 minutes at 180° C. to provide an undercoated support.

2) Back Layer

Preparation of Coating Solutions for Antihalation Layer

To water maintained at 40° C., 32.7 g of lime-processed gelatin, 0.77 g of mono-dispersed polymethyl methacrylate particles (average particle size=8 μm, a standard deviation of particle size=0.4 μm), 0.08 g of benzoisothiazolinone, 0.3 g of sodium polystyrenesulfonate, 0.06 g of a blue dye compound-1, 1.5 g of an ultraviolet absorber-1, 5.0 g of an acrylic acid/ethyl acrylate copolymer latex (copolymerizatiion ratio: 5/95), and 1.7 g of N,N-ethylenebis(vinylsulfonacetamide) were added. Then, pH of the mixture was adjusted to 6.0 with a 1 mol/l sodium hydroxide solution, and the total amount was adjusted with water to 818 ml to provide a coating solution for the antihalation layer.

Preparation of Coating Solution for Back Surface Protective Layer

To water maintained at 40° C., 66.5 g of lime-processed gelatin, 5.4 g of liquid paraffin in a liquid paraffin emulsion, 0.10 g of benzoisothiazolinone, 0.5 g of sodium di(2-ethylhexyl)sulfosuccinate, 0.27 g of sodium polystyrenesulfonate, 13.6 ml of a 2% solution of a fluorine-type surfactant (F-1), and 10.0 g of an acrylic acid/ethyl acrylate copolymer (copolymerization ratio: 5/95) were added. Then, the pH of the mixture was adjusted to 6.0 with a 1 mol/l sodium hydroxide solution, and the total amount was adjusted with water to 1000 ml to provide a coating solution for the back surface protective layer.

Formation of Back Layers

On the back surface of the undercoated support, the coating solution for the antihalation layer and the coating solution for the back surface protective layer were simultaneously coated by simultaneous multi-layer coating method so that the gelatin coating amount of the antihalation layer became 0.52 g/m$^2$ and the gelatin coating amount of the back surface protective layer became 1.7 g/m$^2$. The coated solutions were dried to provide a back layers.

Image Forming Layer, Intermediate Layer and Surface Protective Layer

1. Preparation of Materials to Be Applied

1) Silver Halide Emulsion (Preparation of Silver Halide Emulsion A)

While a solution, obtained by adding 3.1 ml of a 1 mass % solution of potassium bromide, 3.5 ml of a 0.5 mol/L sulfuric acid solution, and 31.7 g of phthalated gelatin to 1421 ml of distilled water, was maintained at 30° C. under agitation in a stainless steel reaction pot, a solution A obtained by dissolving 22.22 g of silver nitrate in distilled water to give the total amount of 95.4 ml and a solution B obtained by dissolving 15.3 g of potassium bromide and 0.8 g of potassium iodide in distilled water to give the total amount of 97.4 ml were added with constant flow rates over 45 seconds. Then, 10 ml of a 3.5 mass % aqueous solution of hydrogen peroxide was added to the mixture, and 10.8 ml of a 10 mass % aqueous solution of benzimidazole was further added to the mixture. Then, a solution C obtained by dissolving 51.86 g of silver nitrate in distilled water to give the total amount of 317.5 ml and a solution D obtained by dissolving 44.2 g of potassium bromide and 2.2 g of potassium iodide in distilled water to give the total amount of 400 ml were added to the mixture. During this addition, the solution C was added with a constant flow rate over 20 minutes, and the solution D was added by a controlled double jet method while the pAg value was kept at a constant value of 8.1. At 10 minutes after the start of addition of the solutions C and D, potassium hexachloroiridate (III) was added in an amount of $1\times10^{-4}$ moles per 1 mole of silver. Also at 5 seconds after the completion of addition of the solution C, an aqueous solution of potassium hexacyanoferrate (II) was added in an amount of $3\times10^{-4}$ moles per 1 mole of silver. Then the pH was adjusted to 3.8 with 0.5 mol/L sulfuric acid solution. Then the agitation was stopped and precipitation/desalting/rinsing steps were executed. The pH was adjusted to 5.9 with sodium hydroxide having a concentration of 1 mol/L, whereby a silver halide dispersion having a pAg of 8.0 was obtained.

While the silver halide dispersion was maintained at 38° C. under agitation, 5 ml of a 0.34 mass % methanol solution of 1,2-benzoisothiazolin-3-one was added to the dispersion, and the dispersion was heated to 47° C. after 40 minutes. At 20 minutes after the temperature elevation, sodium benzenethiosulfonate in a methanol solution was added in an amount of $7.6\times10^{-5}$ moles per 1 mole of silver, then after further 5 minutes, a tellurium sensitizer C in a methanol solution was added in an amount of $2.9\times10^{-4}$ moles per 1 mole of silver, and a ripening was executed for 91 minutes. Thereafter, 1.3 ml of a 0.8 mass % methanol solution of N,N'-dihydroxy-N"-diethylmelamine was added, and, after further 4 minutes, 5-methyl-2-mercaptobenzimidazole in a methanol solution in an amount of $4.8\times10^{-3}$ moles per 1 mole of silver, 1-phenyl-2-heptyl-5-mercapto-1,3,4-triazole in a methanol solution in an amount of $5.4\times10^{-3}$ moles per 1 mole of silver, and 1-(3-methylureidephenyl)-5-mercaptotetrazole in an aqueous solution in an amount of $8.5\times10^{-3}$ moles per 1 mole of silver, were added to form a silver halide emulsion A.

Thus prepared silver halide emulsion contained silver iodobromide grains having an average sphere-corresponding diameter of 0.04 μm and a variation factor of the sphere-corresponding diameter of 20% and uniformly containing 3.5 mol % of iodine. The grain size and the like were determined based on the average of 1000 grains, utilizing an electron microscope.

Preparation of Silver Halide Emulsion B

A silver halide emulsion B was prepared in the same manner as the silver halide emulsion A, except that potassium iodide was not added. The silver halide emulsion B contained silver bromide grains having an average sphere-corresponding diameter of 0.04 μm and a variation factor of the sphere-corresponding diameter of 15%.

Preparation of Silver Halide Emulsion 2

A silver iodobromide emulsion 2 with a silver iodide content of 40 mol % was prepared in the same manner as the emulsion A, except that amounts of addition of potassium iodide and potassium bromide were changed. The silver halide emulsion 2 contained grains having an average sphere-corresponding diameter of 0.04 μm and a variation factor of the sphere-corresponding diameter of 16%.

Preparation of Silver Halide Emulsion 3

A silver iodobromide emulsion 3 with a silver iodide content of 90 mol % was prepared in the same manner as the emulsion A, except that amounts of addition of potassium iodide and potassium bromide were changed. The silver halide emulsion 3 contained grains having an average sphere-corresponding diameter of 0.04 μm and a variation factor of the sphere-corresponding diameter of 17%.

Preparation of Silver Halide Emulsion 4

While a solution, obtained by adding 4.3 ml of a 1 mass % solution of potassium iodide, 3.5 ml of 0.5 mol/L sulfuric acid solution and 36.7 g of phthalated gelatin to 1420 ml of distilled water, was maintained at 42° C. under agitation in a stainless steel reaction pot, a solution A obtained by dissolving 22.22 g of silver nitrate in distilled water to give the total amount of 195.6 ml and a solution B obtained by dissolving 21.8 g of potassium iodide in distilled water to give the total amount of 218 ml were added with constant flow rates over 9 minutes. Then 10 ml of a 3.5 mass % aqueous solution of hydrogen peroxide was added, and 10.8 ml of a 10 mass % aqueous solution of benzimidazole was further added.

Then, a solution C obtained by dissolving 51.86 g of silver nitrate in distilled water to give the total amount of 317.5 ml and a solution D obtained by dissolving 60 g of potassium iodide in distilled water to give the total amount of 600 ml were added. During this addition, the solution C was added with a constant flow rate over 120 minutes, and the solution D was added by a controlled double jet method while the pAg was kept at a constant value of 8.1. At 10 minutes after the start of addition of the solutions C and D, potassium hexachloroiridate (III) was added in an amount of $1\times10^{-4}$ moles per 1 mole of silver. Also at 5 seconds after the completion of addition of the solution C, an aqueous solution of potassium hexacyanoferrate (II) was added in an amount of $3\times10^{-4}$ moles per 1 mole of silver. Then pH was adjusted to 3.8 with 0.5 mol/L sulfuric acid solution. Then the agitation was stopped and precipitation/desalting/rinsing steps were executed. The pH was adjusted to 5.9 with 1 mol/L sodium hydroxide solution, whereby a silver halide dispersion having a pAg value of 8.0 was obtained.

The silver halide dispersion was maintained at 38° C. under agitation, then 5 ml of a 0.34 mass % methanol solution of 1,2-benzoisothiazolin-3-one was added to the dispersion, and the dispersion was heated to 47° C. At 20 minutes after the temperature elevation, sodium benzenethiosulfonate in a methanol solution was added in an amount of $7.6\times10^{-5}$ moles per 1 mole of silver, then after further 5 minutes, a tellurium sensitizer B in a methanol solution was added in an amount of $2.9\times10^{-4}$ moles per 1 mole of silver, and a ripening was executed for 91 minutes.

Thereafter, 1.3 ml of a 0.8 mass % methanol solution of N,N'-dihydroxy-N"-diethylmelamine were added, and, after further 4 minutes, 5-methyl-2-mercaptobenzimidazole in a methanol solution in an amount of $4.8\times10^{-3}$ moles per 1 mole of silver, and 1-phenyl-2-heptyl-5-mercapto-1,3,4-triazole in a methanol solution in an amount of $5.4\times10^{-3}$ moles per 1 mole of silver, were added to form a silver halide emulsion 2.

Thus prepared silver halide emulsion contained pure silver iodide grains having an average sphere-corresponding diameter of 0.04 μm and a variation factor of the sphere-corresponding diameter of 18%. The grain size and the like were determined based on the average of 1000 grains, utilizing an electron microscope. Silver halide emulsions of other particle sizes (particles sizes being shown in Table 1) were obtained, based on the formulation on the silver halide emulsion 1, by varying the temperature from 42° C. to control the average sphere-corresponding diameter.

Preparation of Diluted Emulsion for Coating Solution

Benzothiazolium iodide in a 1 mass % aqueous solution was added in an amount of $7\times10^{-3}$ moles per 1 mole of silver to the aforementioned silver halide emulsions. Then, water was added to each silver halide emulsion so as to obtain a silver halide content corresponding to 38.2 g of silver per 1 kg of the emulsion to form an diluted emulsion for coating solution.

2) Fatty Acid Silver Salt Dispersion 87.6 kg of behenic acid (trade name: EDENOR C22-85R, manufactured by Henkel Co.), 423 L of distilled water, 49.2 L of a 5 mol % aqueous solution of NaOH, and 120 L of t-butyl alcohol were mixed and reacted for 1 hour at 75° C. under agitation to obtain a sodium behenate solution A. Separately, 206.2 L of an aqueous solution (pH 4.0) of 40.4 kg of silver nitrate were prepared and maintained at 10° C. A reaction vessel containing 635 L of distilled water and 30 L of t-butyl alcohol was maintained at 30° C., and the entire amount of the sodium behenate solution A and the entire amount of the silver nitrate solution were added under sufficient agitation with constant flow rates, respectively over 93 minutes and 15 seconds and over 90 minutes. In this operation, during 11 minutes from the start of the addition of the silver nitrate solution, the silver nitrate solution alone was added, then the addition of the sodium behenate solution A was started, and, during 14 minutes and 15 seconds after the completion of addition of the silver nitrate solution, the sodium behenate solution A alone was added. In this operation, the temperature in the reaction vessel was maintained at 30° C., and the external temperature was so controlled as to maintain a constant solution temperature. Also a piping for adding the sodium behenate solution A was temperature-controlled by circulating warm water in an outer jacket of double tubes, thereby adjusting the solution temperature at an exit end of the addition nozzle at 75° C. Also a piping for adding the silver nitrate solution was temperature-controlled by circulating cold water in an outer jacket of double tubes. A position of addition of the sodium behenate solution A and a position of addition of the silver nitrate solution were symmetrically positioned with respect to an agitating shaft, and were adjusted at such a height not touching the reaction solution.

After the completioin of addition of the sodium behenate solution A, the reaction solution was let to stand for 20 minutes at a same temperature under agitation, then the temperature of the reaction solution was elevated to 35° C. over a period of 30 minutes, and was thereafter ripened for 210 minutes. Immediately after the completion of the ripening, solid was separated by a centrifuged filtration and was washed with water until the conductivity of filtered water reached 30 μS/cm. A fatty acid silver salt was obtained in this manner. The obtained solid was not dried but stored in a form of wet cake.

The shape of the obtained silver behanate grains was evaluated by electron photomicrographs. It was found that the silver behanate grains were flake-shaped crystals with a=0.14 μm, b=0.4 μm and c=0.6 μm on the average, having an average aspect ratio of 5.2, an average sphere-corresponding diameter of 0.52 μm and a variation factor of the sphere-corresponding diameter of 15% (a, b and c being defined in the present specification).

To the wet cake corresponding to 260 kg of dry solid, 19.3 kg of polyvinyl alcohol (trade name: PVA-217) and water were added to give the total amount of 1000 kg. Then, the mixture was made slurry by dissolver blades and further pre-dispersed by a pipeline mixer (model PM-10; manufactured by Mizuho Kogyo Co.).

Then the pre-dispersed solution was processed three times in a disperser (trade name: MICROFLUIDIZER M-610, manufactured by Microfluidics International Corporation; with a Z-type interaction chamber) at a pressure of 1260 kg/cm$^2$, whereby a silver behenate dispersion was obtained. A dispersion temperature was controlled at 18° C. by mounting spiral-piped heat exchangers in front of and behind the interaction chamber and regulating the temperature of a refrigerant.

3) Reducing Agent Dispersion

Preparation of Reducing Agent-1 Dispersion 10 kg of a reducing agent-1 (2,2'-methylenebis-(4-ethyl-6-tert-butylphenol)) and 16 kg of a 10 mass % aqueous solution of denatured polyvinyl alcohol (POVAL MP203, manufactured by Kuraray Co.) were added to 10 kg of water and the mixture was mixed well to form a slurry. The slurry was fed by a diaphragm pump to a horizontal sand mill (UVM-2; manufactured by Imex Co.) filled with zirconia beads having an average diameter of 0.5 mm, then dispersed for 3 hours in the sand mill. Then, 0.2 g of sodium benzoisothiazolinone and water were added to give a concentration of the reducing agent of 25 mass %. The dispersion was kept at 60° C. for 5 hours to form a reducing agent-1 dispersion. The reducing agent particles contained in thus obtained reducing agent dispersion had a median diameter of 0.40 μm and a maximum particle diameter of 1.4 μm or less. The obtained reducing agent dispersion was stored after a filtration with a polypropylene filter with a pore size of 3.0 μm for eliminating foreign substances such as dusts.

Preparation of Reducing Agent-2 Dispersion 10 kg of a reducing agent-2 (6,6'-di-t-butyl-4,4'-dimethyl-2,2'-butylidenediphenol) and 16 kg of a 10 mass % aqueous solution of denatured polyvinyl alcohol (POVAL MP203, manufactured by Kuraray Co.) were added to 10 kg of water and the mixture was mixed well to form a slurry. The slurry was fed by a diaphragm pump to a horizontal sand mill (UVM-2; manufactured by Imex Co.) filled with zirconia beads of an average diameter of 0.5 mm, then dispersed for 3 hours and 30 minutes in the sand mill. Then, 0.2 g of sodium benzoisothiazolinone and water were added to give a concentration of the reducing agent of 25 mass %. The dispersion was kept at 40° C. for 1 hour and subsequently at 80° C. for 1 hour to form a reducing agent-2 dispersion. The reducing agent particles contained in thus obtained reducing agent dispersion had a median diameter of 0.50 μm and a maximum particle diameter of 1.6 μm or less. The obtained reducing agent dispersion was stored after a filtration with a polypropylene filter having a pore size of 3.0 μm for removing foreign substances such as dusts.

3) Hydrogen Bonding Compound-1 Dispersion 10 kg of a hydrogen bonding compound-1 (tri(4-t-butylphenyl)phosphinoxide) and 16 kg of a 10 mass % aqueous solution of denatured polyvinyl alcohol (POVAL MP203, manufactured by Kuraray Co.) were added to 10 kg of water and the mixture was mixed well to form a slurry. The slurry was fed by a diaphragm pump to a horizontal sand mill (UVM-2; manufactured by Imex Co.) filled with zirconia beads of an average diameter of 0.5 mm, then dispersed for 4 hours in the sand mill. Then, 0.2 g of sodium benzoisothiazolinone and water were added to give a concentration of the hydrogen bonding compound of 25 mass %. The dispersion was kept at 40° C. for a 1 hour and subsequently at 80° C. for 1 hour to form a hydrogen bonding compound-1 dispersion. The particles of the hydrogen bonding compound contained in thus obtained hydrogen bonding compound dispersion had a median diameter of 0.45 μm and a maximum particle diameter of 1.3 μm or less. The obtained hydrogen bonding compound dispersion was stored after a filtration with a polypropylene filter having a pore size of 3.0 μm for removing foreign substances such as dusts.

4) Development Accelerator-1 Dispersion

Preparation of Development Accelerator-1 Dispersion 10 kg of a development accelerator-1, 20 kg of a 10 mass % aqueous solution of denatured polyvinyl alcohol (POVAL MP203, manufactured by Kuraray Co.), and 10 kg of water were mixed well to obtain a slurry. The slurry was fed by a diaphragm pump to a horizontal sand mill (UVM-2; manufactured by Imex Co.) filled with zirconia beads of an average diameter of 0.5 mm, then dispersed for 3 hours and 30 minutes in the sand mill. Then, 0.2 g of sodium benzoisothiazolinone and water were added to give a concentration of the development accelerator of 20 mass % whereby a development accelerator-1 dispersion was obtained. The particles of the development accelerator contained in thus obtained development accelerator dispersion had a median diameter of 0.48 μm and a maximum particle diameter of 1.4 μm or less. The obtained development accelerator dispersion was stored after a filtration with a polypropylene filter having a pore size of 3.0 μm for removing foreign substances such as dusts.

Preparation of Solid Dispersions of Development Accelerator-2 and Color Controlling Agent-1

Solid dispersions of a development accelerator-2 and a color controlling agent-1 were also prepared by a process similar to that in the case of the development accelerator-1. The dispersion of the development accelerator-2 had a concentration of 20 mass % and the dispersion of the color controlling agent-1 had a concentration of 15 mass %.

5) Polyhalogen Compound Dispersion

Preparation of Organic Polyhalogen Compound-1 Dispersion 10 kg of an organic polyhalogen compound-1 (tribromomethanesulfonylbenzene), 10 kg of a 20 mass % aqueous solution of denatured polyvinyl alcohol (POVAL MP203, manufactured by Kuraray Co.), 0.4 kg of a 20 mass % aqueous solution of sodium triisopropylnaphthalene-sulfonate and 14 kg of water were mixed well to form a slurry. The slurry was fed by a diaphragm pump to a horizontal sand mill (UVM-2; manufactured by Imex Co.) filled with zirconia beads of an average diameter of 0.5 mm, then dispersed for 5 hours in the sand mill. Then, 0.2 g of sodium benzoisothiazolinone and water were added to give a concentration of the organic polyhalogen compound of 30 mass % whereby an organic polyhalogen compound-1 dispersion was obtained. The particles of the organic polyhalogen compound contained in thus obtained organic polyhalogen compound dispersion had a median diameter of 0.41 μm and a maximum particle diameter of 2.0 μm or less. The obtained organic polyhalogen compound dispersion was stored after a filtration with a polypropylene filter having a pore size of 10.0 μm for removing foreign substances such as dusts.

Preparation of Organic Polyhalogen Compound-2 Dispersion 10 kg of an organic polyhalogen compound-2 (N-butyl-3-tribromomethanesulfonylbenzamide), 20 kg of a 10 mass % aqueous solution of denatured polyvinyl alcohol (POVAL MP203, manufactured by Kuraray Co.) and 0.4 kg of a 20 mass % aqueous solution of sodium triisopropylnaphthalene-sulfonate were mixed well to form a slurry. The slurry was fed by a diaphragm pump to a horizontal sand mill (UVM-2; manufactured by Imex Co.) filled with zirconia beads of an average diameter of 0.5 mm, then dispersed for 5 hours in the sand mill. Then, 0.2 g of sodium benzoisothiazolinone and water were added to give a concentration of the organic polyhalogen compound of 30 mass %. The dispersion was kept at 40° C. for 5 hours to form an organic polyhalogen compound-2 dispersion. The particles of the organic polyhalogen compound contained in thus obtained organic polyhalogen compound dispersion had a median diameter of 0.40 μm and a maximum particle diameter of 1.3 μm or less. The obtained organic polyhalogen compound dispersion was stored after a filtration with a polypropylene filter having a pore size of 3.0 μm for removing foreign substances such as dusts.

6) Preparation of Phthalazine Compound Solution 8 kg of denatured polyvinyl alcohol (MP203, manufactured by Kuraray Co.) were dissolved in 174.57 kg of water, and 3.15 kg of a 20 mass % aqueous solution of sodium triisopropylnaphthalenesulfonate and 6 kg of 6-isopropylphthalazine were added to the solution to form a 5 mass % solution.

7) Preparation of a Mercapto Compound

Preparation of Aqueous Solution of a Mercapto Compound-1

7 g of a mercapto compound-1 (1-(3-sulfophenyl)-5-mercaptotetrazole sodium salt) were dissolved in 993 g of water to obtain a 0.7 mass % aqueous solution.

Preparation of Aqueous Solution of a Mercapto Compound-2

20 g of a mercapto compound-2 (1-(3-methylureidophenyl)-5-mercaptotetrazole) were dissolved in 980 g of water to form a 2.0 mass % aqueous solution.

8) Preparation of Pigment-1 Dispersion 64 g of C.I. Pigment blue 60, 6.4 g of DEMOL N (manufactured by Kao Corp.) and 250 g of water were mixed well to obtain a slurry. The slurry was placed in a vessel together with 800 g of zirconia beads having an average diameter of 0.5 mm, then dispersed for 25 hours in a disperser (1/4G sand grinder mill, manufactured by Imex Co.). Then, water was added to the dispersion to give a concentration of the pigment of 5 mass %, whereby a pigment-1 dispersion was obtained. The pigment particles contained in thus obtained pigment dispersion had an average particle diameter of 0.21 μm.

9) Preparation of Dispersions of Adsorbable Redox Compound, and Compound Capable of Electron Release by Oxidation An additive S-1 or an additive S-2 was employed in a process similar to that in the preparation of the pigment-1 dispersion, thereby forming each dispersion.

10) Preparation of SBR Latex

An SBR latex was prepared in the following manner.

In a polymerization vessel of a gas monomer reaction apparatus (model TAS-2J, manufactured by Taiatsu Glass Kogyo Co.), 287 g of distilled water, 7.73 g of a surfactant (PIONIN A-43-S (manufactured by Takemono Yushi Co.), solid content=48.5%), 14.06 ml of 1 mol/L NaOH, 0.15 g of tetrasodium ethylenediamine tetraacetate, 255 g of styrene, 11.25 g of acrylic acid and 3.0 g of tert-dodecylmercaptane were placed. Then, the reaction vessel was tightly closed, and the mixture in the vessel was agitated at an agitating speed of 200 rpm. After the vessel was degassed with a vacuum pump and internal gas replacement with nitrogen gas was repeated several times, 108.75 g of 1,3-butadiene were pressed in the vessel and an internal temperature was elevated to 60° C. Then a solution of 1.875 g of ammonium persulfate in 50 ml of water was added to the vessel, and the agitation was continued for 5 hours. Then the temperature was further raised to 90° C. and the agitation was continued for 3 hours. After the completion of reaction, the internal temperature was lowered to the room temperature. 1 mol/L NaOH solution and 1 mol/L $NH_4OH$ solution were added so as to obtain $Na^+$ ion/$NH_4^+$ ion molar ratio of 1/5.3 and a pH of 8.4. Then a filtration was executed with a polypropylene filter having a pore size of 1.0 μm for removing foreign substances such as dusts, whereby 774.7 g of SBR latex was obtained. A halogen ion measurement with an ion chromatography proved a chloride ion concentration of 3 ppm. Also a measurement with a high speed liquid chromatography proved a chelating agent concentration of 145 ppm.

The latex had an average particle diameter of 90 nm, Tg of 17° C., a solid concentration of 44 mass %, an equilibrated water content at 25° C. and 60% RH of 0.6 mass %, an ion conductivity of 4.80 mS/cm (original latex (44 mass %) at 25° C. was measured with a conductometer CM-30S manufactured by Toa Dempa Kogyo Co.,), and a pH of 8.4.

2. Preparation of Coating Solution (Preparation of Coating Solution-1 to -16 for Image Forming Layer In 1000 g of the aforementioned fatty acid silver salt dispersion A and 276 ml of water, the pigment-I dispersion, the organic polyhalogen compound-1 dispersion, the organic polyhalogen compound-2 dispersion, the phthalazine compound solution, the SBR latex (Tg: 17° C.), the reducing agent-1 dispersion, the hydrogen bonding compound-1 dispersion, the development accelerator-1 dispersion, the development accelerator-2 dispersion, the color controlling agent-1 dispersion, the mercapto compound-1 aqueous solution, the mercapto compound-2 aqueous solution, the additive S-1 dispersion and the additive S-2 dispersion were added in succession. Then, the diluted emulsion for coating solution was further added, and the mixture was mixed well immediately before coating to form coating solutions-1 to -10 for image forming layer.

A zirconium amount in the coating solution was 0.34 mg per 1 g of silver.

Preparation of Intermediate Layer Coating Solution 1000 g of polyvinyl alcohol PVA-205 (manufactured by Kuraray Co.), 272 g of the pigment-I dispersion, 4200 ml of a 19 mass % latex of methyl methacrylate/styrene/butyl acrylate/hydroxyethyl methacrylate/acrylic acid copolymer (copolymerizing weight ratio: 64/9/20/5/2), 27 ml of a 5 mass % aqueous solution of AEROSOL OT (manufactured by American Cyanamide Inc.), 135 ml of a 20 mass % aqueous solution of diammonium phthalate, and water to give a total amount of 10000 g were mixed and the pH was adjusted to 7.5 with NaOH to form an intermediate layer coating solution. The intermediate layer coating solution was supplied to a coating die with a rate of 9.1 ml/$m^2$.

The coating solution used in preparation of a photothermographic material-1 had a viscosity of 58 [mPa·s] in a measurement with a Brookfield viscosimeter (rotor No. 1, 60 rpm) at 40° C.

Preparation of Coating Solution for First Surface Protective Layer 64 g of inert gelatin were dissolved in water. Then, 112 g of a 19.0 mass % latex of methyl methacrylate/styrene/butyl acrylate/hydroxyethyl methacrylate/acrylic acid copolymer (copolymerizing weight ratio: 64/9/20/5/2), 30 ml of a 15 mass % methanol solution of phthalic acid, 23 ml of a 10 mass % aqueous solution of 4-methylphthalic acid, 28 ml of 0.5 mol/L sulfuric acid solution, 5 ml of a 5 mass % aqueous solution of AEROSOL OT (manufactured by American Cyanamide Inc.), 0.5 g of phenoxyethanol, 0.1 g of benzothiazolinone and water to give a total amount of 750 g were added to the gelatin solution to form a coating solution. After addition of 26 ml of a 4 mass % solution of chromium alum to the coating solution by a static mixer immediately before coating, the coating solution was supplied to a coating die at a rate of 18.6 ml/$m^2$.

The coating solution had a viscosity of 20 [mPa·s] when measured with a Brookfield viscosimeter (rotor No. 1, 60 rpm) at 40° C.

Preparation of Coating Solution for Second Surface Protective Layer 80 g of inert gelatin were dissolved in water. Then, 102 g of a 27.5 mass % latex of methyl methacrylate/styrene/butyl acrylate/hydroxyethyl methacrylate/acrylic acid copolymer (copolymerizing weight ratio: 64/9/20/5/2), 5.4 ml of a 2 mass % solution of a fluorine-type surfactant (F-1), 5.4 ml of a 2 mass % solution of a fluorine-type surfactant (F-2), 23 ml of a 5 mass % aqueous solution of AEROSOL OT (manufactured by American Cyanamide Inc.), 4 g of of polymethyl methacrylate fine particles (average particle size=0.7 μm), 21 g of of polymethyl methacrylate fine particles (average particle size=4.5 μm), 1.6 g of 4-methylphthalic acid, 4.8 g of phthalic acid, 44 ml of sulfuric acid at a concentration of 0.5 ml/L, 10 mg of benzothiazolinone and water to give a total amount of 650 g were added to the gelatin solutoin. 445 ml of an aqueous solution containing 4 mass % of chromium alum and 0.67 mass % of phthalic acid was further added to the gelatin solution by a static mixer immediately before coating to form a coating solution for the surface protective layer, which was fed to a coating die at a rate of 8.3 ml/$m^2$.

The coating solution had a viscosity of 19 [mPa·s] when measured with a Brookfield viscosimeter (rotor No. 1, 60 rpm) at 40° C.

3. Preparation of Photothermographic Materials-1 to -16

Samples of the photothermographic material were prepared by simultaneous multi-layer coating. A slide bead coating method was employed in the coating. In the coating, an image forming layer, an intermediate layer, a first surface protective layer, and a second surface protective layer were coated in this order (from the undercoated surface) on a surface of the undercoated support opposite to the back side. In this operation, the temperatures of the coating solutions for the image forming layer and the intermediate layer were controlled at 31° C., the temperature of the coating solution for the first surface protective layer was kept at 36° C. and the temperature of the coating solution for the second surface protective layer was kept at 37° C.

TABLE 1

| Sample No. | Silver halide emulsion | Reducing agent-1 | Reducing agent-2 | Development accelerator-1 | Development accelerator-2 | Remarks |
|---|---|---|---|---|---|---|
| 1 | 1 | 0.45 | 0.31 | — | — | comp. ex. |
| 2 | 2 | 0.45 | 0.31 | — | — | invention |
| 3 | 3 | 0.45 | 0.31 | — | — | invention |
| 4 | 4 | 0.45 | 0.31 | — | — | invention |

TABLE 1-continued

| Sample No. | Silver halide emulsion | Reducing agent-1 | Reducing agent-2 | Development accelerator-1 | Development accelerator-2 | Remarks |
|---|---|---|---|---|---|---|
| 5 | 1 | 0.48 | 0.27 | 0.024 | 0.018 | comp. ex. |
| 6 | 2 | 0.48 | 0.27 | 0.024 | 0.018 | invention |
| 7 | 3 | 0.48 | 0.27 | 0.024 | 0.018 | invention |
| 8 | 4 | 0.48 | 0.27 | 0.024 | 0.018 | invention |

Each compound in the image forming layer had the following coating amount (g/m$^2$):

| | |
|---|---|
| silver behenate | 5.27 |
| pigment (C.I. Pigment Blue 60) | 0.036 |
| organic polyhalogen compound-1 | 0.08 |
| organic polyhalogen compound-2 | 0.12 |
| phthalazine compound | 0.18 |
| SBR latex | 9.43 |
| reducing agent-1 (shown in Tab. 1) | (Tab. 1) |
| reducing agent-2 (shown in Tab. 1) | (Tab. 1) |
| hydrogen bonding compound-1 | 0.28 |
| development accelerator-1 | (Tab. 1) |
| development accelerator-2 | (Tab. 1) |
| color controlling agent-1 | 0.008 |
| additive S-1 | 0.001 |
| additive S-2 | 0.002 |
| silver halide (in terms of silver amount) | 0.046 |

Coating and drying conditions were as follows.

The support was subjected, before the coating, to a charge elimination by an ionized air flow, and the coating was executed at a speed of 170 m/min. The coating and drying condition for each sample was so selected within the following ranges that a most stable surface state was obtained:

a gap between a front end of the coating die and the support was from 0.10 to 0.30 mm;

a pressure in a reduced-pressure chamber was maintained lower than the atmospheric pressure by 196 to 882 Pa;

the coating solution was cooled in a succeeding chilling zone with an air flow having a dry bulb temperature of 10 to 20° C.;

after non-contact transportation, the support was dried by a non-contact type spiral drying apparatus with a drying air flow having a dry bulb temperature of 23 to 45° C. and a wet bulb temperature of 15 to 21°, followed by a humidity adjustment at a temperature of 25° C. in a humidity of 40 to 60% RH; and the film surface was heated to 70 to 90° C., and thereafter, the film surface was cooled to 25° C.

The photothermographic material-1 thus prepared had a matting degree, represented by Beck's smoothness, of 550 seconds on the side of the photosensitive layer and 130 seconds on the back side. Also the side of the photosensitive layer had a film pH of 6.0.

In the following, there are shown chemical structures of the compounds employed in the examples of the invention.

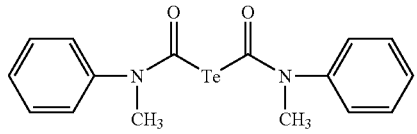

Tellurium sensitizer C

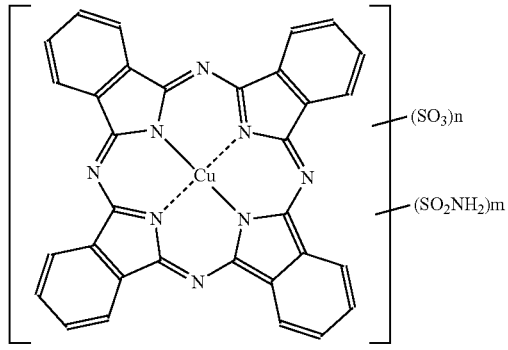

Blue dye compound -1 n = 1~3
m = 1~3

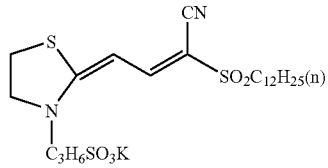

Ultraviolet absorber -1

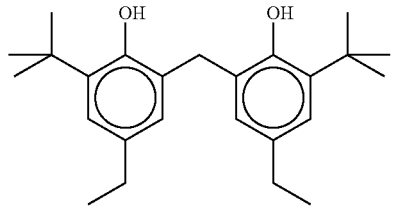

(Reducing agent -1)

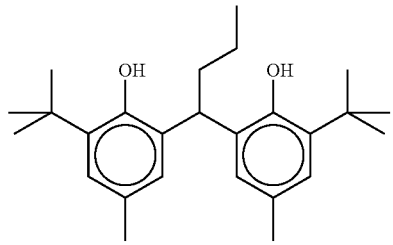

(Reducing agent -2)

-continued

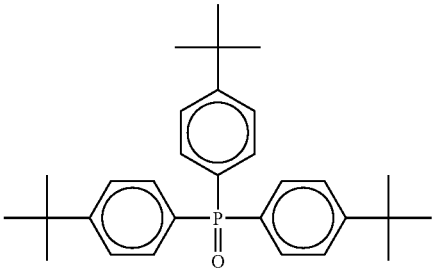

(Hydrogen bonding compound -1)

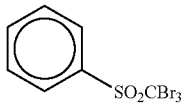

(Polyhalogen compound -1)

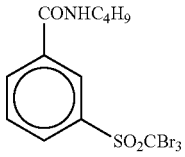

(Polyhalogen compound -2)

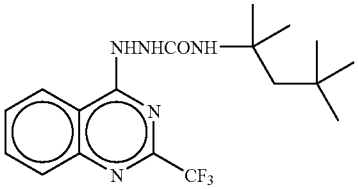

(Development accelerator -1)

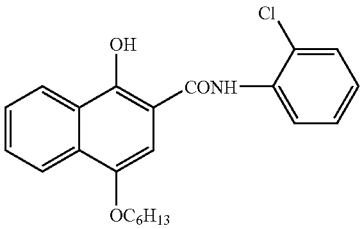

(Development accelerator -2)

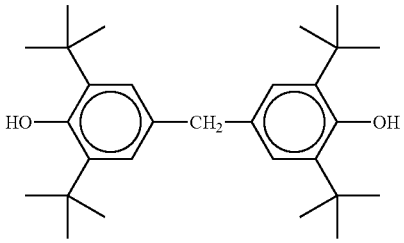

(Color controlling agent -1)

(S-1)

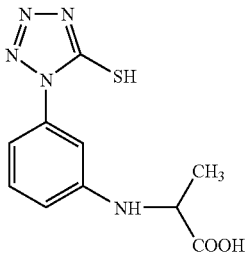

-continued (S-2)

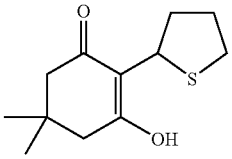

(F-1)

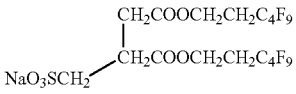

(F-2)

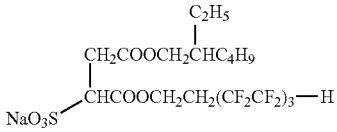

4. Evaluation of Performance

Preparation of Sample

Each obtained sample was cut into a half size (about 30×50 cm), then packed in the following packaging material in an environment of 25° C. and 50% RH.

(Packaging Material)

A sheet of PET 10 μm/PE 12 μm/aluminum foil 9 μm/nylon 15 μm/polyethylene 50 μm containing 3 mass % of carbon;

oxygen permeation rate: 0.02 ml/atm·$m^2$·25° C.·day, moisture permeation rate: 0.10 g/atm·$m^2$·25° C.·day.

Evaluation of Photographic Property

In an exposure unit of a Fuji medical dry laser image DRYPIX 7000, a semiconductor laser NLHV3000E, manufactured by Nichia Chemical Industries Co., was mounted as a laser light source and a beam diameter was narrowed to 100 μm. Each sample was exposed for $10^{-6}$ seconds with an illumination intensity of the laser light on the surface of the photothermographic material controlled at 0 and within a range of 1 to 100 mW/$mm^2$. The laser had an oscillation wavelength of 405 nm. A thermal development was executed with four panel heaters set at 109°-121°-122° C., for a time shown in Table 2 by controlling a transportation speed. The obtained image was evaluated with a densitometer.

Dmax: a saturated maximum density reached when an exposure amount is increased.

Evaluation of Unprocessed Stock Storability

An unprocessed stock storability was evaluated by measuring a sensitivity after a storage for 30 days at 40° C. and 40% RH. The sensitivity is a reciprocal of an exposure amount required for obtaining a density which is higher by 0.5 than a fog density, and is represented by a relative value, taking a sensitivity of each sample in a fresh state as 100.

Evaluation of Image Storability

A sample after thermal development was let to stand for 30 days in an environment of 25° C., 60% RH under a fluorescent lamp (illumination intensity 200 lux). A fog density ($Dmin_1$) immediately after the thermal development and a fog density ($Dmin_2$) after standing in the aforementioned environment were measured and an increase (ΔDmin) was determined as follows:

$$\Delta Dmin = Dmin_2 - Dmin_1.$$

A smaller increase of the fog density indicates a better image storability.

The obtained results are shown in Table 2.

TABLE 2

| Sample No. | Thermal dev. time | Photographic characteristics Dmax | Image storability ΔDmin | Unprocessed stock storability | Remarks |
|---|---|---|---|---|---|
| 1 | 24 | 3.7 | 0.032 | 89 | comp. ex. |
| 1 | 12 | 3.3 | 0.034 | 90 | comp. ex. |
| 2 | 24 | 3.8 | 0.008 | 86 | comp. ex. |
| 2 | 12 | 3.2 | 0.005 | 95 | invention |
| 3 | 24 | 3.7 | 0.003 | 83 | comp. ex. |
| 3 | 12 | 3.2 | 0.004 | 94 | invention |
| 4 | 24 | 3.7 | 0.003 | 82 | comp. ex. |
| 4 | 12 | 3.1 | 0.003 | 94 | invention |
| 5 | 24 | 3.8 | 0.049 | 91 | comp. ex. |
| 5 | 12 | 3.7 | 0.048 | 91 | comp. ex. |
| 6 | 24 | 3.8 | 0.008 | 87 | comp. ex. |
| 6 | 12 | 3.8 | 0.005 | 95 | invention |
| 7 | 24 | 3.7 | 0.003 | 85 | comp. ex. |
| 7 | 12 | 3.7 | 0.004 | 94 | invention |
| 8 | 24 | 3.7 | 0.003 | 84 | comp. ex. |
| 8 | 12 | 3.7 | 0.003 | 94 | invention |

Based on the results shown in Table 2:

1) Samples processed with a developing time of 12 seconds are clearly excellent in the unprocessed stock storability; and
2) Samples including the improved development accelerator and the improved reducing agent provide a high sensitivity and an image having an excellent image quality with a high image density even with a development time of 12 seconds, and are also excellent in the image storability.

Thus the present invention provides a photothermographic material excellent in the printout property and improved in the unprocessed stock storability.

What is claimed is:

1. An image forming method comprising:

image-wise exposing to a blue semiconductor laser which has a light emission peak intensity within a wavelength range of 350 to 450 nm a photothermographic material comprising, on a same surface of a support, a photosensitive silver halide having a silver iodide content of 40 to 100 mol %, a non-photosensitive organic silver salt of an aliphatic carboxylic acid including a silver behenate, a reducing agent, a binder, and an adsorbable redox compound represented by Formula (I), wherein, in Formula (I), A represents a group that can be adsorbed by silver halide; W represents a divalent connecting group; n represents 0 or 1; B represents a reducing group that is capable of reducing silver ions and is a residue derived from a compound represented Formula $B_{13}$; and thermally developing the image-wise exposed photothermographic material with a developing time of 1 to 12 seconds and with a developing temperature of 110° C. to 140° C.;

wherein in Formula $B_{13}$, $R_{b13}$, represents a hydrogen atom, an alkyl group, an aryl group or a heterocyclic group; $R_{H13}$ represents a hydrogen atom, an alkyl group, an aryl group, an acyl group, an alkylsulfonyl group or an arylsulfonyl group; $R_{b130}$ to $R_{b133}$ each independently represent a hydrogen atom or a substituent;

$A\text{-}(W)_n\text{—}B$ Formula (1)

($B_{13}$)

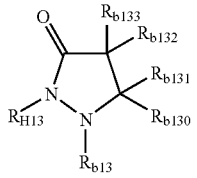

wherein the photothermographic material further includes a compound represented by the following formula (H):

$Q\text{-}(Y)_n\text{—}C(Z_1)(Z_2)X$ Formula (H)

wherein in formula (H), Q represents an alkyl group, an aryl group or a heterocyclic group; Y represents a divalent connecting group; n represents 0 or 1; $Z_1$ and $Z_2$ each independently represent a halogen atom; and X represents a hydrogen atom or an electron attracting group and wherein the reducing agent is a compound represented by the following formula (R-1):

Formula (R-1)

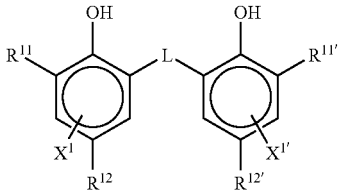

wherein in formula (R-1), $R^{11}$ and $R^{11'}$ each independently represent an alkyl group having 1 to 20 carbon atoms; $R^{12}$ and $R^{12'}$ each independently represent an alkyl group having 2 to 20 carbon atoms; L represents a —S—group or a —$CHR^{13}$— group; $R^{13}$ represents a hydrogen atom or an alkyl group having 1 to 20 carbon atoms; $X^1$ and $X^{1'}$ each independently represent a hydrogen atom or a group that can substitute a benzene ring.

2. The image forming method according to claim 1, wherein the developing time is 2 to 10 seconds.

3. The image forming method according to claim 1, wherein the thermal development is conducted at a temperature of 110° C. to 130° C.

4. The image forming method according to claim 1, wherein the photothermographic material further includes an antifogging agent.

5. The image forming method according to claim 1, wherein the photosensitive silver halide has an average grain size of 5 to 50 nm.

6. The image forming method according to claim 1, wherein the photothermographic material further includes a development accelerator.

7. The image forming method according to claim 1, wherein the photothermographic material further includes a toning agent.

8. The image forming method according to claim 1, wherein the photothermographic material further includes an ultra-high contrast agent.

9. The image forming method according to claim 1, wherein the photothermographic material further includes a matting agent.

10. The method of claim 1 wherein the silver halide has a silver iodide content of 80 to 100 mol %.

11. The method of claim 1 wherein the silver halide has a silver iodide content of 90 to 100 mol %.

12. The method of claim 1, wherein an adsorbable group represented by A is a mercapto group, a salt thereof, a thion group (—C(═S)—), a heterocyclic group containing at least an atom selected from a nitrogen atom, a sulfur atom, a selenium atom and a tellurium atom, a sulfide group, a disulfide group, a cationic group, or an ethynyl group.

13. The method of claim 1, wherein the adsorbable redox compound is represented by any of the following formulas (71) to (79):

(71)

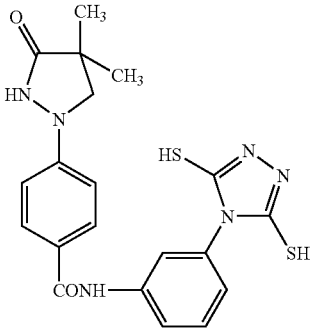

(72)

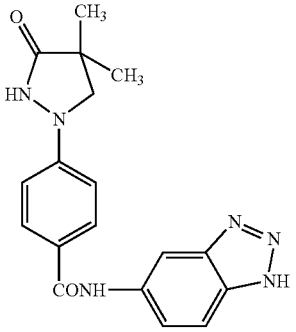

-continued (73)

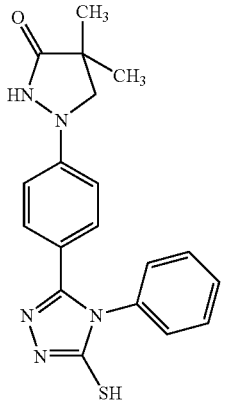

(74)

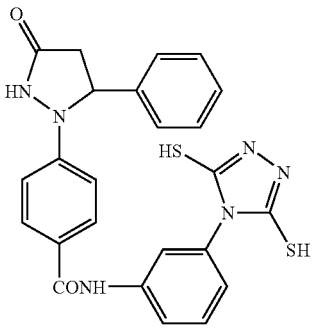

(75)

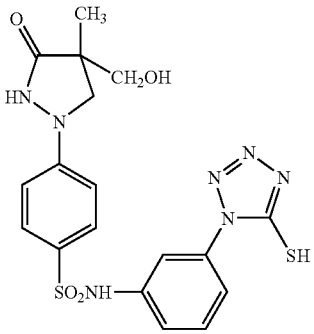

-continued (76)

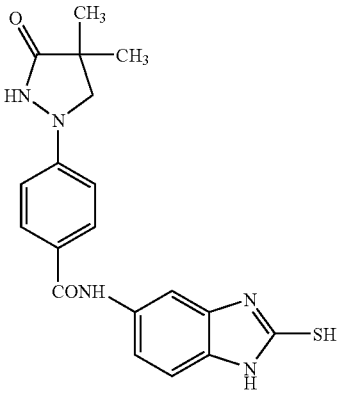

(77)

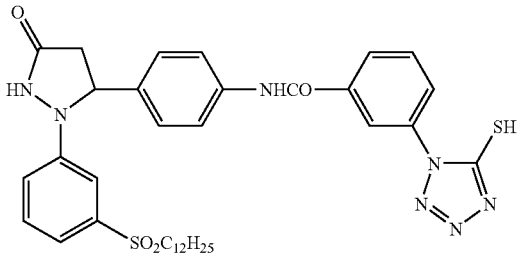

(78)

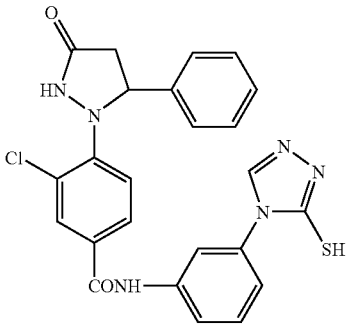

-continued (79)

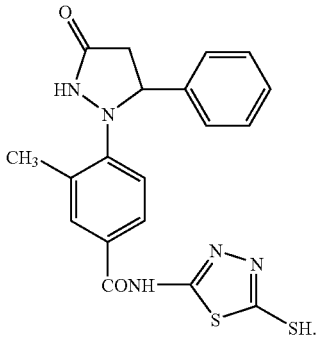

14. The method of claim 1, wherein the photothermographic material further comprises a compound represented by the following formula (H):

$$Q\text{-}(Y)_n\text{—}C(Z_1)(Z_2)X \qquad \text{Formula (H)}$$

wherein in formula (H), X is a bromine atom; Y is $SO_2$; N is 1; and Q is an aryl group or a heterocyclic group.

15. The method of claim 1, wherein the photothermographic material is thermally developed by a plate heater.

* * * * *